US010808403B2

(12) United States Patent
Bodwell et al.

(10) Patent No.: US 10,808,403 B2
(45) Date of Patent: Oct. 20, 2020

(54) STRUCTURAL SYSTEMS WITH IMPROVED SIDELAP AND BUCKLING SPANS

(71) Applicant: NUCOR CORPORATION, Charlotte, NC (US)

(72) Inventors: Patrick Allen Bodwell, Auburn, CA (US); Brian Hansen Bogh, Yucaipa, CA (US); Jeffrey Reino Martin, Fremont, CA (US)

(73) Assignee: NUCOR CORPORATION, Charlotte, NC (US)

( * ) Notice: Subject to any disclaimer, the term of this patent is extended or adjusted under 35 U.S.C. 154(b) by 0 days.

(21) Appl. No.: 16/532,145

(22) Filed: Aug. 5, 2019

(65) Prior Publication Data

US 2019/0360206 A1 Nov. 28, 2019

Related U.S. Application Data

(63) Continuation of application No. 15/463,937, filed on Mar. 20, 2017, now Pat. No. 10,370,851.

(Continued)

(51) Int. Cl.

*E04D 3/36* (2006.01)
*E04C 3/32* (2006.01)

(Continued)

(52) U.S. Cl.

CPC ..... *E04C 2/322* (2013.01); *E04C 2/08* (2013.01); *E04D 3/362* (2013.01); *E04H 9/02* (2013.01); *E04H 9/14* (2013.01)

(58) Field of Classification Search

USPC ..... 52/537, 528, 520, 481.1, 483.1

See application file for complete search history.

(56) References Cited

U.S. PATENT DOCUMENTS 107,290 A * 9/1870 Reynolds ..... E04D 3/365 52/521
182,183 A ‡ 9/1876 Ervien ..... F15B 11/048 91/24

(Continued)

FOREIGN PATENT DOCUMENTS

CA 602190 ‡ 7/1960
CN 202053595 U ‡ 11/2011

(Continued)

OTHER PUBLICATIONS

International Search Report and Written Opinion for International Application No. PCT/US17/23232 dated Aug. 10, 2017.‡

(Continued)

*Primary Examiner* — Kyle J. Walraed-Sullivan
(74) *Attorney, Agent, or Firm* — Moore & Van Allen PLLC; Jeffrey R. Gray

(57) ABSTRACT

The invention relates to structural panel systems which utilize different configurations to increase the flexibility of the panel systems. The increased flexibility of the panel systems may be achieved through the use of improved connection patterns and/or improved sidelap strength. The improved sidelap strength may be achieved through the use of a reinforcing member between edges of the panels or other sidelap configurations that improve the strength of the system along the sidelaps. The increased flexibility may also be achieved through the use of orienting flutes of the panels in the same direction as the supports members of the panel systems. The different aspects of the invention that improve the flexibility of the systems may be utilized alone or in combination with each other to improve the wall panel systems or roof panel systems, or combinations thereof, to improve the displacement capacity of the panel systems for in-plane shear loading.

20 Claims, 25 Drawing Sheets

Related U.S. Application Data

(60) Provisional application No. 62/311,257, filed on Mar. 21, 2016.

(51) Int. Cl.

| | |
|---|---|
| ***E04C 2/32*** | (2006.01) |
| ***E04C 2/08*** | (2006.01) |
| *E04D 3/362* | (2006.01) |
| *E04H 9/02* | (2006.01) |
| *E04H 9/14* | (2006.01) |

(56) References Cited

U.S. PATENT DOCUMENTS 182,193 A ‡ 9/1876 Holeton ..... E04B 9/068 52/465
324,551 A ‡ 8/1885 Goldenberg ..... 174/52
326,557 A ‡ 9/1885 Hayes ..... B21D 39/034 29/21
345,687 A ‡ 7/1886 Hayes ..... B21D 39/034 72/325
426,627 A ‡ 4/1890 Sagendorph ..... E04D 3/38 52/394
451,550 A * 5/1891 Bayer ..... E04D 3/364 52/528
453,743 A * 6/1891 Heller ..... E04D 3/364 52/522
824,551 A ‡ 6/1906 Levis ..... B21D 28/10 72/327
835,818 A * 11/1906 Divver ..... E04D 3/363 52/522
938,869 A ‡ 11/1909 Hunter ..... E04F 13/0864 52/519
968,887 A ‡ 8/1910 Roth ..... E04D 3/362 52/531
993,686 A ‡ 5/1911 Howard ..... E04F 13/04 52/417
1,094,893 A * 4/1914 Grant ..... E04D 3/362 52/531
1,292,960 A ‡ 1/1919 Owens ..... E04D 3/364 52/528
1,743,209 A ‡ 1/1930 Groehn ..... B21J 5/04 72/451
2,059,157 A * 10/1936 Turner ..... E04D 3/362 52/530
2,101,090 A * 12/1937 Palmer ..... E04B 1/08 52/210
2,108,350 A ‡ 2/1938 Roth ..... E04D 3/365 52/534
2,254,558 A ‡ 9/1941 Williams ..... B21D 39/035 403/27
2,348,724 A * 5/1944 Carpenter ..... E04F 15/04 52/261
2,511,083 A * 6/1950 Small ..... E04F 13/0864 52/547
2,602,408 A * 7/1952 Smith-Johannsen ..... E04D 3/38 52/394
2,619,855 A ‡ 12/1952 Williams ..... B21D 39/035 29/566
2,626,687 A ‡ 1/1953 Williams ..... B21D 39/035 403/28
2,668,890 A ‡ 2/1954 Latour ..... H01H 9/341 218/15
2,692,496 A * 10/1954 Thomas ..... E04B 9/00 52/597
2,829,714 A ‡ 4/1958 Kalb ..... B65B 13/305 29/21
2,847,099 A * 8/1958 Gruber ..... E04C 2/08 52/481.1
2,874,666 A ‡ 2/1959 Thor ..... B21D 39/034 29/243
2,924,312 A ‡ 2/1960 Williams ..... B21D 39/035 403/28
2,950,788 A ‡ 8/1960 Edgar ..... E04B 5/48 52/481
2,964,829 A ‡ 12/1960 Spengler ..... B21D 39/034 29/21
2,991,855 A * 7/1961 Buell ..... E04B 2/92 52/481.1
3,010,199 A ‡ 11/1961 Smith ..... B21D 39/034 29/509
3,038,573 A * 6/1962 Nuernberger ..... E04D 3/3607 52/483.1
3,110,079 A ‡ 11/1963 Novy ..... B21D 39/025 29/21
3,111,788 A ‡ 11/1963 Ouellet ..... E04B 7/107 52/537
3,141,532 A ‡ 7/1964 Runyan ..... E04D 3/3606 52/105
3,163,931 A ‡ 1/1965 Nielsen ..... B21D 39/035 29/509
3,171,689 A ‡ 3/1965 Chessrown ..... A61G 15/125 297/39
3,208,189 A ‡ 9/1965 Hickman ..... E04B 5/40 52/534
3,213,583 A * 10/1965 Winski ..... B21D 39/02 52/395
3,214,875 A * 11/1965 Slowinski ..... E04B 2/7863 52/364
3,243,930 A * 4/1966 Slowinski ..... E04B 2/7457 52/364
3,312,028 A ‡ 4/1967 Schroyer ..... E04B 9/0457 52/478
3,320,709 A * 5/1967 Schroter ..... E04D 3/362 52/478
3,332,711 A * 7/1967 Holly ..... F16B 5/0016 52/468
3,371,457 A * 3/1968 Wienand ..... E04D 1/28 52/404.4
3,377,760 A ‡ 4/1968 Waite ..... E04C 2/292 52/410
3,399,503 A ‡ 9/1968 Dyer ..... B32B 27/00 52/406
3,411,339 A ‡ 11/1968 Brown ..... E04B 5/10 72/326
3,465,414 A ‡ 9/1969 Koett ..... B21D 39/03 29/432
3,474,583 A ‡ 10/1969 Manias ..... E04B 1/7612 52/302
3,474,585 A * 10/1969 Foster ..... E04B 1/54 52/394
3,482,367 A ‡ 12/1969 Curran ..... E04B 2/58 52/309
3,511,011 A ‡ 5/1970 Straus ..... E04D 3/30 52/478
3,513,614 A ‡ 5/1970 Studzinski ..... E04D 13/1618 52/742
3,520,100 A * 7/1970 Webb ..... E04D 3/24 52/534
3,535,843 A ‡ 10/1970 Hughes ..... B62D 27/02 52/394
3,538,660 A ‡ 11/1970 Moor ..... B28B 7/06 52/242
3,568,388 A * 3/1971 Flacbarth ..... E04B 2/72 52/588.1
3,606,718 A * 9/1971 Curran ..... E04C 2/322 52/542
3,624,876 A ‡ 12/1971 Irvin ..... B21D 39/00 29/267
3,641,729 A * 2/1972 Irvin ..... B21D 39/02 52/528
3,662,509 A ‡ 5/1972 Studzinski ..... E04D 13/1618 52/404
3,714,688 A ‡ 2/1973 Olson ..... B21D 39/034 29/21
3,726,000 A ‡ 4/1973 Hafner ..... B21D 39/00 29/21
3,728,779 A ‡ 4/1973 Behlen ..... B21D 39/035 29/432

(56) References Cited

U.S. PATENT DOCUMENTS 3,818,668 A * 6/1974 Charniga ..... E04F 13/0864 52/547
3,877,280 A ‡ 4/1975 Cornell ..... B21D 31/02 29/243
3,889,437 A ‡ 6/1975 Day ..... E04D 3/364 52/520
3,909,998 A ‡ 10/1975 Simpson ..... E04B 7/22 52/223
3,924,378 A ‡ 12/1975 Hafner ..... B21D 39/035 403/27
3,982,373 A * 9/1976 Wilson ..... E04D 3/30 52/90.1
3,998,016 A * 12/1976 Ting ..... E04B 1/98 52/323
4,021,982 A ‡ 5/1977 Kotcharian ..... F16L 59/02 52/410
4,035,901 A ‡ 7/1977 Lux ..... B21D 39/035 29/243
4,063,393 A * 12/1977 Toti ..... E04B 2/7453 52/245
4,081,938 A ‡ 4/1978 Bertacchi ..... E04D 3/3602 52/410
4,128,984 A * 12/1978 Charbonneau ..... E04D 3/36 52/746.11
4,155,209 A * 5/1979 Schirmer ..... E04D 13/151 52/396.07
4,186,535 A ‡ 2/1980 Morton ..... E04B 1/24 52/250
D256,843 S ‡ 9/1980 Madsen ..... D25/11
4,224,775 A ‡ 9/1980 Heckelsberg ..... E04D 3/30 52/528
4,233,795 A * 11/1980 Snyder ..... B61D 17/12 52/45
4,314,429 A * 2/1982 Casteel ..... E04F 13/0864 33/647
4,333,280 A ‡ 6/1982 Morton ..... E04B 1/24 52/167
4,335,557 A * 6/1982 Morton ..... E04B 1/164 52/167.1
4,353,240 A ‡ 10/1982 Undin ..... H01R 43/042 72/409
4,392,295 A ‡ 7/1983 Sasai ..... B21D 51/32 220/62
4,442,581 A ‡ 4/1984 Molnick ..... B21D 39/025 269/15
4,445,305 A * 5/1984 Orie, Sr. ..... E04D 13/165 52/309.9
4,459,735 A ‡ 7/1984 Sawdon ..... B21D 39/031 29/243
4,494,343 A ‡ 1/1985 Berry ..... E04D 13/165 52/309
4,505,084 A * 3/1985 Knudson ..... B21D 13/04 52/519
4,525,976 A ‡ 7/1985 Simpson ..... E04D 3/362 52/127
4,527,544 A ‡ 7/1985 Wolf ..... A01G 9/222 126/60
4,531,397 A ‡ 7/1985 Pratt ..... B25B 7/126 29/243
4,558,584 A ‡ 12/1985 Myers ..... H01R 43/0421 7/158
4,571,975 A ‡ 2/1986 Pawloski ..... B21D 39/034 137/62
4,575,983 A ‡ 3/1986 Lott, Jr. ..... E04D 3/363 52/520
4,677,795 A * 7/1987 Mathews ..... E04D 5/142 52/222
4,700,511 A ‡ 10/1987 Minialoff ..... E04B 1/98 52/1
4,759,165 A * 7/1988 Getoor ..... E04D 3/30 29/425
4,860,514 A ‡ 8/1989 Kelly ..... E04D 5/143 52/410
4,870,798 A ‡ 10/1989 Richter ..... E04D 3/364 52/528
4,893,493 A ‡ 1/1990 Jacques ..... B25B 27/146 29/243
4,894,967 A ‡ 1/1990 Morton ..... E04B 7/00 228/18
4,934,120 A * 6/1990 Boyd ..... E04D 3/365 52/518
4,936,071 A * 6/1990 Karrfalt ..... E04D 3/38 52/420
4,962,622 A ‡ 10/1990 Albrecht ..... E04B 5/40 52/220
4,986,691 A ‡ 1/1991 Hafner ..... B21D 39/03 29/521
4,987,716 A ‡ 1/1991 Boyd ..... E04D 3/364 52/520
4,989,438 A ‡ 2/1991 Simon ..... B25B 27/146 227/11
RE33,563 E ‡ 4/1991 Heckelsberg ..... E04D 3/364 52/404
RE33,566 E ‡ 4/1991 Heckelsberg ..... E04D 3/30 52/520
5,187,911 A ‡ 2/1993 Cotter ..... E04D 3/363 52/469
5,221,183 A ‡ 6/1993 Hoeffken ..... F04D 29/4226 29/509
5,247,772 A ‡ 9/1993 Greenberg ..... B04D 3/63 52/528
5,321,927 A ‡ 6/1994 Bellem ..... E04D 3/36 52/520
5,337,535 A ‡ 8/1994 Maupin ..... E04B 1/08 52/262
5,349,801 A * 9/1994 Verbofsky ..... E04D 1/265 52/478
5,367,848 A * 11/1994 McConnohie ..... E04D 3/3608 52/334
5,381,686 A ‡ 1/1995 Thorup ..... H01R 43/0427 72/453
5,392,583 A * 2/1995 Gregory ..... E04D 3/365 52/408
5,509,291 A ‡ 4/1996 Nilsson ..... B25B 7/12 72/409
5,524,409 A ‡ 6/1996 Kaiser ..... E04C 2/08 52/537
5,600,971 A ‡ 2/1997 Suk ..... E04D 3/3608 52/470
5,619,837 A * 4/1997 DiSanto ..... E04C 2/08 52/630
5,651,221 A ‡ 7/1997 Golen ..... E06B 9/02 49/464
5,697,197 A ‡ 12/1997 Simpson ..... E04D 3/364 52/462
5,706,626 A * 1/1998 Mueller ..... E04C 2/384 52/656.2
5,715,639 A * 2/1998 Yamada ..... E04D 3/363 52/469
5,794,396 A * 8/1998 Gibbs ..... E04D 1/16 52/518
5,855,101 A * 1/1999 Schulte ..... E04D 3/3608 52/506.05
5,860,265 A * 1/1999 Knudson ..... E04C 3/07 29/509
5,878,617 A ‡ 3/1999 Parker ..... B21D 39/025 72/409
5,884,405 A ‡ 3/1999 Breeden ..... B21D 39/034 29/21
5,950,383 A * 9/1999 Williamson ..... E04D 3/38 52/408
5,976,292 A ‡ 11/1999 Barksdale ..... A47L 13/16 15/229
6,070,449 A ‡ 6/2000 Vachon ..... B21D 39/031 72/409
6,076,320 A ‡ 6/2000 Butler ..... E02D 27/02 405/22

(56) References Cited

U.S. PATENT DOCUMENTS 6,212,932 B1 ‡ 4/2001 Parker ..... B21D 39/03 72/325
6,250,036 B1 * 6/2001 Nurley ..... E04D 3/3606 52/408
6,314,699 B1 ‡ 11/2001 West ..... E04B 5/023 52/177
6,397,469 B2 ‡ 6/2002 Parker ..... B21D 39/03 29/509
6,415,557 B1 * 7/2002 McCalley ..... E04B 1/08 52/79.1
6,415,581 B1 ‡ 7/2002 Shipman ..... E04B 5/40 428/59
6,527,335 B1 ‡ 3/2003 Yurgevich ..... B62D 33/04 296/18
6,689,449 B2 * 2/2004 Hasan ..... E04D 5/142 428/124
6,889,478 B1 * 5/2005 Simpson ..... E04O 3/08 52/520
6,904,730 B2 ‡ 6/2005 Mitchell ..... E04D 3/3602 52/478
6,931,804 B2 ‡ 8/2005 Trarup ..... E02D 27/32 52/167.3
6,990,781 B2 ‡ 1/2006 Sundstrom ..... E04D 3/368 29/432
7,021,023 B2 ‡ 4/2006 Rood, Jr. ..... E04D 3/364 52/588
7,021,108 B2 ‡ 4/2006 Bodwell ..... E04D 15/04 29/243
7,104,020 B1 * 9/2006 Suttle ..... E04D 3/362 52/478
7,162,788 B2 ‡ 1/2007 Inch ..... A47L 15/0092 29/450
7,174,686 B1 * 2/2007 Legband ..... E04D 3/3608 52/462
7,353,584 B2 ‡ 4/2008 DeFreese ..... B21D 39/02 29/243
7,434,314 B2 ‡ 10/2008 Morton ..... B21D 39/021 29/243
7,434,329 B2 * 10/2008 Walda ..... E04F 21/1855 33/649
7,506,479 B2 ‡ 3/2009 Pryor ..... E04B 2/707 52/293.3
7,634,882 B1 * 12/2009 Briggs ..... E04D 3/364 52/489.1
7,874,117 B1 * 1/2011 Simpson ..... E04D 3/362 52/520
7,891,308 B2 ‡ 2/2011 Bianchi ..... B63B 3/06 114/79
7,963,083 B1 ‡ 6/2011 Briggs ..... E04D 3/364 52/489
7,984,596 B1 ‡ 7/2011 Simpson ..... E04D 3/364 52/478
D652,956 S * 1/2012 Tanaka ..... D25/138
8,104,156 B2 ‡ 1/2012 Morton ..... B21D 39/021 29/243
8,141,221 B2 ‡ 3/2012 Webb ..... B32B 3/28 29/428
8,146,314 B2 ‡ 4/2012 Nguyen ..... E04B 1/08 52/241
8,171,689 B2 ‡ 5/2012 Pierson ..... E04D 3/3603 52/394
8,322,014 B1 ‡ 12/2012 Rider ..... B21D 39/023 29/243
8,397,454 B2 * 3/2013 Commins ..... E04B 1/26 52/293.3
8,397,465 B2 * 3/2013 Hansbro ..... E04H 5/10 52/309.14
8,539,730 B2 * 9/2013 Madsen ..... E04B 1/08 52/634
8,769,908 B1 * 7/2014 Santini ..... E04C 2/38 446/123
9,010,054 B2 * 4/2015 Herdt ..... B29C 44/1214 52/220.2
9,863,146 B2 * 1/2018 Bogh ..... E04B 5/40
2001/0039704 A1 ‡ 11/2001 Parker ..... B21D 39/03 29/33 R
2002/0088199 A1 * 7/2002 Linn ..... E04C 2/26 52/745.19
2002/0174618 A1 * 11/2002 Carroll ..... E04F 21/1855 52/520
2003/0009964 A1 * 1/2003 Trarup ..... E02D 27/32 52/295
2004/0074188 A1 * 4/2004 Beck ..... E04F 13/0846 52/522
2004/0093925 A1 ‡ 5/2004 Bodwell ..... E04D 15/04 72/325
2005/0055903 A1 * 3/2005 Greenberg ..... E04D 3/364 52/198
2005/0055904 A1 * 3/2005 Greenberg ..... E04D 3/364 52/198
2005/0126105 A1 ‡ 6/2005 Leek ..... E04H 9/02 52/633
2005/0252125 A1 * 11/2005 Messing ..... E04C 2/20 52/309.9
2006/0037256 A1 * 2/2006 Pryor ..... F16B 15/0046 52/167.1
2006/0156669 A1 * 7/2006 Fukuhara ..... E04D 3/30 52/542
2006/0272258 A1 * 12/2006 Pollock ..... E04F 21/1855 52/543
2008/0190065 A1 * 8/2008 Craig ..... E06B 9/02 52/586.1
2009/0000246 A1 * 1/2009 Chang ..... E04C 2/36 52/783.11
2009/0044477 A1 * 2/2009 Simpson ..... E04D 3/364 52/520
2009/0107075 A1 ‡ 4/2009 Bodwell ..... E04D 3/30 52/582
2009/0113833 A1 * 5/2009 Horton ..... E04D 3/363 52/521
2009/0272060 A1 * 11/2009 Lucchesi ..... E04D 3/362 52/489.1
2010/0058693 A1 * 3/2010 Plumley ..... E04H 9/14 52/384
2010/0115858 A1 * 5/2010 Olsen ..... E04H 9/14 52/79.1
2011/0113725 A1 * 5/2011 Garry ..... B21D 47/04 52/838
2012/0042597 A1 * 2/2012 Ray ..... E04D 3/3608 52/582.1
2013/0047542 A1 * 2/2013 Rider ..... E04D 3/364 52/528
2013/0074434 A1 ‡ 3/2013 Wiens ..... B21D 39/032 52/528
2014/0290473 A1 * 10/2014 Lorenzo ..... B32B 27/365 89/36.02
2014/0331588 A1 * 11/2014 Bolo ..... E04D 3/352 52/547
2014/0345223 A1 * 11/2014 Miks ..... E04B 1/7637 52/309.4
2015/0308116 A1 * 10/2015 Bogh ..... E04B 5/40 52/579
2015/0322686 A1 * 11/2015 Harper ..... E04H 9/10 52/481.1
2016/0333584 A1 * 11/2016 Bogh ..... E04D 3/362
2017/0081870 A1 * 3/2017 Hensen ..... E04H 1/12
2017/0275872 A1 * 9/2017 Yu ..... E04D 3/30
2018/0038104 A1 * 2/2018 Tipping ..... B32B 3/266

FOREIGN PATENT DOCUMENTS

CN 202108134 U ‡ 1/2012
DE 2423226 A1 ‡ 11/1975 ..... B21D 5/01
DE 10003188 A1 ‡ 7/2000 ..... E04D 3/3602
GB 875213 A ‡ 8/1961 ..... E04D 3/3602
GB 2397074 A ‡ 7/2004 ..... E04B 5/40
JP 57165550 A ‡ 10/1982

(56) References Cited

FOREIGN PATENT DOCUMENTS

| | | | | |
|---|---|---|---|---|
| WO | WO-9743494 | A1 ‡ | 11/1997 | ..... E04F 13/0837 |
| WO | WO-0047836 | A1 ‡ | 8/2000 | ..... E04B 2/842 |
| WO | WO-2004106661 | A1 ‡ | 12/2004 | ..... E04B 5/40 |
| WO | WO-2006125248 | A1 ‡ | 11/2006 | ..... E04B 5/40 |
| WO | WO-2007119749 | A1 ‡ | 10/2007 | ..... E04C 2/322 |

OTHER PUBLICATIONS

International Search Report and Written Opinion for International Application No. PCT/US16/32402 dated Sep. 1, 2016.‡

* cited by examiner
‡ imported from a related application

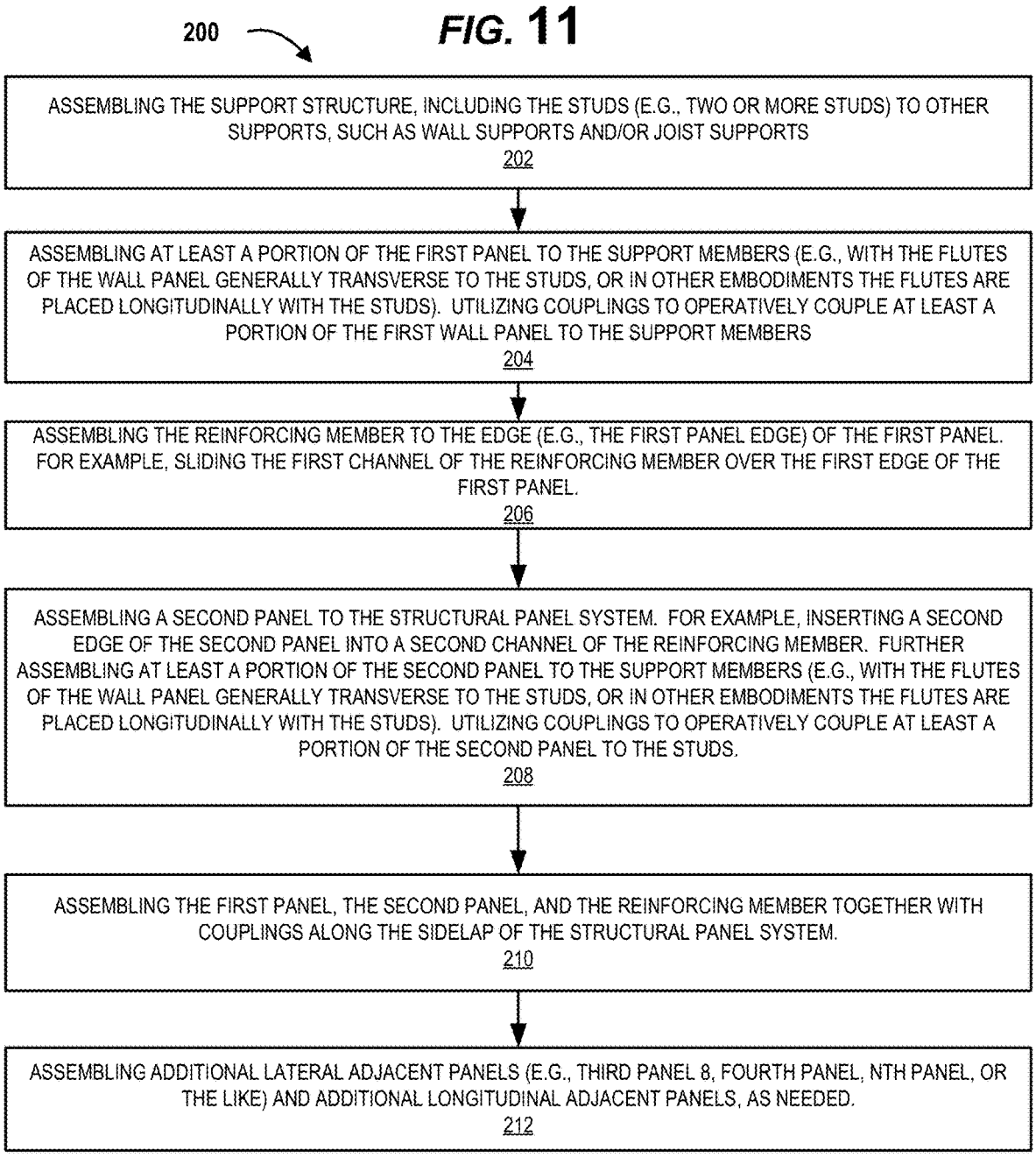
200
FIG. 11
ASSEMBLING THE SUPPORT STRUCTURE, INCLUDING THE STUDS (E.G., TWO OR MORE STUDS) TO OTHER SUPPORTS, SUCH AS WALL SUPPORTS AND/OR JOIST SUPPORTS
202
ASSEMBLING AT LEAST A PORTION OF THE FIRST PANEL TO THE SUPPORT MEMBERS (E.G., WITH THE FLUTES OF THE WALL PANEL GENERALLY TRANSVERSE TO THE STUDS, OR IN OTHER EMBODIMENTS THE FLUTES ARE PLACED LONGITUDINALLY WITH THE STUDS). UTILIZING COUPLINGS TO OPERATIVELY COUPLE AT LEAST A PORTION OF THE FIRST WALL PANEL TO THE SUPPORT MEMBERS
204
ASSEMBLING THE REINFORCING MEMBER TO THE EDGE (E.G., THE FIRST PANEL EDGE) OF THE FIRST PANEL. FOR EXAMPLE, SLIDING THE FIRST CHANNEL OF THE REINFORCING MEMBER OVER THE FIRST EDGE OF THE FIRST PANEL.
206
ASSEMBLING A SECOND PANEL TO THE STRUCTURAL PANEL SYSTEM. FOR EXAMPLE, INSERTING A SECOND EDGE OF THE SECOND PANEL INTO A SECOND CHANNEL OF THE REINFORCING MEMBER. FURTHER ASSEMBLING AT LEAST A PORTION OF THE SECOND PANEL TO THE SUPPORT MEMBERS (E.G., WITH THE FLUTES OF THE WALL PANEL GENERALLY TRANSVERSE TO THE STUDS, OR IN OTHER EMBODIMENTS THE FLUTES ARE PLACED LONGITUDINALLY WITH THE STUDS). UTILIZING COUPLINGS TO OPERATIVELY COUPLE AT LEAST A PORTION OF THE SECOND PANEL TO THE STUDS.
208
ASSEMBLING THE FIRST PANEL, THE SECOND PANEL, AND THE REINFORCING MEMBER TOGETHER WITH COUPLINGS ALONG THE SIDELAP OF THE STRUCTURAL PANEL SYSTEM.
210
ASSEMBLING ADDITIONAL LATERAL ADJACENT PANELS (E.G., THIRD PANEL 8, FOURTH PANEL, NTH PANEL, OR THE LIKE) AND ADDITIONAL LONGITUDINAL ADJACENT PANELS, AS NEEDED.
212

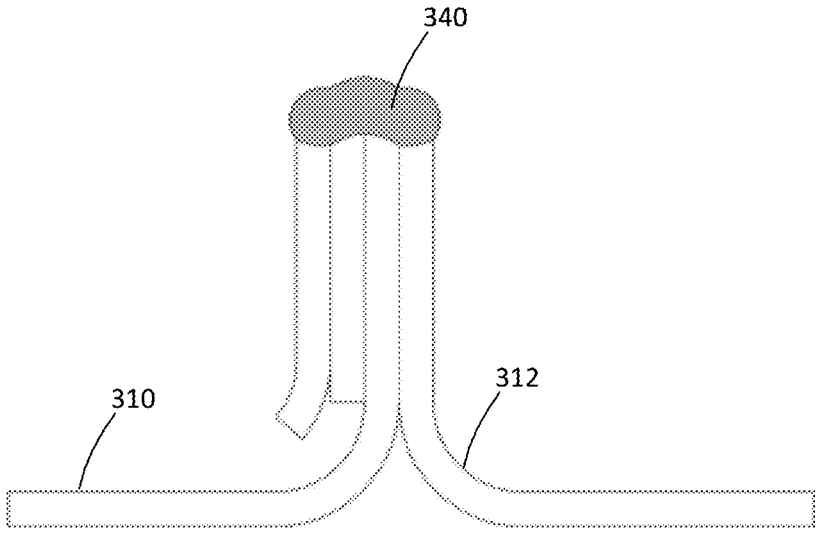
FIG. 14A
FIG. 14B
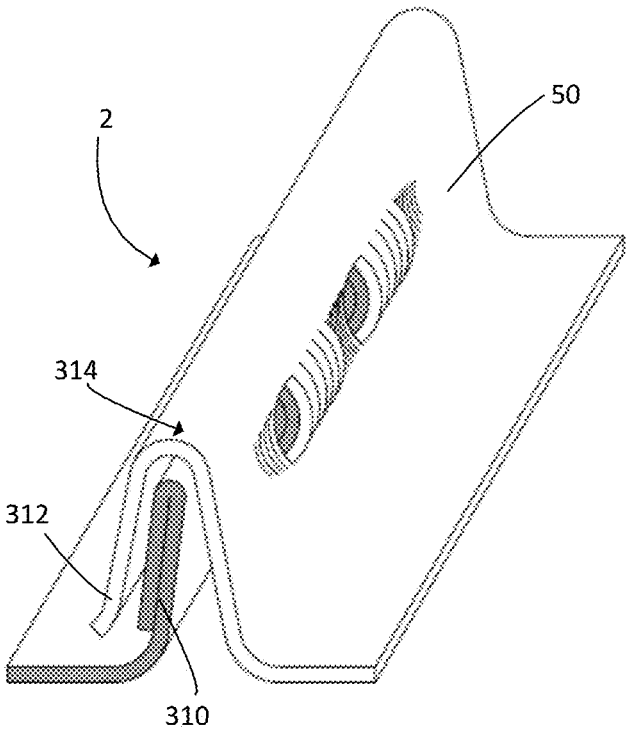

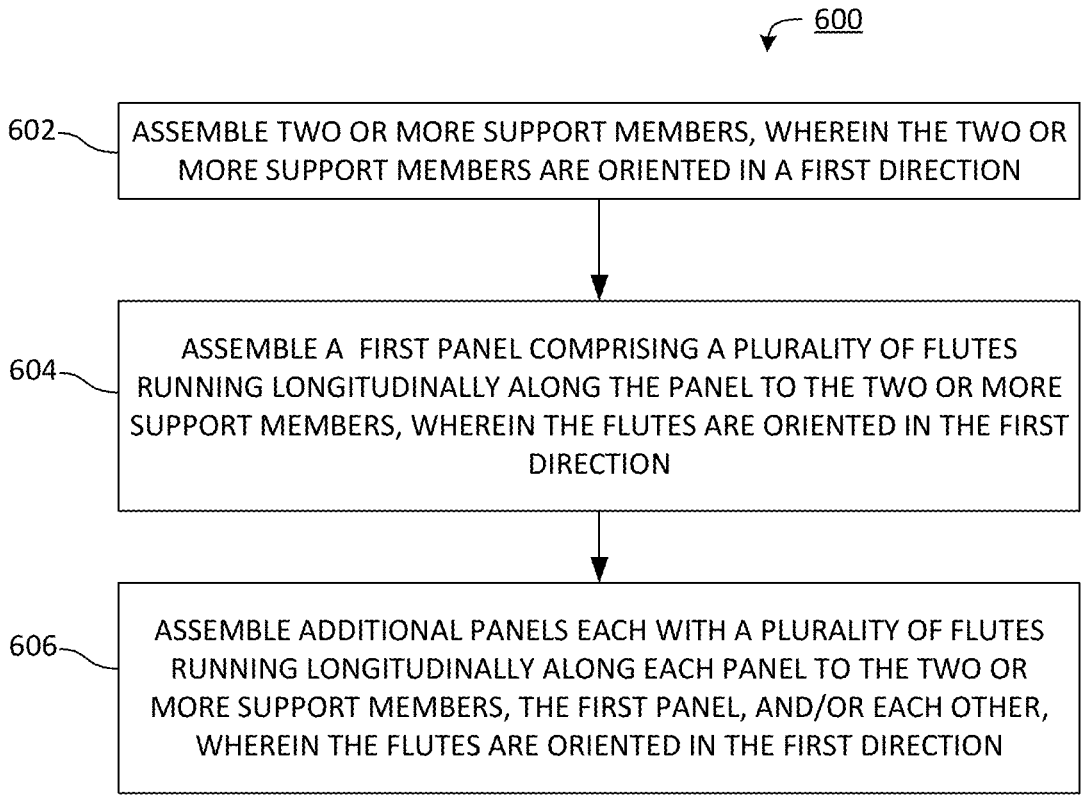
*FIG.* 24

STRUCTURAL SYSTEMS WITH IMPROVED SIDELAP AND BUCKLING SPANS

CROSS REFERENCE AND PRIORITY CLAIM

The present application for a patent claims priority to U.S. Pat. No. 10,370,851 entitled "Structural System with Improved Sidelap and Buckling Spans" filed on Mar. 20, 2017 and issued on Aug. 6, 2019, which claims priority to U.S. Provisional Patent Application Ser. No. 62/311,257 entitled "Structural Wall and Roof Panel Systems Having Panel Seams With Improved Strength and Connection Configurations that Improve Ductility" filed on Mar. 21, 2016, both of which are assigned to the assignees hereof and hereby expressly incorporated by reference herein.

FIELD

This application relates generally to the field of structural panel systems, and more particularly to structural wall, roof, and floor panel systems with improved ductility due to improved shear strength at the sidelaps created between adjacent structural panels and improved connection configurations that create buckling spans within the structural panel systems.

BACKGROUND

Structural wall, roof, or floor panels (collectively "structural panels") are used in commercial or industrial construction (and in some cases residential construction), for example, in commercial buildings, industrial buildings, institutional buildings, or the like. Structural panels, may be typically manufactured from steel sheets, which may or may not be coiled. In order to increase the structural strength and the stiffness of the individual steel sheets, structural panels with longitudinal flutes are formed from the steel sheets via roll forming, break forming, bending, stamping, or other like processes. The structural panels are secured to each other in order to form a structural panel system when installed (e.g., wall system, roof system, floor system, or combination thereof). The structural panels are also connected to the other load resisting structural support members of a building, such as studs, joists, support beams, or the like to create the structural panel system.

In geographic regions that are prone to seismic activity (e.g., earthquakes) and/or high winds, the structural panels are solidly connected to each other and to the other load resisting structural members of the building so that the building is better able to withstand shear forces (e.g., in-plane and out-of-plane shear forces) created by the seismic activity and/or high winds. The structural panels are connected to reduce, or eliminate excessive, out-of-plane separation of structural panels, or longitudinal movement between the edges of the panels at the sidelap. To this end, the sidelap between adjacent structural panels is joined in such a way as to create resistance in-plane along the length of the sidelap (e.g., parallel with the decking) to thereby carry loads (e.g., resist forces) and prevent displacement between the structural panels along the sidelap. In addition, the connection of the structural panels at the sidelap also creates resistance out-of-plane along the sidelap (e.g., perpendicular to the decking) to thereby carry loads and prevent one panel lifting off an adjacent panel. As such, the connections along the sidelap and connections of the panel to underlying supports maintains the structural integrity of the diaphragm strength of the panel system.

BRIEF SUMMARY

Structural panels utilized within a structural panel system of a building typically include longitudinal flutes (e.g., upper flange, lower flange, and webs that form a single flute as discussed in further detail later) that run longitudinally along the length of the panel in order to provide structural strength to the panels, and thus, to the structural panel system and building system. The structural panels typically comprise two edges and two ends. The edges of structural panels run parallel with the longitudinal flutes, while the ends of the structural panel run perpendicular (or transverse) to the longitudinal flutes. As such, one edge of the structural panels may be described as a "first edge" (or a "top edge" or "left edge") while the second edge of the structural panels may be described as a "second edge" (or a "bottom edge" or "right edge"). The ends of the structural panels may be described as a "first end" (or a "top end" or "left end") and a "second end" (or a "bottom end" or "right end").

The preset invention relates to structural panel systems, and in particular ductile fluted panel systems, which incorporate various embodiments of the present invention to improve the ductility of typical structural wall, floor, or roof panel systems. The ductile fluted panel systems of the present invention incorporate improved strength along the sidelaps between adjacent panels, as well as various connection configurations between the panels and the underlying supports in order to create buckling spans. The buckling spans allow for buckling of the panel upon reaching the ultimate load of the system before the connections fail. After reaching the ultimate load of the system, during subsequent loading, the capacity of the ductile fluted panel system is reduced; however, the ductile fluted panel system may continue to buckle over time under loading below the reduced capacity to prolong the diaphragm system strength of the ductile fluted panel system.

In stiff structural panel systems, upon reaching the ultimate load of the system, the connections within the system, which utilize couplings (e.g., fasteners, welds, sheared tabs, or the like) to operatively couple the panels to each other and/or to the support members, fail first. For example, the couplings between the panels and the support members (e.g., studs, or the like) will pull out of the support members, the panels will tear around the couplings, and/or the couplings will shear (e.g., fasteners will shear, welds will fail, or the like). After the failure of the connections, the diaphragm system strength rapidly degrades under subsequent loading.

The ductile fluted panel systems of the present invention improve upon the ductility of structural panels systems in order to provide prolonged diaphragm strength after ultimate loading, and thus, prolonged life of the structural panel system. The ductile fluted panel systems are of particular use within cyclic loading (e.g., in the case of seismic loading, or the like) because after being loaded past the ultimate load, additional loading of the ductile fluted panel systems result in the ductile fluted panels expanding and contracting to maintain the diaphragm system strength of the building system at the reduced capacity.

In order to achieve the ductile fluted panels systems of the present invention, the shear strength along the sidelaps of the adjacent ductile panels is improved, and the connection configurations of the panels to the underlying supports is made in order to allow the panels to buckle before the connections at the panel edges and/or at the support structures fail.

As such, in some embodiments of the invention a reinforcing member may be utilized within a sidelap between panels, a four-layer sidelap seam may be created at the sidelap between panels, a three or four-layer nested sidelap may be created at the sidelap between panels, or other like sidelaps may be created in order to improve the strength of the sidelaps between adjacent panels. When couplings are created in these types of sidelaps, the shear strength of the sidelap is improved over typical wall or roof sidelaps having overlapping edges (e.g., two-layer overlapping edges) and/or three-layer interconnected edges. The connections created by the couplings in these sidelaps creates improved shear strength along the sidelaps.

In some embodiments of the invention, a reinforcing member (otherwise described herein as a "reinforcement member") may be utilized to increase the strength of the sidelap. The reinforcing member may include a first channel and a second channel. The channels in some embodiments may be U-shaped channels (or any other shaped channel), and may have openings on opposite sides, thus forming a generally S-shaped reinforcing member. As such, the reinforcing member may include a first leg, a second leg, and a third leg. The first leg and the second leg may be operatively coupled together to form the first channel, while the second leg and the third leg may be operatively coupled together to form the second channel. The reinforcing member is utilized between the edges of two lateral adjacent structural panels (e.g., wall panels, roof panels, or the like) such that the first edge of a first panel is inserted into the first channel, and the second edge of the second panel is inserted into the second channel (or otherwise the first channel and/or second channel are inserted over the edges of the first panel and the second panel). In some embodiments, when assembled a five-layer sidelap is created between the first panel, the second panel, and the reinforcing member. Connections are made using couplings at the sidelap (e.g., the sidelap created by the first edge of the first panel, the second edge of the second panel, and the reinforcing member), and thus, a panel system is created that has improved shear strength and stiffness along the sidelap. The improved strength and stiffness at the sidelap may allow for utilization of other connection configurations in the structural panel system that improve the flexibility (e.g., reduce stiffness) of the overall structural panel system.

In some embodiments of the invention, a sidelap seam configuration (e.g., standing interlocking out-of-plane edges) that has three layers may be used with the connection configurations described herein. Alternatively, a sidelap seam configuration that has four or more layers may be utilized to increase the strength and stiffness of the sidelap seam. When couplings (e.g., the connection configurations) are utilized to secure the four or more layers of the sidelap seam, the sidelap seam has improved strength and/or stiffness over other sidelap seams that utilize a two or three layer configuration. The improved strength and stiffness at the sidelap seam may allow for utilization of other configurations that improve the flexibility (e.g., reduce stiffness) of the overall structural panel system, such as the connection configurations discussed herein.

In still other embodiments of the invention, a nested sidelap (e.g., in-plane overlapping nested edges) that has two layers may be used with the connection configurations described herein. Alternatively, a nested sidelap that has three or more layers (e.g., three, four, five, or the like layers), may be utilized to increase the strength and stiffness of the nested sidelap. When couplings are utilized to secure the nested sidelap, the nested sidelap has improved strength and/or stiffness over other steams that utilize two overlapping layers. The improved strength and stiffness at the sidelap may allow for utilization of other configurations that improve the flexibility (e.g., reduce stiffness) of the overall structural panel system, such as the connection configurations discussed herein.

In addition to strengthening the sidelap of the ductile fluted panel systems, in order to achieve the ductile fluted panel systems of the present invention, buckling spans are created in the panels, such that the panels will buckle before the connections formed from the couplings within the panel systems fail. The buckling spans are created by reducing or eliminating the connections made using the couplings at the locations where the panels cross one or more of the intermediate support members. In some cases this may include where the sidelap crosses one or more of the intermediate support members.

As such, some embodiments of the invention include connection configurations in which the ends of the structural panels are operatively coupled (e.g., directly coupled or coupled through other components) to supports members (e.g., outer support members, such as outer studs) and/or the ends of adjacent panels through couplings, and the edges of the structural panels are operatively coupled to the edges of adjacent panels and/or support members through couplings. However, the structural panels are not coupled (e.g., within the body of the structural panels) to support members at locations at which the structural panels cross intermediate support members (e.g., at locations between the ends or edges of the structural panels). In other embodiments, it may be beneficial to reduce the buckling span of longer panels, as will be described in further detail later, and as such, the structural panels may be operatively coupled to one intermediate support member and/or alternating intermediate support members at locations between the ends or edges of the structural panels (e.g., between the outer support members). In some embodiments, when the sidelap of two adjacent panels cross a support member, the sidelap may or may not be coupled to the support members, such as one or more of the intermediate support members. Various connection configurations for the structural panel systems will be described in further detail herein. The couplings used to create the connections in the panel systems are typically screws, however other couplings may include welds, rivets, bolts, cut or sheared couplings, clinch couplings and/or other suitable fasteners. It should be understood that different couplings may be used in different areas in order to achieve the desired diagram strength and flexibility of the ductile fluted panel system and create the desired bucking spans for the cyclic loading.

The increased strength of the sidelaps between adjacent panels and/or the connection configurations, alone or in combination, provide the ability to create the buckling spans within the ductile fluted panel system, such that ductile fluted panel systems may prolong the life of the structural panel system. As discussed, the configurations of the present invention provide for improved structural panel systems, and in particular, for ductile fluted panel systems used in buildings that are more prone to seismic activity.

The ductile fluted panel systems described above may be achieved through other types of configurations of the present invention. For example, in some embodiments of the invention instead of the longitudinal flutes running perpendicularly with respect to the support members, the longitudinal flutes may run parallel the with support members to achieve the improvements described above in another way. When the longitudinal flutes run parallel with the support members, upon cycle loading the panels will buckle before the connections fail. This configuration may be utilized apart from, or together with, the embodiments of the present invention that improves the sidelap strength and/or increases the buckling span (e.g., improved strength at the sidelap between panels, and/or the connection configurations described herein). Having longitudinal flutes that run parallel with the support members may achieve the same general results as the other configurations described herein, however this embodiment of the invention may or may not provide the desired system strength before and/or after buckling, or may or may not provide the desired strength for other types of loading, when compared to the other configurations described herein. As such, the ductile fluted panel systems that use the improved strength at the sidelap between panels and the connection configurations described herein provides another, and potentially improved, way of achieving the ductile fluted panel system in which the longitudinal flutes run parallel the with support members.

Embodiments of the invention comprise structural panel system comprising a first support member, a second support member, and one or more intermediate support members. The system further comprises a first panel comprising first flutes, opposing ends, and opposing edges comprising at least a first edge, and a second panel comprising second flutes, opposing ends, and opposing edges comprising at least a second edge. The first panel and the second panel are oriented generally perpendicular with the first support member, the second support member, and the one or more intermediate support members. The system further comprises a sidelap formed between the first edge of the first panel and the second edge of the second panel. Panel edge couplings operatively coupling the first edge of the first panel to the second edge of the second panel, and end support couplings operatively coupling the opposing ends of the first panel and the second panel to the first support member and the second support member. The system is formed such that the first panel and second panel are void of couplings where the first panel and second panel cross at least one of the one or more intermediate support members.

In further accord with embodiments of the invention, the structural panel system further comprising edge support couplings further operatively coupling the first edge of the first panel to the second edge of the second panel and to the one or more intermediate support members where the sidelap crosses the one or more intermediate support members. However, the first panel and second panel are void of couplings where the first panel and the second panel cross at least one of the one or more intermediate support members, except for the edge support couplings.

In other embodiments of the invention, the structural panel system further comprises a reinforcing member comprising a first channel and a second channel. When assembled in the sidelap, the first edge of the first panel is located within the first channel, and the second edge of the second panel is located within the second channel to form the sidelap. Moreover, the panel edge couplings operatively couple the first edge of the first panel, the second edge of the second panel, and the reinforcing member together.

In yet other embodiments of the invention, the sidelap comprises a sidelap seam that is out-of-plane and formed from the first edge of the first panel being a male lip and the second edge of the second panel being a female lip, wherein the male lip and the female lip form the sidelap seam comprising four or more layers.

In still other embodiments of the invention, the sidelap comprises a nested sidelap that is in-plane and formed from the first edge of the first panel being an in-plane edge and the second edge of the second panel being an in-plane edge, wherein the first edge and the second edge form the nested sidelap comprising three or more layers.

In further accord with embodiments of the invention, the one or more intermediate supports comprise at least three or more intermediate supports, and wherein the structural panel system further comprises panel support couplings in the middle intermediate support of the three or more intermediate supports to reduce the buckling span of the first panel and the second panel.

In other embodiments of the invention, the structural panel system comprises a ductile fluted roof panel system.

In still other embodiments of the invention, the structural panel system comprises a ductile fluted wall panel system.

Other embodiments of the invention comprise structural panel system comprising a first support member, a second support member, and one or more intermediate support members. The structural panel system further comprises a first panel comprising first flutes, opposing ends, and opposing edges comprising at least a first edge, and a second panel comprising second flutes, opposing ends, and opposing edges comprising at least a second edge. The first panel and the second panel are oriented generally perpendicular with the first support member, the second support member, and the one or more intermediate support members. The system further comprises a sidelap formed between the first edge of the first panel and the second edge of the second panel. The system further comprises panel edge couplings operatively coupling the first edge of the first panel to the second edge of the second panel, and end support couplings operatively coupling the opposing ends of the first panel and the second panel to the first support member and the second support member. The first panel and second panel are void of couplings where the first panel, the second panel, and the sidelap of the first panel and second panel cross at least one of the one or more intermediate support members.

In further accord with embodiments of the invention, the structural panel system further comprises edge support couplings further operatively coupling the first edge of the first panel to the second edge of the second panel and to the one or more intermediate support members where the sidelap crosses the one or more intermediate support members. Moreover, the first panel and second panel are void of couplings where the first panel and the second panel cross at least one of the one or more intermediate support members, except for the edge support couplings.

In other embodiments of the invention, the structural panel system further comprises a reinforcing member comprising a first channel and a second channel. When assembled in the sidelap, the first edge of the first panel is located within the first channel, and the second edge of the second panel is located within the second channel to form the sidelap. Moreover, the panel edge couplings operatively couple the first edge of the first panel, the second edge of the second panel, and the reinforcing member together.

In yet other embodiments of the invention, the sidelap comprises a sidelap seam that is out-of-plane and formed from the first edge of the first panel being a male lip and the second edge of the second panel being a female lip, wherein the male lip and the female lip form the sidelap seam comprising four or more layers.

In still other embodiments of the invention, the sidelap comprises a nested sidelap that is in-plane and formed from the first edge of the first panel being an in-plane edge and the second edge of the second panel being an in-plane edge, wherein the first edge and the second edge form the nested sidelap comprising three or more layers.

In further accord with embodiments of the invention, the one or more intermediate supports comprise at least three or more intermediate supports, and wherein the structural panel system further comprises panel support couplings in the middle intermediate support of the three or more intermediate supports to reduce the buckling span of the first panel and the second panel.

In other embodiments of the invention, the one or more intermediate supports comprise at least three or more intermediate supports, and wherein the structural panel system further comprises panel support couplings in the middle intermediate support of the three or more intermediate supports to reduce the buckling span of the first panel and the second panel.

In yet other embodiments of the invention, the structural panel system comprises a ductile fluted roof panel system.

In still other embodiments of the invention, the structural panel system comprises a ductile fluted wall panel system.

Other embodiments of the invention comprise a structural panel system comprising two or more support members, a first panel comprising first flutes, opposing ends, and opposing edges comprising at least a first edge, and a second panel comprising second flutes, opposing ends, and opposing edges comprising at least a second edge. The first panel and the second panel are oriented generally perpendicular with the two or more support members. The system further comprises a reinforcing member comprising a first channel and a second channel, wherein when assembled the first edge of the first panel is located within the first channel, and the second edge of the second panel is located within the second channel to form a sidelap. Moreover, couplings operatively couple the first panel and second panel to the two or more support members.

In further accord with embodiments of the invention, the reinforcing member comprises a first leg and a second leg forming the first channel, and a third leg and the second leg forming the second channel. The first channel and the second channel are open in opposite directions, and wherein the reinforcing member comprises three layers and when assembled with the first edge of the first panel and the second edge of the second panel forms the sidelap with least five layers.

In yet other embodiments of the invention, the couplings comprise panel edge couplings operatively coupling the first edge of the first panel to the second edge of the second panel, edge support couplings operatively coupling the first edge of the first panel, the second edge of the second panel, and the one or more intermediate support members when the sidelap crosses the one or more intermediate support members, and end support couplings operatively coupling the opposing ends of the first panel and the second panel to the first support member and the second support member. The first panel and second panel are void of couplings where the first panel and second panel cross at least one of the one or more intermediate support members, except for the edge support couplings.

In still other embodiments of the invention, the two or more support members comprise a first support member, a second support member, and one or more intermediate support members. The one or more intermediate supports comprise at least three or more intermediate supports, and wherein the structural panel system further comprises panel support couplings in the middle intermediate support of the three or more intermediate supports to reduce the buckling span of the first panel and the second panel.

To the accomplishment of the foregoing and the related ends, the one or more embodiments of the invention comprise the features hereinafter fully described and particularly pointed out in the claims. The following description and the annexed drawings set forth certain illustrative features of the one or more embodiments. These features are indicative, however, of but a few of the various ways in which the principles of various embodiments may be employed, and this description is intended to include all such embodiments and their equivalents.

BRIEF DESCRIPTION OF DRAWINGS

The foregoing and other advantages and features of the invention, and the manner in which the same are accomplished, will become more readily apparent upon consideration of the following detailed description of the invention taken in conjunction with the accompanying drawings, which illustrate embodiments of the invention and which are not necessarily drawn to scale, wherein:

FIG. 11 illustrates a flow chart of the process for assembling the structural wall panel system, in accordance with embodiments of the invention.

FIG. 14A illustrates a cross-sectional view of a top sidelap seam weld coupling in a sidelap seam with a male lip with a closed inward fold located within a female lip, in accordance with embodiments of the invention.

FIG. 14B illustrates a perspective view of a sheared and deformed coupling in a sidelap seam having a male lip with a closed outward fold located within a female lip, in accordance with embodiments of the invention.

FIG. 24 is a high-level process flow for assembling a ductile wall panel system, in accordance with embodiments of the invention.

DETAILED DESCRIPTION

Embodiments of the present invention may now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

A key to developing safe, economical, and high performance shear systems using structural panels is the ductility of the system. The ductile fluted panel system described herein is able to go through large in-plane shear displacement cycles prior to and after the peak shear load is reached. As previously discussed, some embodiments of the invention include configurations in which the ends of the structural panels are coupled to support members and/or ends of adjacent panels through couplings, and the edges of the structural panels are coupled to the edges of adjacent panels and/or to support members through couplings. However, the structural panels are not coupled within the body of the structural panels where the panels cross support members at locations between the ends or edges of the structural panels. Alternatively, the structural panels are only connected to one support member and/or alternating support members at locations between the ends or edges of the structural panels where the structural panels cross the support members. In this way, buckling spans are created in the panels that improve the ductility of the structural panel system while having the same or similar structural strength. Various connection configurations for structural panel systems are described in further detail herein, which result in an improved ductile fluted panel system.

Figure 1:
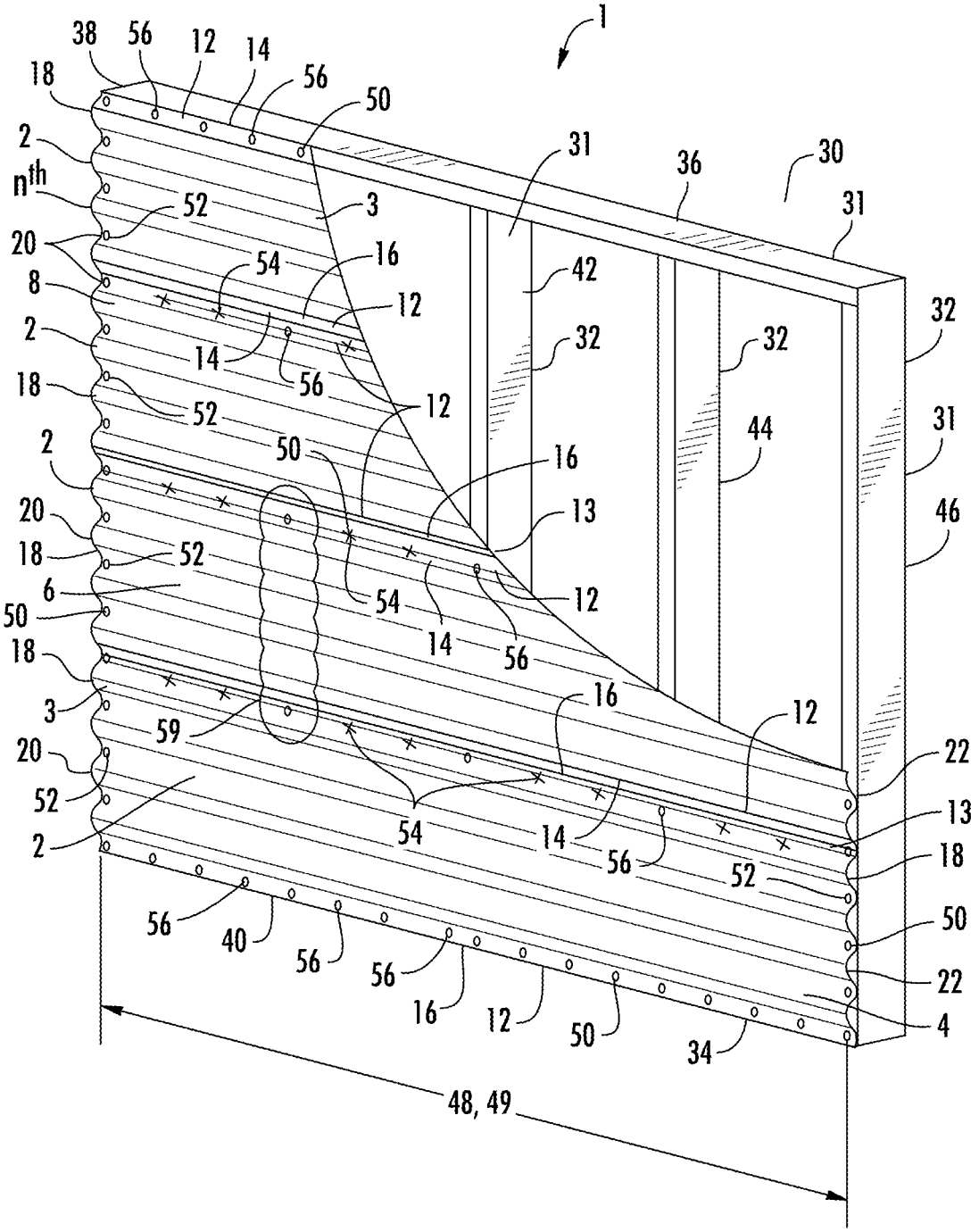
FIG. 1 illustrates a perspective view of a portion of a structural wall panel system having wall panels orientated transverse to studs and a specific connection configuration, in accordance with embodiments of the invention.

FIG. 1 illustrates a perspective view of one embodiment of the present invention for a portion of a ductile fluted wall panel system 1, wherein the panels 2 are operatively coupled to a support structure 30 using couplings 50 at connection locations (otherwise described herein as a joint, attachment, or the like locations) in order to create a panel buckling span length that is long enough to allow the panel to buckle rather than have connection failures at the ultimate shear capacity of the ductile fluted wall panel system 1. The ductile fluted wall panel system 1 includes the structural wall panels 2, such as a first wall panel 4, a second wall panel 6, a third wall panel 8, and an $n^{th}$ wall panel located laterally adjacent to one another, and configured to form at least a portion of the ductile fluted wall panel system 1. Each panel 2 may include edges 12, such as a first edge 14 and a second edge 16, as well as ends 18, such as a first end 20 and a second end 22. Sidelaps 13 are formed between adjacent edges 12 of the panels 2. Couplings 50 may be made in the sidelaps 13, and operatively couple, the first edge 14 and the second edge 16 of each lateral adjacent panel 2 within the ductile fluted wall panel system 1. Additionally, the ends 18 of each panel 2 may be operatively coupled to longitudinally adjacent structural wall panels 2, for example, the first end 20 of a first panel 4 may be operatively coupled to a second end 22 of a longitudinally adjacent panel (not illustrated in FIG. 1). As described herein, laterally adjacent panels 2 are panels 2 located parallel to each other and to the longitudinally extending flutes 3 of each panel 2, while the longitudinally adjacent panels are panels 2 located in series with each other and to the longitudinally extending flutes 3 of the panels 2.

Figure 2:
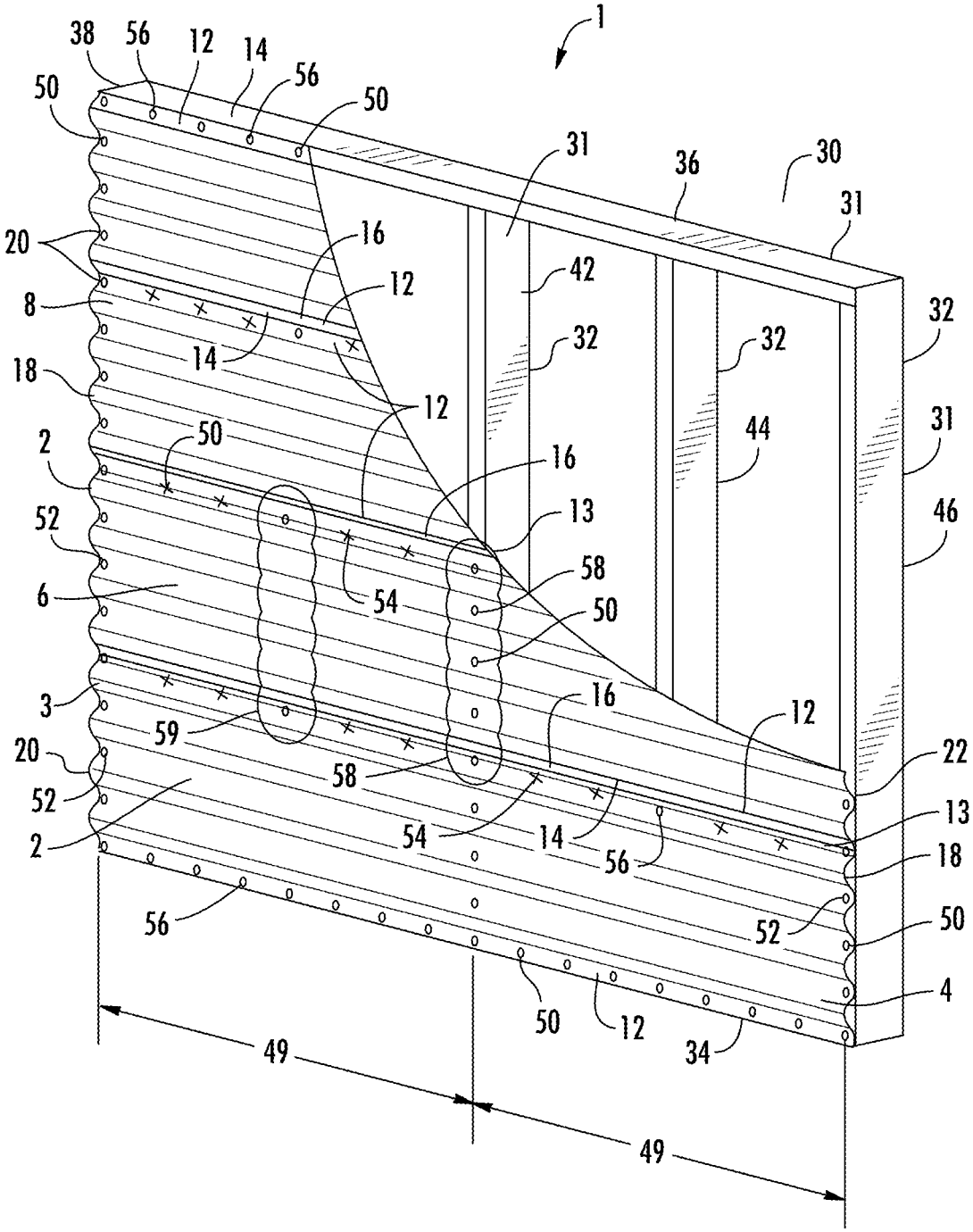
FIG. 2 illustrates a perspective view of a portion of a structural wall panel system having wall panels orientated transverse to studs and a specific connection configuration, in accordance with embodiments of the invention.

In some embodiments, as illustrated in FIGS. 1 and 2 the ductile fluted wall panel system 1 further includes a support structure 30. The support structure 30 may include support members 31. In some embodiments the support members 31 may be studs 32 (e.g., a first stud 38, a second stud 40, a third stud 42, a fourth stud 44, a fifth stud 46, and an $n^{th}$ stud), a lower cap 34, and an upper cap 36. The support structure 30 may further include other support members 31, such as joists, trusses, purlins, beams, or any other type of support members 31 that may be included in a building structure. As such, in some embodiments, as illustrated in FIG. 1, the ends 18 of each of the wall panels 2 (e.g., the first end 20 of a first wall panel 4 and the second end 22 of a longitudinally adjacent wall panel) may be operatively coupled to the support members 31 (e.g., the studs 32, such as the first stud 38 and the fifth stud 46) in the ductile fluted wall panel system 1. The components of the support structure 30 and support members 31 within the support structure 30, such as the studs 32, joists, support beams, or the like may be made of any material including, but not limited to, wood beams, metal beams, plastic material, composite material, or the like.

Figure 8:
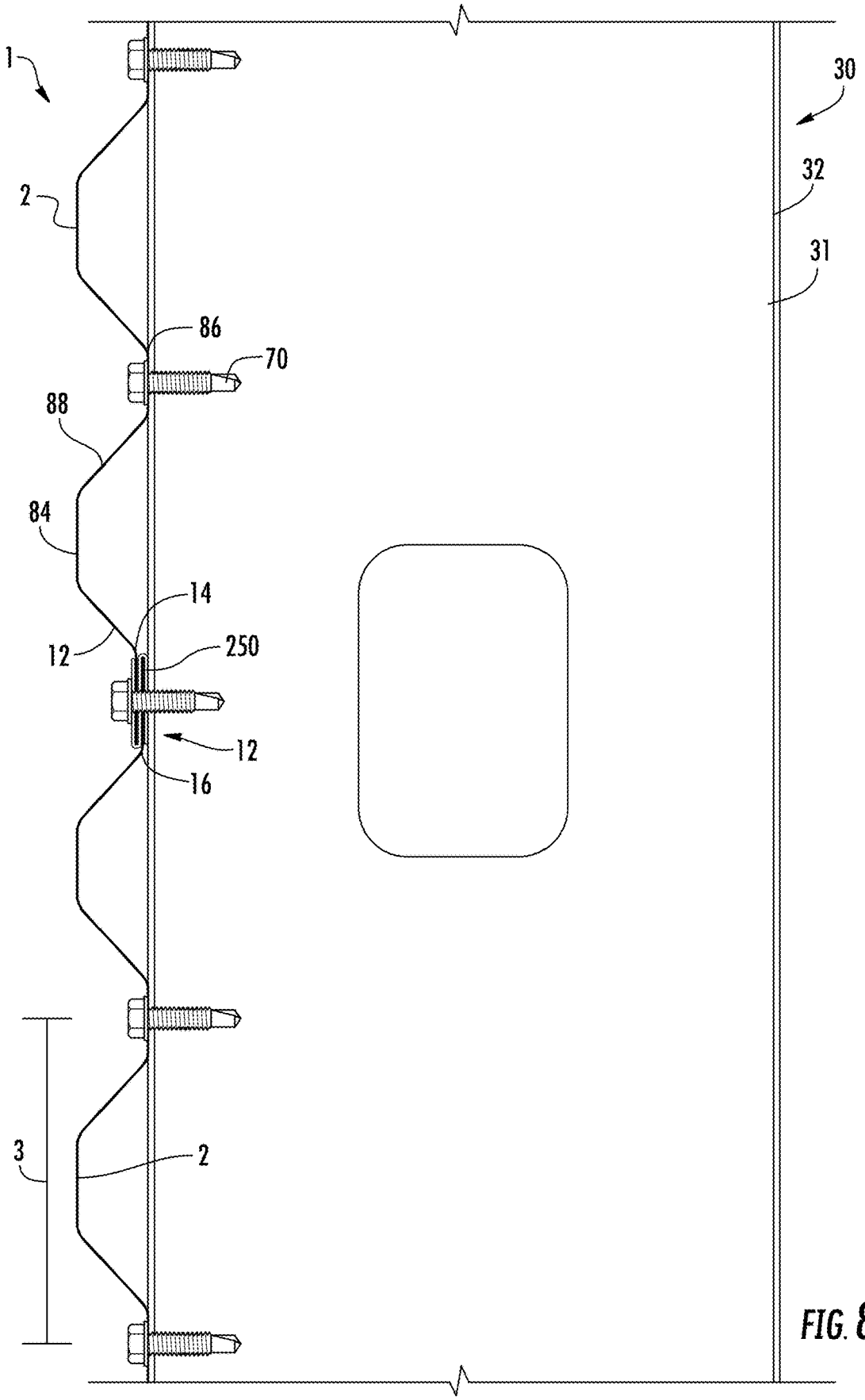
FIG. 8 illustrates a side view of a portion of the structural wall panel system illustrated in FIG. 7 illustrating the cross-section of the reinforcing member, in accordance with embodiments of the invention.

The structural panels 2 may have profiles that include longitudinal flutes 3. The longitudinal flutes 3, as illustrated in FIG. 8, may be comprised of longitudinal flanges, such as top flanges 84 (otherwise described as peaks, upper flanges, outer flanges, or the like), bottom flanges 86 (otherwise described as troughs, lower flanges, inner flanges, or the like), and webs 88 (e.g., the portions of the panel that are sloped, perpendicular, or generally perpendicular with the flanges 84, 86) that operatively couple the top flanges 84 to the bottom flanges 86. The combination of an outer and inner flange 84, 86, and the webs 88 create a single flute 3 for the structural panels 2. As such, the panels may be described herein as having a plurality of longitudinal flutes 3. The profiles of the panels 2 formed form the longitudinal flutes 3 may be referred to as "fluted profiles," "hat profiles", "vee profiles," "flat-bottomed profiles", "triangular profiles," "trapezoidal profiles," "dovetail profiles," or other like profiles formed from the plurality of longitudinal flutes 3.

The structural panels 2, described herein, may be manufactured from a variety of rigid materials including steel, aluminum, titanium, plastic, a composite, or another type of rigid material. Typical structural panels 2 are made of steel and are sized in ranges from 12 inches to 42 inches wide by 1 foot to 50 feet long. These dimensions include some sizes of structural panels 2, but it should be understood that any size of structural wall panels 2 within these ranges, overlapping these ranges, or outside of these ranges might be utilized within the present invention. The material thickness of the structural panels 2 may be any thickness; however, the panel thicknesses may correspond to 29 gage panels to 16 gage panels, inclusive. Other gage material, or the associated thicknesses therefor, may be within this range, overlap this range, or be located outside of this range.

The distance from the top of the top flange 84 and the bottom of the bottom flange 86 may generally range from ½ inch to 3 inches in depth; however, other ranges of depths within this range, overlapping this range, or outside of this range may be used in the profiles. For example, in some embodiments the distance may range from ½ inch to 12 inches in depth, or the like. The panels 2 may or may not include longitudinal ribs, bends, or cutouts that affect the moment of inertia and section modulus of the panels 2 (e.g., profile dimensions, ribs, cutouts, or the like are used to target different performance characteristics, such as but not limited to strength, stiffness, moment of inertia, and section modulus). Depending on the material thickness, the length and width of the panels 2, and the height of the top flanges 84 and bottom flanges 86, the panels 2 may weigh between 30 and 420 lbs. In other embodiments, the weight of the panels may be within, overlap, or be located outside of this range.

In some embodiments, the panel 2 has a panel length 48, ends 18 that are connected to end support members 31, and a body that crosses at least one or more intermediate support members 31. For example, the panel 2 may be operatively coupled to end support members 31 (e.g., first stud 38 and fifth stud 46), and cross one or more intermediate support members 31 (e.g., the studs 32, such as the second stud 40, the third stud 42, the fourth stud 44, or the like) along the panel length 4. As illustrated in FIG. 1, the panel 2 is void of any couplings 50 at connections locations between the panels 2 and the one or more intermediate support members 31 located between the end support members 31 (e.g., support coupling void locations 59). For example, the panel 2 may be operatively coupled to the end support members 31 with couplings 50 only at the panel ends 18 (e.g., the first stud 38 and the fifth stud 46, or other like number of end studs). It should be understood that the present invention may have any number of intermediate support members 31 at which there are no couplings 50 at connection locations between the panels 2 and the intermediate support members 31, except for in some embodiments at the sidelaps 13 between adjacent wall panels 2. As such, as illustrated in FIG. 1, the couplings 50 may include end support couplings 52, panel edge couplings 54, and edge support couplings 56. This connection configuration allows the panel 2 to buckle while providing bracing of the intermediate supports only at the sidelaps 13 of the panels 2. The panels 2 are attached to the support structure 30 at the ends of the buckling span by a sufficient number of connections to cause the panel to buckle rather than have the couplings 50 fail at the connection locations.

The depiction in FIG. 1 illustrates a single buckling span along a panel 2. A longer panel may have more than one buckling span. This is achieved by providing an adequate number of couplings 50 at connection locations between the panel 2 and one or more of the intermediate support members 31 to divide the buckling span into two or more sections along the panel length 48. For example, as illustrated in FIG. 2 the support structure 30 may include additional support members 31 (e.g., studs 32) and/or a larger spacing between support members 31 (e.g., studs 32), such that panel support couplings 58 may be provided at connection locations between the panel 2 and one or more of the intermediate support members 31. The use of the panel support couplings 58 reduces the length of the buckling span, such that the buckling span becomes half the panel length 48 (or other fractions of the panel length 48 in other embodiments of the invention) so long as there are locations void of connections between intermediate supports and the panels 2. For example, as illustrated in FIG. 2, the panel 2 is coupled to every other support member 31 between the ends 18 of the panel 2 (e.g., the first end 20 at the first stud 38, within the panel body at the third stud 42, and at the second end 22 at the fifth stud 46). However, it should be understood that any number of support members 31 (e.g., studs 32) may be utilized within ductile fluted wall panel system 1. As such, each buckling span 49 may have one or more intermediate support members 31 that are void of connections using couplings (e.g., support coupling void locations 59).

The ductile fluted wall panel systems 1 depicted in FIGS. 1 and 2 show the panels 2 in a horizontal orientation with the supports members 32 running vertically. However, as will be discussed in further detail later, it is also possible to orient the panels 2 in the vertical direction with the support members 32 running horizontally, and have the same connection pattern described herein. Alternatively, as will be discussed in further detail later, it is also possible to orient the longitudinal flutes 3 of the panels 2 in the same orientation as the support members 31. It should be further understood, that the ductile fluted wall panel system 1 is illustrated as being used in a wall of a building; however, it should be understood that the system may be a ductile fluted roof panel system 1 that is utilized in a roof of a building, or in a floor system. In the roof or floor system, the ductile fluted roof panel system 1 may have the same components and be configured in the same way as the ductile fluted wall panel system 1 described above.

The present invention is an improvement over traditional systems which connect the panels 2 to each of the one or more intermediate supports members 31, which creates a very stiff structural wall panel system 1. This stiffness is a result of the stiffness of the fluted structural panel 2 and the stiffness of the connections to the support members 31. This configuration will carry load well, but is not very ductile when the system is loaded past its ultimate capacity in cyclic shear loading. The poor ductility is due to the construction of the walls to which the panels 2 are connected and the connection of the panels 2 to each of the support members 31. This combination of close support framing, the fluted panel stiffness, and connection stiffness leads to a stiff structural wall panel system 1 that carries load up to the ultimate capacity at which point the couplings 50 at the connections fail and the wall panel system 1 loses shear strength with very little additional displacement during additional cyclic in-plane shear loading. It should be understood that the traditional systems are described with respect to wall systems, but it should be understood that roof systems in which the roof panels are coupled to each of the intermediate support members also creates a very stiff structural roof panel system 1, and has the same problems as the traditional wall panel systems described above.

The present invention provides a ductile fluted panel system (e.g., ductile fluted wall panel system and/or a ductile fluted roof panel system) that provides increased load capacity after reaching the ultimate failure load by allowing panel buckling between support members 31. When the ductile fluted panel system (e.g., wall or roof system) of the present invention is subjected to cyclic in-plane shear loading, the panel 2 will buckle between support members 31 (e.g., between the studs 32 at which the connections are made), then when the load is reversed, the panel 2 pulls straight before buckling in the other direction. In the present invention, panels 2 can buckle back and forth through multiple in-plane loading cycles without a rapid failure caused by the failure of the couplings 50 or panel at the connection locations. Structural wall panel systems and roof panel systems that behave in this way are not generally practical because the spacing between supports must be very wide to achieve panel buckling when the couplings 50 are used at connection locations between the panel 2 and each support member 31 in the system. This large spacing between support members 31 is too wide for other building considerations, which require the close spacing between support members 31 in order to support structural loads other than in-plane shear loading (e.g., seismic loading), such as the loads from the weight of the building and furnishing therein.

As such, the use of the combination of the sidelaps described herein that increase the strength of the sidelaps, along with the connection configurations described herein, allows the panels 2 to buckle with close support member 31 spacing that maintains the diaphragm strength of the panel system. For example, the ductile wall panel system 1 has buckling spans (e.g., distance between support members 31 with end support couplings 52, panel support couplings 58, and/or both) that may range from 4 ft to 16 ft, and typically range from 5 ft to 10 ft. It should be understood that the bucking spans may be within, outside, or overlapping these ranges. Alternatively, the ductile roof panel system 1 has buckling spans that may range from 6 ft to 20 ft, and typically range from 8 ft to 16 ft. It should be understood that the buckling spans may be within, outside, or overlapping these ranges.

Figure 3:
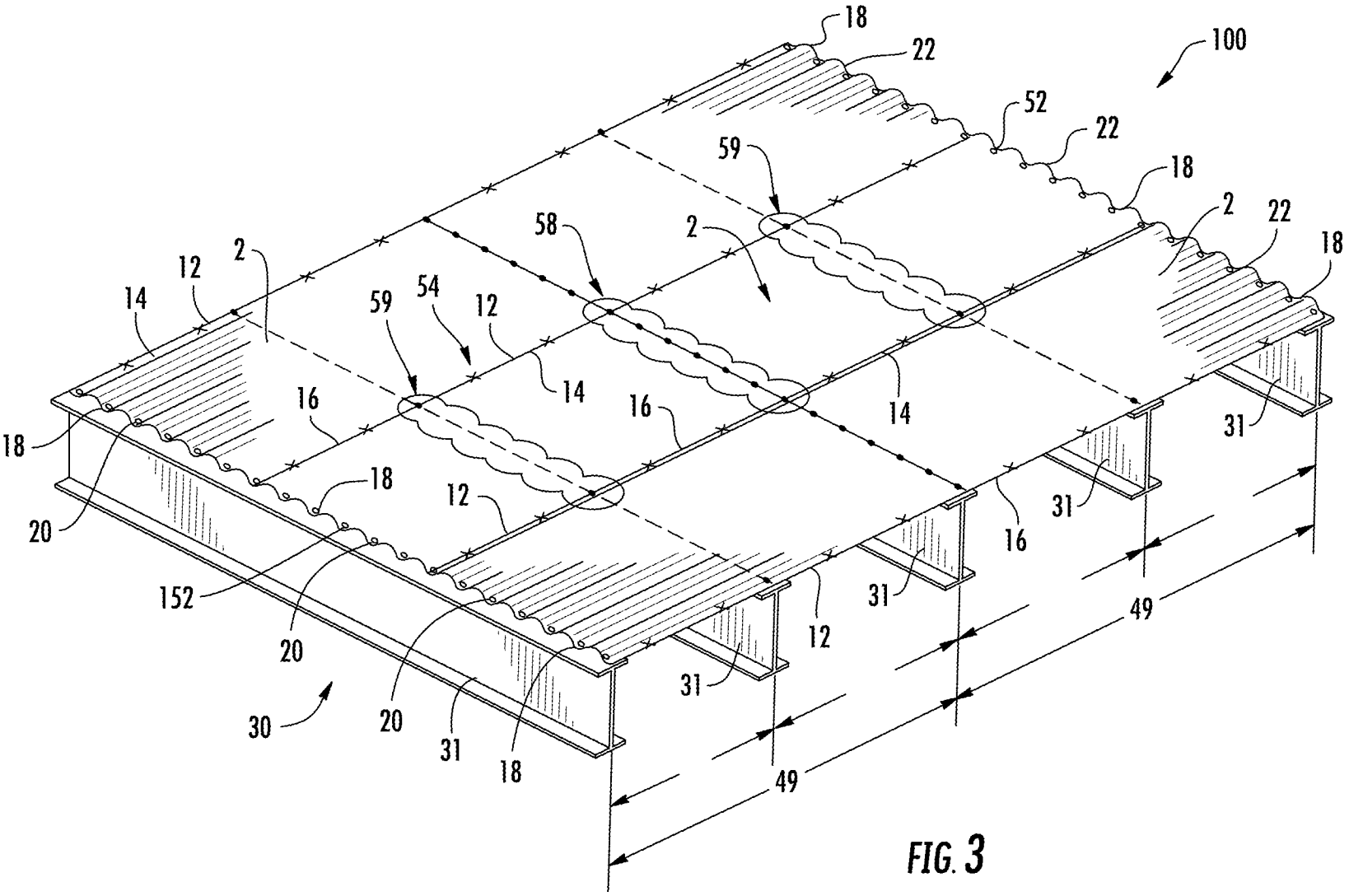
FIG. 3 illustrates a perspective view of a portion of a structural roof panel system having roof panels orientated transverse to studs and a specific connection configuration, in accordance with embodiments of the invention.

As previously discussed, in addition to the structural wall panel system 1 discussed with respect to FIGS. 1 and 2, it should also be understood that the same principals may be applied to roof systems, as illustrated and described with respect to FIG. 3. One example of a ductile fluted roof panel system 100 that may utilize the aspects of the invention described herein is for large flexible diaphragm rigid wall structures, also known as rigid wall flexible diaphragm ("RWFD") structures. RWFDs are common for warehouses, industrial, and large retail structures. These structures are typically constructed with concrete tilt-up walls or unit masonry wall and steel deck or plywood/OSB wood panel's roof structures. In high seismic areas, or in configurations that may be subjected to cyclic loading, the RWFS structures develop high diaphragm shear forces in the roof structure. Traditionally, in order to create high shear strength in the roof, heavy gauge steel roof decking is utilized with connectors to all of the underlying supports and in the sidelaps between the adjacent decking panels. This configuration creates relatively stiff diaphragms with low ductility. Stiff diaphragms transfer more seismic loading, and any other types of cyclic in-plane shear loading, to the diaphragm due to the low energy dissipation of stiff diaphragms. The ultimate mode of failure of these roof systems, like the similar wall systems previously described, is in the connections. When the connections fail then the diaphragm ceases to carry shear loads leading to failure of the roof system to perform as a part of the building, which can lead to full or partial building collapse. In these roof systems the buckling span is limited to the same span as the gravity load span because the connection pattern includes couplings between the panels and all of the support members of the support structures. In these configurations the short span of the panels 2 leads to a buckling strength that exceeds the connection strength of the panel, thus leading to connection failure before buckling of panels 2 occur.

The present invention provides a ductile fluted roof panel system 100 with improved ductility through buckling that occurs before connection failure. Like the ductile fluted wall panel system 1 previously discussed, the improved ductility is created by the increased strength at the sidelap between adjacent panels 2, and the increased buckling span formed by the absence of couplings 50 between the panels 2 and the one or more of the intermediate support members 31 located between the end support members 31 having end support couplings 52, as illustrated by FIG. 3. The intermediate one or more support members 31 within the buckling span that are void of connections using couplings 50, allows the panel 2 to buckle while the end support couplings 52, panel edge couplings 54 (e.g., couplings only between the panel edges), edge support couplings 56 (e.g., couplings between one or more panel edges and the support members 31 at the panel edges), and panel support couplings 58 (e.g., the couplings at the intermediate support members 31 which may optionally be included based on the panel length) provide stability to the intermediate support members 31.

Figure 4:
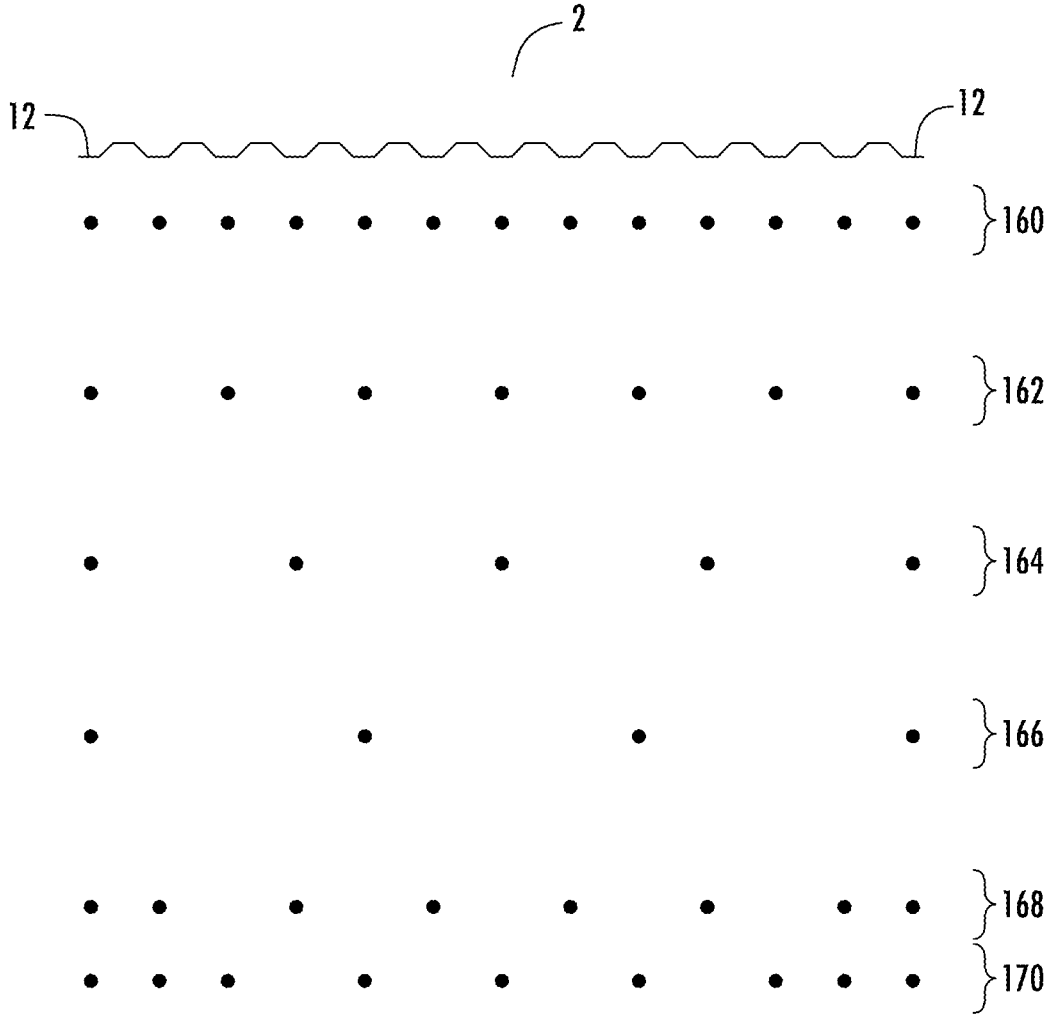
FIG. 4 illustrates a view of various coupling spacing patterns within a panel system, in accordance with embodiments of the invention.

FIG. 4 illustrates different connection patterns that could be utilized for the end support couplings 52 at the ends of the panels 2 and/or for the panel support couplings 58 that may occur at the one or more intermediate support members 31 As illustrated in FIG. 4, the connection patterns may include couplings located at every lower flange 160, at every other lower flange 162, at every third lower flange 164, at every fourth lower flange 166, or non-uniform patterns 168, 170. FIG. 4 only illustrates some of the connection patterns, and it should be understood that other connection patterns may be utilized in these ductile fluted panel systems 1, 100. Moreover, FIG. 4 illustrates one type of fluted panel, and it should be understood that other types of fluted panels may utilize the illustrated connection patters or other connection patters.

Figure 5:
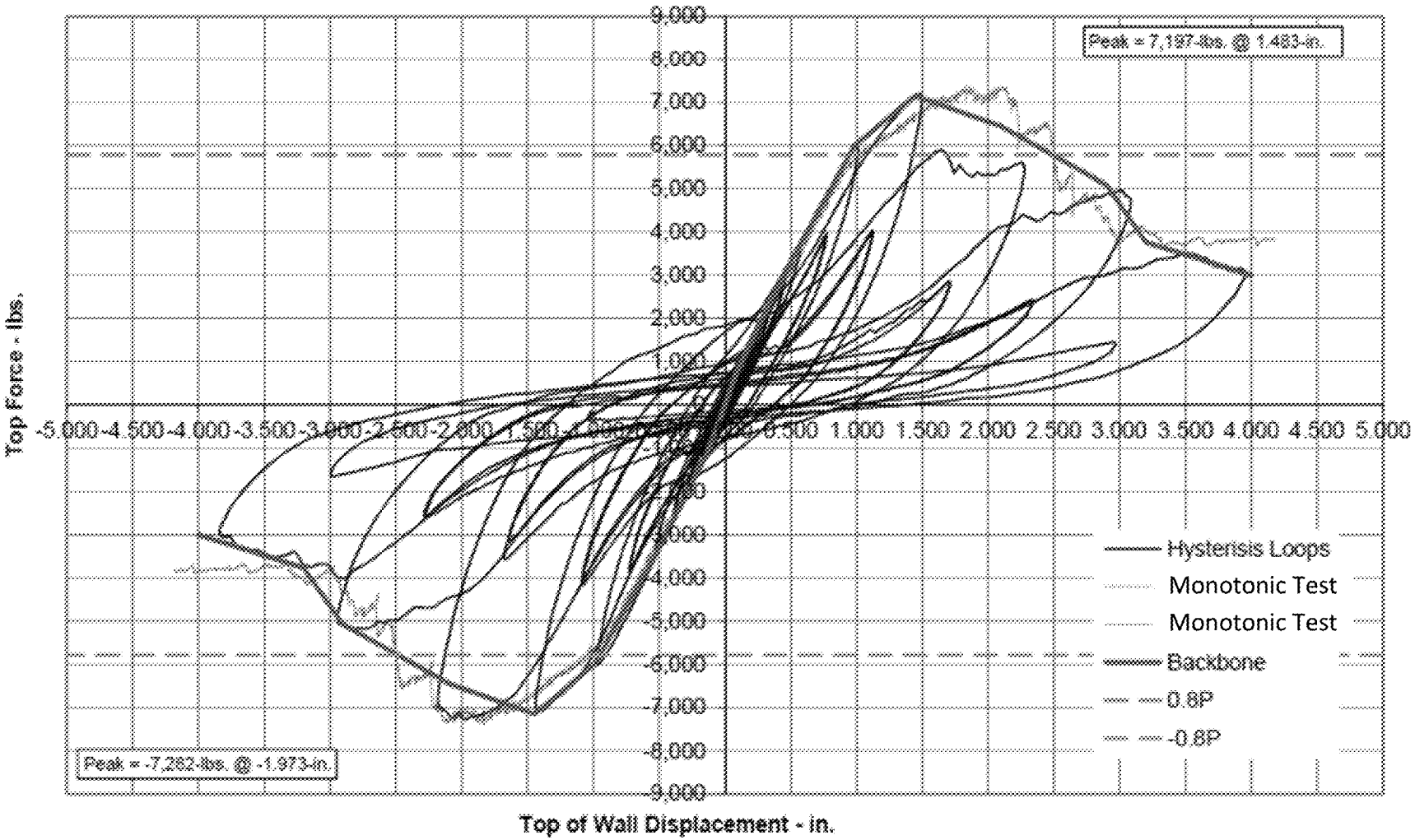
FIG. 5 illustrates a graph of the load displacement of a panel system that includes couplings at all of the supports.
Figure 6:
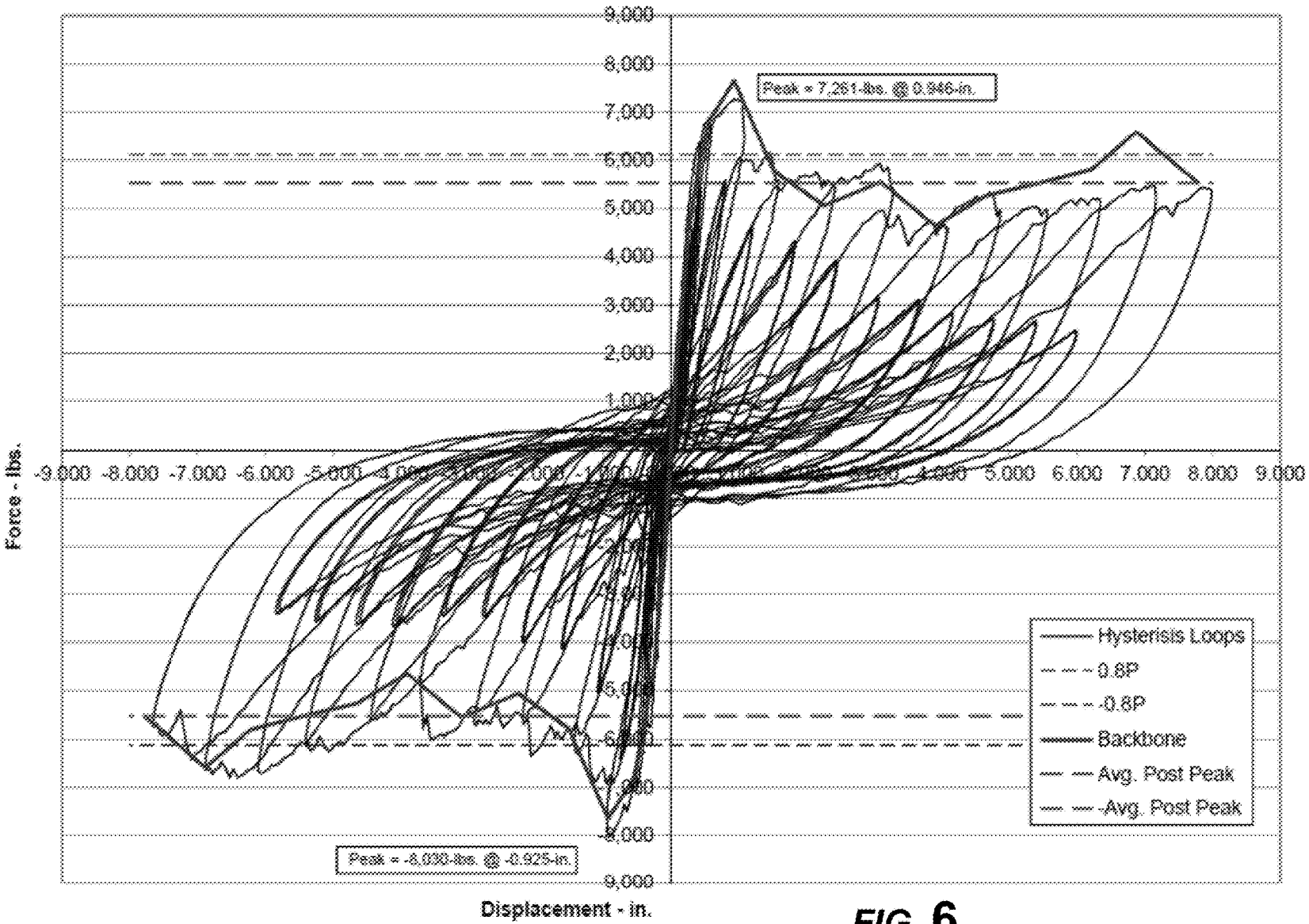
FIG. 6 illustrates a graph of the load displacement of a panel system without couplings at one or more of the intermediate supports, in accordance with embodiments of the invention.

The performance of the ductile fluted wall panel systems 1 and ductile fluted roof panel systems 100 described herein has been demonstrated in various tests. The connection patterns in which none of the intermediate supports are coupled to the panel 2, versus coupling the panels 2 to all of the intermediate support members 32 was tested. The load displacement graphs illustrating the displacement of the systems verses shear loading are shown in FIGS. 5 and 6, and demonstrate the difference in the performance of these connection configurations. In FIG. 5 (e.g., couplings at all of the intermediate support members 32), the connections (e.g., the couplings 50 or the panel around the couplings 50) begin to fail at the ultimate load and then the diaphragm system strength rapidly degrades as additional displacement cycles progress. In FIG. 6 (e.g., without couplings 50 at the intermediate support members 32) the connections do not fail at the ultimate load or in subsequent cycles. In FIG. 6, the panel 2 buckles at the ultimate load (e.g., which is approximately the same as the ultimate load of the system in FIG. 5), which reduces the capacity of the system; however, at subsequent displacement cycles the reduced capacity is maintained for many loading cycles. The buckling diaphragm in FIG. 6 retains approximately 75% of the ultimate strength, which is a displacement of approximately 3 times (or a range of 1.5 to 4 times, or a range that falls within, outside, or overlapping this range) the system in FIG. 5.

Figure 7:
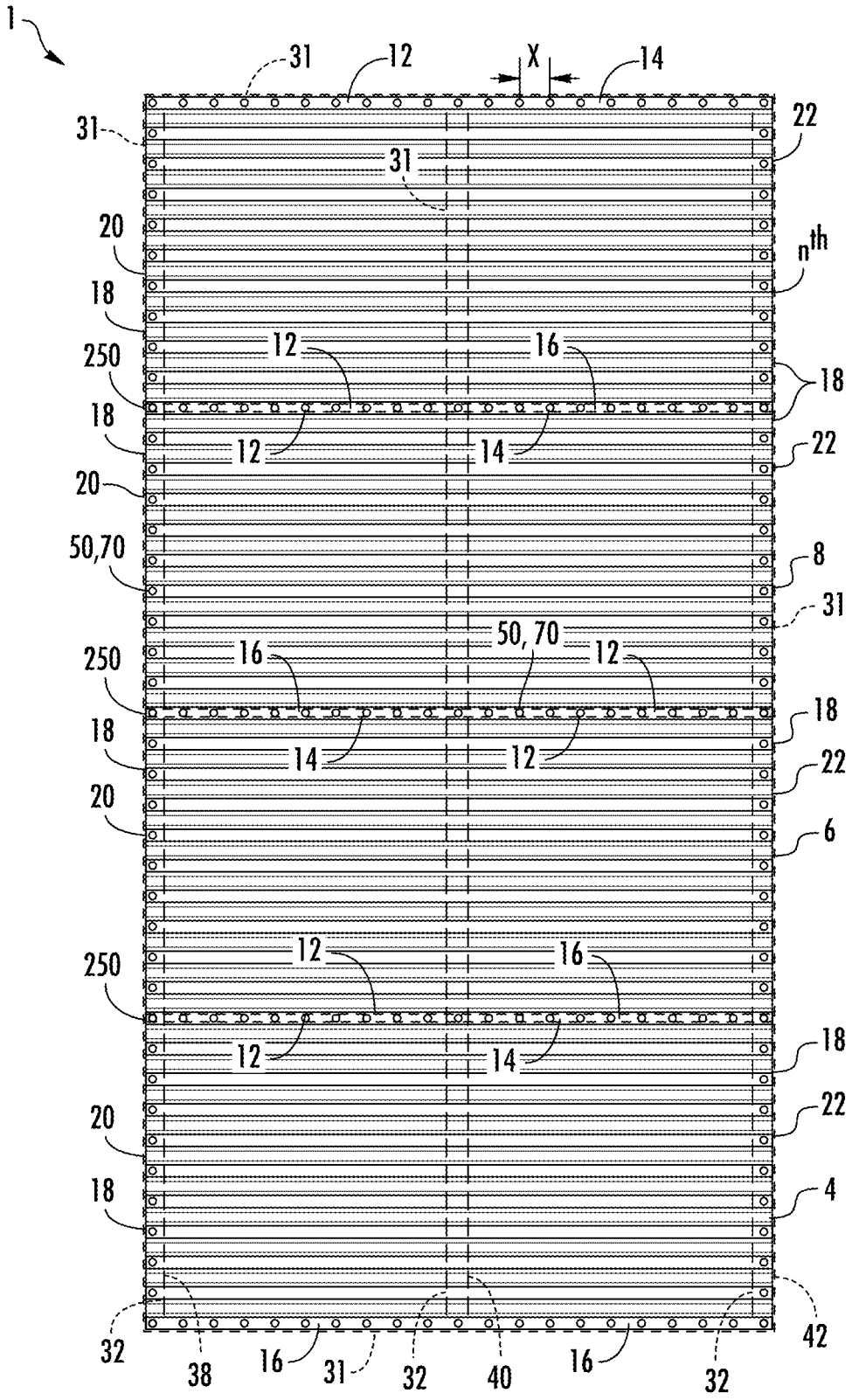
FIG. 7 illustrates a front view of a portion of a structural wall panel system having wall panels located transverse to studs, reinforcing members located at the sidelaps at the edges of the lateral adjacent wall panels, and a specific connection configuration, in accordance with embodiments of the present invention.

FIGS. 7 and 8 illustrate an embodiment of the invention in which the connection pattern configuration discussed with respect to FIGS. 1-4 is utilized along with a reinforcing member 250 that increases the strength of the sidelap between the edges of adjacent panels. As illustrated in FIGS. 7 and 8, the reinforcing members 250 are located between, and create the reinforced sidelap between the first edge 14 and the second edge 16 of each lateral adjacent panel 2 within the ductile fluted panel system 1 to create an improved sidelap 13. Moreover, the couplings 50 are used to create the connections in the first edge 14, second edge 16 and the reinforcing members 250. Additionally, the ends 18 of each panel 2 may be operatively coupled to longitudinally adjacent panels 2, for example, the first end 20 of a first panel 4 may be operatively coupled to a second end 22 of a longitudinally adjacent panel (not illustrated).

FIGS. 7 and 8, illustrate that the reinforcing member 250 is typically utilized within a wall panel system, such as the ductile fluted wall panel system 1 described above. However, it may also be utilized in roof panel system, such as the ductile fluted roof panel system 100 described above. Moreover, while the reinforcing member 250 (and the other sidelaps described herein below) are discussed as being utilized to increase the strength of the sidelap to create the ductile fluted panel systems 1, 100 described above, it should be understood that the reinforcing member 250 (and the other sidelaps described herein below) may be utilized in traditional roof or wall panel systems in order to increase the strength of the sidelap. As described herein, increasing the strength of the sidelap of a typical wall or roof panel system may allow for cost reductions related to decreasing the thickness of the panels, decreasing the number of connection locations, reducing the assembly time, or the like.

Figure 9:
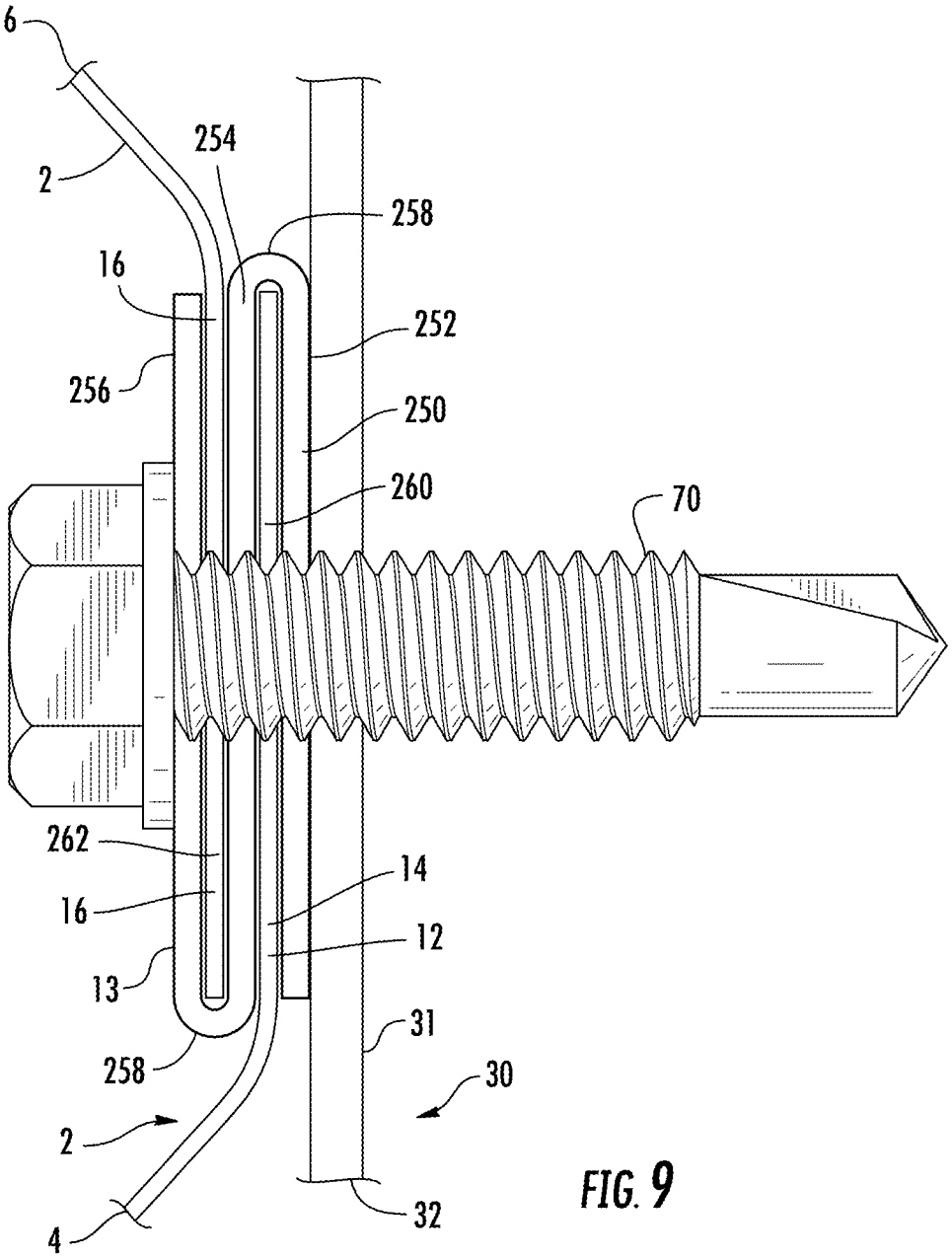
FIG. 9 illustrates an enlarged view of a portion of the structural wall panel system illustrated in FIG. 8 illustrating an enlarged view of the cross-section of the reinforcing member and wall panel edges, in accordance with embodiments of the invention.
Figure 10:
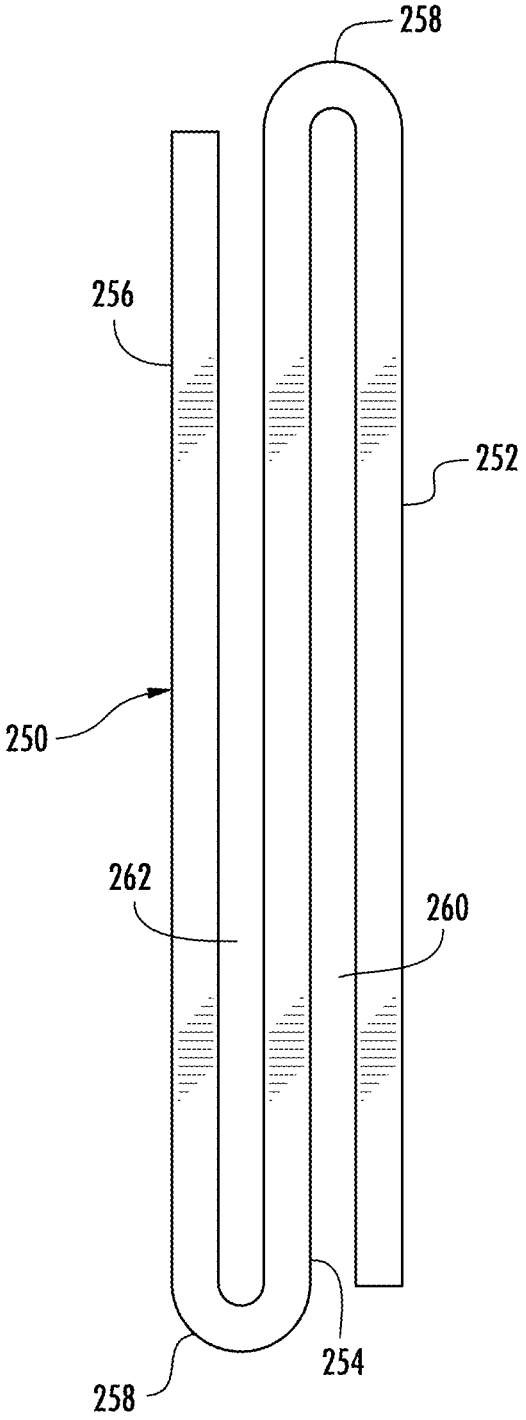
FIG. 10 illustrates a cross-sectional view of the reinforcing member used in the sidelap, in accordance with embodiments of the invention.

FIGS. 9 and 10 illustrate cross-sectional views of the reinforcing member 250 operatively coupled to the panels 2, and without the panels 2, respectively. As previously discussed, and as illustrated in the figures, the reinforcing members 250 may include a first leg 252, a second leg 254, and a third leg 256. The first leg 252 may be operatively coupled to the second leg 254, while the second leg 254 may be operatively coupled to the third leg 256. A connector 258, such as a U-shaped connector, may be utilized to couple the legs together. The connector 258 may be a separate part from the legs, and thus used to secure the legs together. In other embodiments, the connector 258 may be formed integrally within the legs. In one embodiment, the reinforcing member 250 may be formed from a single piece of metal that is bent into the desired shape. The legs of the reinforcing member 250 may be formed into a generally S-shaped member that has a first channel 260 formed by the first leg 252 and the second leg 254, and a second channel 262 formed by the second leg 254 and the third leg 256. In other embodiments of the invention the shape of the reinforcing member 250, or a portion thereof, may be formed into a panel edge 12.

It should be understood that in some embodiments of the invention the first leg 252, the second leg 254, and the third leg 256 are the same height, such that the overall height of the reinforcing member 250 is the same as the heights of the legs. In some embodiments of the invention the connectors 258 may extend the height of one or more of the first leg 252, the second leg 254, and/or the third leg 256. In still other embodiments the first leg 252, the second leg 254, and/or the third leg 256 may be different heights. As such, it should be understood that different configurations of the reinforcing member 250 may be provided, in which the individual legs have heights that may extend beyond, short of, or are in line with the other legs and/or connectors of the reinforcing member 250. The legs may be straight, or may have portions that are straight with other portions that are shaped (e.g., bent, curved, or the like) in order to add additional support to the reinforcing member 250.

As such, in some embodiments of the invention the couplings 50, such as fasteners, may extend through all of the legs of the reinforcing member 250. In some embodiments, the couplings 50, such as the fasteners, may extend through the straight portions and/or the shaped portions of the legs of the reinforcing members 250 and the edges of the panels 2. In other embodiments of the invention, the first leg 252 and/or the third leg 256 may be of a length, such that the couplings 50 (e.g., fasteners) do not extend through the first leg 252 and/or third leg 256; however, in this embodiment these legs may still provide channels 260, 262 in which the panel edges 12 are located for assembly purposes.

It should be further understood that while the legs of the generally S-shaped reinforcement member 250 are illustrated herein as being generally parallel, the first leg 252 and the third leg 256 may diverge from the second leg 254 such that the channels 260, 262 become wider at the opening of the channels 260, 262, which may facilitate assembly of the edges 12 of the panels 2 into the reinforcing members 250.

As illustrated in FIG. 9, in some embodiments of the invention, the reinforcing member 250 may have a height of 0.75 inches, or may range from 0.5 to 5 inches or 0.5 to 1.5 inches (or may be within, outside, or overlapping these ranges depending on the size of the panels 2). The gap between the legs (e.g., the width of the connectors 258) may correspond to or be slightly bigger than the thickness of the panels 2. As such, in some embodiments the gap between the legs may be 0.0625 inches, or may range from 0.02 to 0.5 or 0.05 to 0.1 inches (or may be within, outside, or overlapping these ranges depending on the thickness of the panels 2). The overall width of the reinforcing member 250 may be approximately 0.3 inches, or may range from 0.2 to 0.75 inches or 0.2 to 1.5 inches (or may be within outside, or overlapping these ranges depending on the thickness of the panels 2). The length of the reinforcing member 250 may be 10 ft, or may range from 2 ft to 40 ft, or from 5 ft to 20 ft (or may be within, outside, or overlapping these ranges depending on the spacing of the studs and/or the length of the panels 2). As such, the length of the reinforcing member 250 may be the same length as, slightly less than, or slightly greater than the length of the panels 2 described herein. The reinforcing member may be 22 gage, or any other gage. In some embodiments the gage of the reinforcing member 250 may be the same as, larger than, or smaller than the gage of the panels 2 depending on the required strength, the gage of the panels 2, the number of couplings 50, or the like of the ductile fluted panel system.

It should be further understood that in some embodiments, two or more reinforcing members 250 may be utilized along the length of a single panel 2. For example, one reinforcing member 250 may be located between a first span between a first support member 31 and an intermediate support member 31 (e.g., it may or may not cross one or more of the support members), and a second reinforcing member 250 may be located between a second span between a second support member 31 and an intermediate support member (e.g., it may or may not cross one or more of the support members). As such, in some embodiments the reinforcing member may not be located in the sidelap 13 where the sidelap 13 crosses a support member 31. Alternatively, the reinforcing member 250 may be notched (or a portion thereof may be notched, such as one or more of the legs) at a location where the reinforcing member 250 crosses one or more of the support members 31, such that the couplings 50 at the support member location may be easier to make (e.g., coupling doesn't have to be made through one or more of the additional layers of the reinforcing member 250).

Returning to FIG. 9, the figure illustrates an enlarged view of the sidelap 13 between two structural wall panels 2 (e.g., a first wall panel 4 and a second wall panel 6). As illustrated in FIG. 9, the edge 12 (e.g., first edge 14) of a first wall panel 2 (e.g., wall panel 4) is located inside of the first channel 260 of the reinforcing member 250. As further illustrated in FIG. 9, the edge 12 (e.g., second edge 16) of a second wall panel 2 (e.g., wall panel 6) is located inside of the second channel 262 of the reinforcing member 250. The sidelap 13 in this configuration illustrates a five layer sidelap, through which a coupling 250 (e.g., a fastener 70, or the like) is used to operatively couple the first panel 4, the second panel 6, and the reinforcing member 250 together. It should be understood, as illustrated in FIG. 7, that in some locations the five layer sidelap of the present invention may be created in locations between support members 31 of the support structure 30; however, where support members 31 are crossed by the sidelap 13, the five layer sidelap of the present invention has six layers at this location. As illustrated in FIG. 9, the edges 12 of the wall panels 2, the reinforcing member 250 and the support member 31 (e.g., stud 32) creates at least six layers at the location of the coupling 50. However, as previously discussed above, notches in at least a portion of the reinforcing member 250, and/or utilizing multiple reinforcing members 250 within a single panel 2, may be used in order to reduce the number of layers at the location where the panel sidelap 13 crosses one or more of the support members 31. As such, in some embodiments, the sidelap 13 where the reinforcing member 250 crosses a support member 31 may have a connection that only has five layers, four layers, three layers, or the like (e.g., the layer of metal in the support member 31, the first panel edge, the second panel edge, and/or zero or more layers of the reinforcing member 250).

FIG. 9 described above illustrates an embodiment of the reinforcing member 250 in which the edge 12 (e.g., first edge 14) of the first panel 4 is located behind the edge 12 (e.g., second edge 16) of the second panel 6. However, it should be understood that the reinforcing member 250 may be reversed, and as such, the edges (e.g., first edge 14) of the first panel 4 may be located in front of the edge 12 (e.g., second edge 16) of the second panel 6.

FIG. 11 illustrates one process 200 of assembling the ductile fluted wall panel system 1 utilizing the reinforcement member 250. As illustrated by block 202 in FIG. 11, the support structure 30 is assembled, which in some embodiments may include assembling the support members 31, such as the studs 32 (e.g., a first stud 38, a second stud 40, a third stud 42, and/or an $n^{th}$ stud), a bottom cap 34, and a top cap 36 together and/or with other supports members 31. In some embodiments, as illustrated in FIG. 7, the support members 31 are installed in a generally vertical orientation. However, in other embodiments the top and bottom caps may be end caps, or other support members 31, and the studs 32 may be generally horizontal and operatively coupled to the end caps or other support members 31. In some embodiments, the support structure 30 may further include joists, trusses, beams, purlins, framing (e.g., wood, metal, or other like framing), metal decking, rebar, concrete flooring, or the like.

Block 204 in FIG. 11 further illustrates assembling a first wall panel 4 to one or more of the support members 31 (e.g., a center or middle stud 40, and/or other studs). In the embodiment illustrated in FIG. 7, the first wall panel 4 is installed with the flutes 3 of the wall panel 2 running generally transverse to the support members 31 (e.g., in a generally horizontal orientation to the vertical studs 32). The couplings 50 (e.g., fasteners 70, or the like) are used to operatively couple the first wall panel 4 to the one or more support members 31 (e.g., studs 32). In some embodiments, it should be understood that multiple longitudinal adjacent panels 2 may be assembled to the first wall panel 4, such that the ends 18 of longitudinal adjacent panels 2 may be overlapped and assembled at the locations of the support members 31 (e.g., studs 32). It should be further understood that only a portion of the first wall panel 4 may be assembled to the support members 31 in order to facilitate assembling the longitudinal adjacent panels 2, the lateral adjacent panels 2, and/or the reinforcing member 250 together with the first wall panel 4 before the first wall panel 4 is fully assembled to the support members 31.

FIG. 11 further illustrates in block 206 that the reinforcing member 250 is assembled to the edge 12 (e.g., first edge 14) of the first panel 4. In some embodiments this includes sliding the reinforcing member 250 over the first edge 12 of the first panel 14. In some embodiments the first edge 14 is a single male edge 14 that is slid within a first channel 260 that is a female channel opening. However, the edges 12 and channels 260, 262 may have other types of configurations and/or shapes.

Block 208 in FIG. 11 illustrates that a second panel 6 is assembled to the support members 31 (e.g., studs 32). As with the assembly of the first panel 4 described with respect to block 204, the second panel 6 is installed with the flutes 3 generally transverse to the support members 31 (e.g., studs 32). The second edge 16 of the second panel 6 is slid into the second channel 262 of the reinforcing member 250. The second panel 6 is operatively coupled to the support members 31 as was previously described with respect to the first panel 4 in block 204. For example, the second panel 6 ends may be overlapped with the ends 18 of adjacent wall panels 2 and at least partially coupled to the support members 31 (e.g., studs 32).

Block 210 in FIG. 11 illustrates that the first wall panel 4, the second wall panel 6, and the reinforcing member 250 are coupled together and/or to the support members (e.g., studs 32), as illustrated in and described with respect to FIGS. 7, 8, and 9.

As previously discussed, in one embodiment of the invention the five-layer, six-layer, or other like sidelap may be operatively coupled using couplings 50 that are fasteners 70. In one embodiment of the invention, as illustrated in FIGS. 7, 8 and 9, the fasteners 70 may be screws, such as self-drilling screws that drill apertures through the layers (e.g., five-layers, or the like) using a lead portion of the screw, create aperture threads in one or more of the layers using a thread forming portion, and have fastener threads in a threaded portion that engage the aperture threads to create the connection (also described as a joint, attachment, or the like) between structural wall panels 2. In other embodiments of the invention, the fasteners 70 may be other types of mechanical fasteners that are either hand-driven or power-driven (e.g., electrically, pneumatically, hydraulically, or the like) into the sidelap 13, such as other screws, nails, rivets, or the like. It should be understood that the couplings 50 of any of the systems described herein may be fasteners 70, and/or any other type of coupling 50.

As such, in other embodiments of the invention, the couplings 50 in the five or more layer sidelap (or three-layer, four-layer, five-layer, six-layer, or the like) may be welds that are welded from the inside or outside of the building. When welding from the inside of the building, the additional layers at the sidelap 13 provide additional material for creating the weld and preventing burn-through. The weld may fuse portions of the first edge 14, second edge 16, and/or the reinforcing member 250 together. When welding two-layer sidelaps, for example, burn through may occur when filler material burns through the single edges of the panels, which causes a defective weld. A defective weld may result in additional time for a welder to repair the weld, and even after repairing the weld may not have the desired strength. The extra layers of material provided by the reinforcing member 250 creates a sidelap that is less likely to be burned through during the welding process.

In other embodiments of the invention, instead of the couplings 50 being fasteners 70 or welds, the five-layer (or other layer) sidelap may be deformed and/or cut (e.g., sheared) to couple the structural panels 2 together. In some embodiments of the invention a tool that punches through the sidelap may be utilized to create the couplings 50.

Block 212 of FIG. 11, further illustrates that additional lateral adjacent wall panels 2 (e.g., third wall panel 8, $n^{th}$ wall panels, or the like) and/or additional longitudinal adjacent wall panels 2 are assembled within the ductile fluted wall panel system 1, in the same way as described with respect to the first wall panel 4 and/or the second wall panel 6. As such a structural wall panel system 1 is created that has reinforcing members 250 located at the sidelaps of one or more wall panels 2.

During assembly of longitudinal adjacent wall panels 2, the panels may either be butted up against each other, or may be overlaid on top of each other at the ends 18 of the structural panels 2. When the ends 18 of longitudinal adjacent panels 2 are overlaid on top of each other, fasteners 70 or other means for coupling the ends 18 of the longitudinal adjacent structural panels 2 may be utilized. However, in some embodiments, overlaying the ends of the longitudinal adjacent structural panels 2 may create a double sidelap location at the corners of the panels 2, such as a ten-layer sidelap or eleven-layer sidelap (e.g., when five-layer sidelaps are used on top of each other, and potentially when located at a support member 31 that adds an additional layer). In some embodiments of the invention, a coupling 50 may be created at the overlapping location. As previously discussed with respect to the couplings 50 in the five-layer sidelap, the couplings 50 used in the double sidelap locations, such as the ten-layer sidelap location (or other number of layers) may be the same. However, in some embodiments of the invention a special fastener (e.g., self-drilling screw, pin, rivet, or the like) may be utilized to create a coupling 50 at the double sidelap location (e.g., in the ten-layer or eleven-layer sidelap location, or other number of layers). In other embodiments, a weld may be used as a coupling at the double sidelap locations, while the same or different types of couplings may be used at other locations on the sidelaps 13. However, it may be difficult to create a proper weld at a sidelap 13 that has ten-layers or eleven-layers. Creating a coupling 50 at the double sidelap location may further improve the shear strength of the sidelap 13 and structural wall panel system 1, thus allowing for a reduced thickness of the wall panels 2, a reduction of the number of couplings used along a sidelap 13 or within the ductile fluted wall panel system 1 and/or improved flexibly. However, in some embodiments the ductile fluted wall panel system 1 may be formed without a coupling 50 at the double sidelap location, and the improvements of the shear strength and/or flexibility described herein may be still be achieved. In still other embodiments of the invention, the panels 2 may have a cut-away (e.g., notch) at the corner of one or more of the ends 18 to prevent the double seem locations at the corners of the wall panels 2. In still other embodiments of the invention the reinforcing member 250 may be shorter than the length of the panel 2 or have a cutout (e.g., notch), such that the one or more ends 18 of the panels 2 when assembled would not include the additional layers created by the reinforcing member 250. For example, the reinforcing member 250 may not exist at the overlap of longitudinally adjacent ends 18, or only a single reinforcing member may exist at the overlap of the longitudinally adjacent ends 18.

The sidelap 13 created in the present invention is much easier to assemble than an interlocking sidelap and/or overlapping sidelaps, because the wall panels 2 can be slid right into the channels 260, 262 of the reinforcing member 250, or the reinforcing member 250 may be slid over the edges 12. The reinforcing member 250, in addition to ultimately increasing the strength and/or stiffness of the sidelap 13 and/or system 1 when the couplings 50 are installed, also holds the panels 2 in place while being assembled together. It should further be understood that the improved strength at the sidelap 13, allows for the use of other features of the present invention that improve the flexibility of the structural panel systems. For example, increasing the strength of the sidelap 13, and utilizing the connection configurations previously described above, create the buckling spans in the panels 2 without degrading the strength of the overall ductile fluted panel system (e.g., without reducing the ultimate loading strength). Without increasing the strength of the sidelaps 13 between the panels 2, the ability to create the buckling spans in the panels 2 without degrading the strength of the overall system may not be possible.

It should be understood that while the edges 12 of the panels 2 are represented as single layer edges 12. It should be understood that the edges 12 may be multiple layer edges 12, and may be formed by folding the edge 12 of the panel 2 back upon itself. In this embodiment, one or more of the panels 2 may be inserted into the reinforcing member 250 and provide additional layers at the edges 12 of the panels 2. Alternatively, the reinforcing member 250 may include legs that are folded back upon themselves in order to create legs that have additional layers.

Like the structural panels 2 previously described, the reinforcing member 250 described herein, may be manufactured from a variety of rigid materials including steel, aluminum, titanium, plastic, a composite, or another type of rigid material. The reinforcing member 250 may typically be made of steel and may have a length that ranges from 1 foot to 50 feet long. As such, the reinforcing member 250 may be the same length as a panel 2, may be longer than a panel 2, or may be shorter than a panel 2, in which case one or more reinforcing members 250 may be utilized within a sidelap 13 between two adjacent lateral panels 2. It should be understood that any size of reinforcing member 250 may be utilized that is within these ranges, overlapping these ranges, or outside of these ranges. The material thickness of the reinforcing member 250, like the structural panels 2, may be any thickness; however, the reinforcing member 250 thicknesses, may be the thickness of 29 gage to 16 gage steel, inclusive. Other material thicknesses of the present invention may be within this range, overlap this range, or be located outside of this range.

As previously discussed the reinforcing member 250 may improve the strength of the sidelap 13 and/or the panel system with or without the use of the connection configurations discussed above. It should be understood that utilizing the reinforcing member 250 of the present invention described herein (e.g., five-layer sidelap, or other layer sidelap) may improve the shear strength of the sidelap and/or structural panel system 1 over an overlapping sidelap and/or interlocking sidelap by 1, 2, 3, 4, 5, 6, 7, 8, 9, 10, 11, 12, 13, 14, 15, 16, 17, 18, 19, 20, 21, 22, 23, 24, 25, 30, 35, 40, 45, 50, 55, 60, 65, 70, 75, 80, 85, 90, 95, 100, 110, 120, 130, 150, 200, 250, 300 or more percent. In other embodiments, the improvement may be outside of, within, or overlapping any range of these numbers. This improvement in the strength of the sidelap 13 and/or structural panel systems 1, 100 may allow for the other configurations described herein that improve the flexibility of the overall structural panel systems 1, 100, while still maintaining the desired strength of the structural panel systems 1, 100.

In other embodiments of the invention, other types of improved sidelaps 13 may be utilized in order to improve the strength of the sidelap 13 and/or the overall ductile fluted panel systems 1, 100. As such, as previously described, the improved strength at the sidelap 13 may allow for the use of other aspects of the invention that improve the flexibility of the panel system, such as the use of the connection configurations previously described. Two examples, of improved sidelaps may be a sidelap seam (e.g., an out-of-plane sidelap seam) with four or more layers as described in further detail with respect to FIGS. 12A-14B, or a nested sidelap (e.g., an in-plane nested sidelap) with three or more layers as described in further detail below with respect to FIGS. 15A-17B.

Figure 12A:
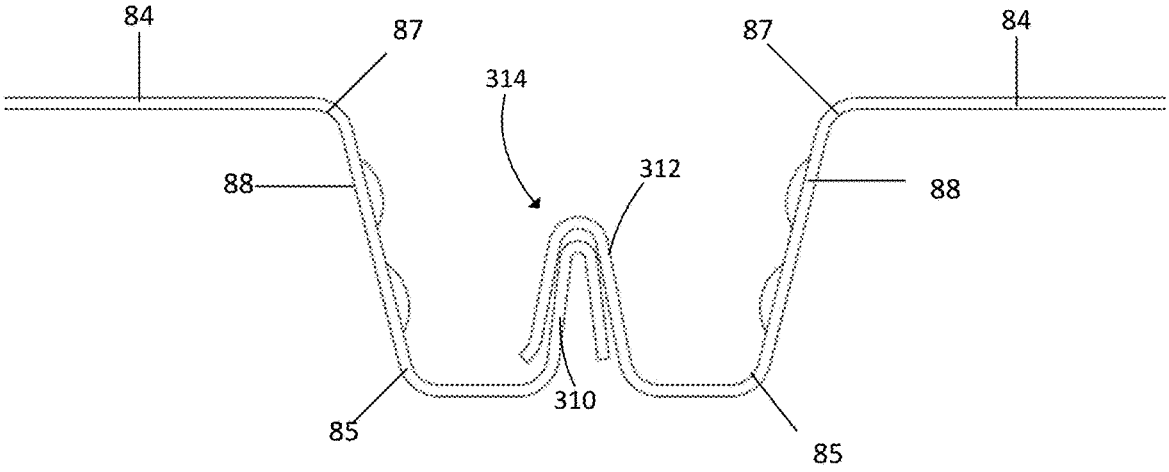
FIG. 12A illustrates a profile view of a sidelap seam with a male lip with an open outward fold located within a female lip, in accordance with embodiments of the invention.

FIGS. 12A-14B illustrate that one embodiment of the sidelap 13 of the present invention includes a sidelap seam with four or more layers. As illustrated in FIG. 12A, one panel 2 may include an edge 12 having a generally out of plane male lip 310 (e.g., substantially perpendicular to the panels, such as located between 45 degrees+/−from a perpendicular orientation with the plane of the decking panel, or the like). The male lip 310 may be offset from one of the decking top flanges 84 such that there is room for the male lip 810 of a first decking panel 2 to interlock with a female lip 312 of an adjacent second decking panel 2, and moreover, there is enough room to insert a tool (e.g., cutting tool, welding tool, or fastening tool) between adjacent decking top flanges 84 in order to couple the decking panels 2 together at the four-layered sidelap seam 314.

The male lip 30 may be created at one of the decking panel edges 12 by roll forming (or other like operation) the decking panel edge 12 into a generally inverted U-shape, V-shape, or other like shape. The male lip 310 may have a first male lip layer 320 that is extended generally out of plane from an in-plane orientation of the decking panel 2, as illustrated in FIGS. 12A-13B.

Figure 12B:
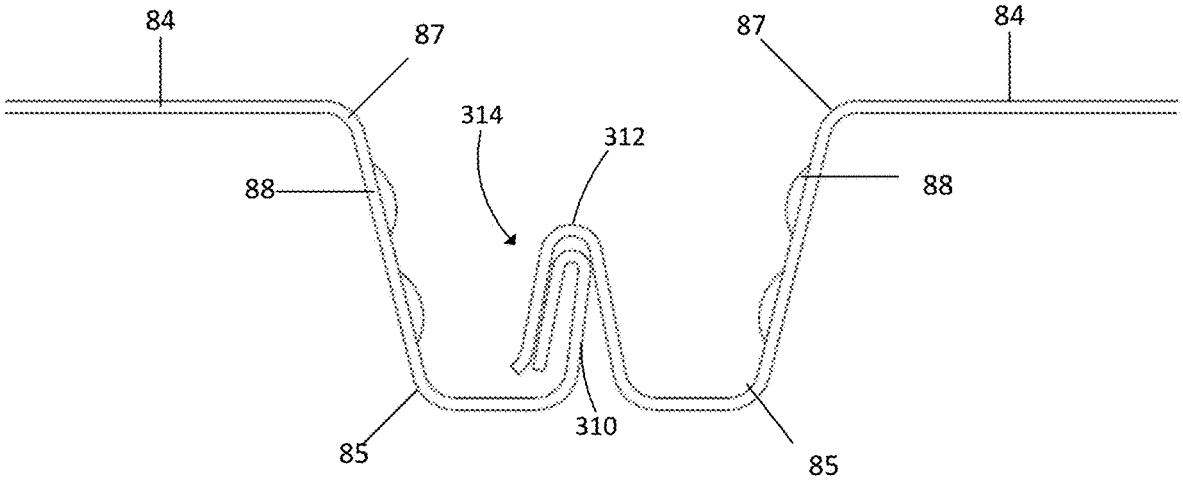
FIG. 12B illustrates a profile view of a sidelap seam with a male lip with an open inward fold located within a female lip, in accordance with embodiments of the invention.
Figure 13A:
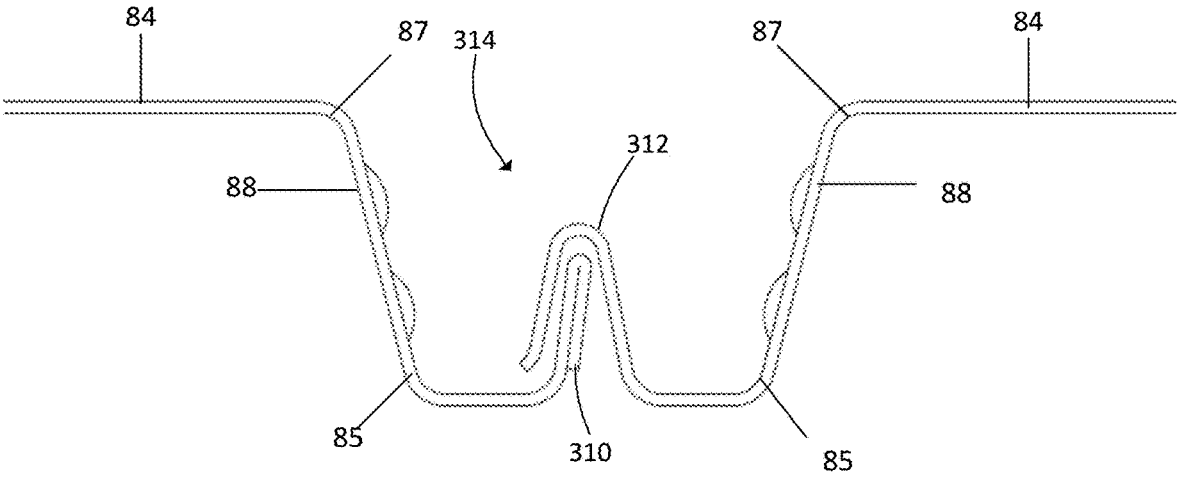
FIG. 13A illustrates a profile view of a sidelap seam with a male lip with a closed outward fold within a female lip, in accordance with embodiments of the invention.
Figure 13B:
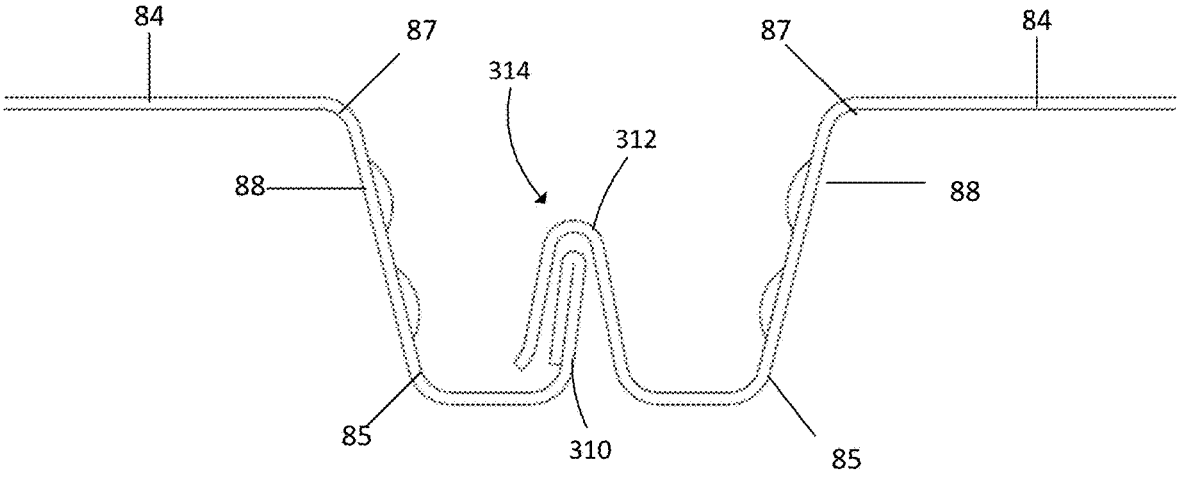
FIG. 13B illustrates a profile view of a sidelap seam with a male lip with a closed inward fold within a female lip, in accordance with embodiments of the invention.

As further illustrated in FIGS. 12A and 13B, the male lip 310 may have a second male lip layer 322 that is folded outwardly towards the outside of the decking panel edge 12. In other embodiments, as illustrated in FIGS. 12B and 13B, the second male lip layer 322 may be folded inwardly towards the inside of the decking panel edge 12.

In some embodiments, the male lip 310 may have a second male lip layer 22 that is folded in an open configuration to the inside or the outside of the decking panel edge 12 (e.g., inwardly or outwardly), as depicted in FIGS. 12A and 12B. The open configuration may include a second male lip layer 322 that has an end that diverges away from the first male lip layer 320. In other embodiments, the second male lip layer 322 may be folded in a closed configuration to the inside or the outside of the decking panel edge 12 (e.g., inwardly or outwardly), as depicted in FIGS. 13A an 13 B. The closed configuration may include a second male lip layer 322 that is parallel with, overlays, or has an end that converges towards the first male lip layer 320. In some embodiments of the invention the space between the first male layer 320 and the second male layer 322 may be as close as possible, however, there may be gaps between the second male lip layer 322 and the first male lip layer 320.

When folded, the male lip 310 typically includes a thickness of two layers of the panel 2 as illustrated in FIGS.

12A-14B. By including two panel layers in the male lip 310, the strength of the male lip 310 with two-layers is improved over the strength of a male lip with a single male lip layer along the decking panel edge 12. As such, the male lip 310 with two layers is less likely to be bent out of position before installation, and has improved strength even before the female lip 312 of an adjacent decking panel 2 is placed over the male lip 310 and the couplings 50 are created. Moreover, after the couplings 50 are used to create the connection, the shear strength of the sidelap 13 formed by coupling the two layer male lip 310 to the two layer female lip 312 increases the shear strength of the sidelap 13, thus allowing for the use of a reduced number of couplings 50 and/or a reduced material thickness of the panels 2 (e.g., as determined before the decking is installed). As such, utilization of the two-layer male lip 310 may enable the use of panels 2 with reduced material thicknesses (e.g., higher gage panels) to achieve the same or similar shear strengths along the sidelap 13 as panels 2 with greater material thicknesses (e.g., lower gage panels) that utilize a single layer male lip and/or more couplings, as will be illustrated in further detail below.

The panel edge 12 on the opposite side of the panel 2 as the male lip 310 may include an inverted "U" shaped female lip 312 as shown in FIGS. 12A-14B. Like the male lip 310, the female lip 312 may be generally out of plane (e.g., substantially perpendicular to the panels, such as located between 45 degrees+/−from an in-plane orientation with the plane of the panel 2, or the like) as illustrated in FIGS. 12A-13B. The female lip 312 may be offset from the adjacent top flange 4 such that there is room for the female lip 312 of the second decking panel 2 to interlock with the male lip 310 of an adjacent first decking panel 2, and moreover, there is room to insert a tool (e.g., cutting tool, welding tool, or fastening tool) between the top flanges 4 of adjacent panels 2 in order to couple the adjacent panels 2 together at the four-layered sidelap seam 314.

The female lip 312, in some embodiments, is configured to substantially cover the male lip 310 (e.g., configured to receive the male lip 310), such that the female lip 312 is typically larger than the male lip 310. The female lip 312 may be formed by folding the panel edge 12 into an "inverted U" or "inverted V" shape, or other like shape, with a channel that fits over the male lip 310. The female lip 312 may have a first female lip layer 330 that is extended generally out-of-plane from the in-plane orientation of the panel 12.

The female lip 312 may have a second female lip layer 332 that is folded outwardly towards the outside of the decking panel edge 12, as depicted in FIGS. 12A-14B. The second female lip layer 332 may extend generally out of plane, from the in-plane orientation of the panel 12. It should be understood that in other embodiments of the invention, the female lip 312 may have three layers, and the male lip may have a single layer in order to create the four or more layered sidelap seam 314.

It should be understood that the layers may be straight, or may have portions that are straight with other portions that are shaped (e.g., bent, curved, or the like), in order to add additional support to the male lip 310, the female lip 312, and/or the sidelap 13. The couplings 50 formed at the connection locations may occur in the straight portions and/or the shaped portions of the male lip 310, the female lip 312, and/or the sidelap 13

In order to operatively couple two adjacent panels 2 together, the male lip 310 of a first panel 4 may be received by a female lip 312 of a second panel 6. The female lip 312 may be placed over the male lip 310 as depicted in FIGS. 12A through 14B to create a sidelap seam 314 along the length of laterally adjacent panel edges 12. The purpose of the sidelap seam 314 and couplings 50 (e.g., cutting, deforming, welding, fastening, or the like) is to couple two adjacent panels 2 securely to each other in order to prevent one panel from lifting off another panel 2, preventing lateral movement between the lateral adjacent panels 2, and providing the desired shear strength of the panel system, such that the panel system, including the sidelap seam 314, meets the structural requirements for the application. When the male lip 310 and female lip 312 are coupled, the sidelap seam 314 may include four layers of decking panel material, in which two of the layers are associated with the male lip 310 and two of the layers are associated with the female lip 312. In other embodiments of the invention the sidelap seam 314 may have additional layers to further improve the shear strength of the sidelap seam 314 and/or panel system. For example, a five-layer seam, a six-layer sidelap seam, or the like formed by having additional folds on the male lip 310 (e.g., three layers) or on the female lip 312 (e.g., three layers) may be utilized in the present invention. However, in some embodiments of the invention, the tools used to cut (e.g., shear or punch) a five-layer sidelap seam, six-layer sidelap seam, or the like may need additional power to cut the layers in the sidelap seam while still operating between adjacent top flanges 84 of adjacent panels 2 of the structural panel systems.

In one embodiment of the invention the four-layer sidelap seam (or five-layer, six-layer, or the like) may be top-seam welded or side-seam welded in order to create the coupling (also described as a joint, connection, attachment, or the like) between adjacent decking panels 2. As illustrated by FIG. 14A the top seam weld may fuse the top 334 of the female lip 312 with the top 324 of the male lip 310. Additionally, in some embodiments, as illustrated in FIG. 14A filler material 340 may be added to form a pool of metal along with the metal from the female lip 312 and the male lip 310 in order to form an effective weld. A weld formed on the four-layer sidelap seam 314 is an improvement over a three-layer sidelap seam because of the additional layer of material provided in the male lip 310. When welding three-layer sidelap seams, burn through may occur when the filler material 340 burns through not only the female lip 312, but also through the single layer of the male lip 310, which causes a defective weld. A defective weld may result in additional time for a welder to repair the weld, and even after repairing, the weld may not have the desired shear strength. The extra layer of material in the male lip 310 of the present invention allows for additional material that is less likely to be burned through during the welding process. Particularly, using the closed male lip 310 illustrated in FIG. 14A may be better than using an open male lip 310 (not illustrated) during welding because burn through may be less likely when the layers are folded on top of each other since there is little or no space between the layers to allow for burn through of the filler material 340. This is particularly true as the material thickness of the decking panels 2 become thinner. FIG. 14A illustrates a male lip 310 with an inwardly folded second male lip layer 322; however, it should be understood that the top seam weld may be utilized with an outwardly folded second male lip layer 322. The outwardly or inwardly folded second male lip layer may be folded in an open or closed configuration. It should be noted that in some embodiments, after the female lip 312 is placed over the male lip 310, the female lip 312 and/or the male lip 310 might be deformed (e.g., crimped, or the like) before being welded.

In other embodiments, a side-seam weld may be utilized to create the couplings 50 in the sidelap seam 314. As was described with respect to the top seam weld, the side seam weld may fuse the one or more layers of the four-layer sidelap seam 314 and/or utilize filler material to create the welded coupling 50. Also, like with top-seam weld, when only three layers are present burn through may occur through the three layers, and as such, the coupling may not be formed properly and the shear strength of the coupling 50 may be reduced. As such, the presence of the fourth layer (or additional layers) provides additional material that helps to prevent burn through. However, the presence of the fourth layer may also make it more difficult to create a weld through all four layers. Moreover, the space limitations on either side of the sidelap seam 314 between the top flanges 84 of adjacent decking panels 2 may make it difficult to access the side of the sidelap seam 314 in order to create the side-seam weld. As such, in some embodiments a top seam weld may be more effective and/or easier to form than a side-seam weld.

In other embodiments of the invention, instead of a welded sidelap seam 314, as previously discussed, the four-layer sidelap seam 314 may be deformed and/or cut (e.g., sheared) to couple the decking panels 2 together. In some embodiments of the invention a tool having jaws is used to form the couplings 50 in the sidelap seam 314. The jaws (e.g., two or more opposed jaws) of the tool may span the out of plane side lap seam 314. The jaws may perform the deformation and cutting operations, or the jaws may include blades, cavities, punches, dies, and/or any other feature that deforms and/or cuts at least a portion of the sidelap seam 314. When actuated, the jaws, and/or other feature on the jaws, deform and/or cut the sidelap seam (e.g., in any order) in order to form the coupling 50. The jaws may be manually actuated or actuated through a power source, such as but not limited to pneumatically actuated, hydraulically actuated, electromechanically actuated, or actuated using any other type of power source in order to create the coupling 50. Depending on the material thickness of the four layers of the sidelap seam 314, pneumatic or hydraulic actuation may be required in order to cut through the four layers (or more) of the sidelap seam 314.

In one embodiment cutting the sidelap seam 314 comprises shearing and deforming a portion of the sidelap seam 314 to create a tab that provides interference at the ends of the tab to resist lateral movement of the adjacent panels. FIG. 14B illustrates one embodiment of the shearing of the sidelap seam 314; however, it should be understood that other embodiments may comprise other configurations for cutting the sidelap seam 314 to achieve the results described herein. FIG. 14B illustrates an inwardly folded closed male lip 310; however, it should be understood that any inwardly or outwardly, or open or closed lip may be utilized. Regardless of the male lip 310 being in an open or closed folded position, in some embodiments, as the jaws are actuated the four layers of the sidelap seam 314 are deformed, and thus, the deformation creates a male lip 310 having a closed folded configuration (e.g., if it wasn't already in a closed folded configuration). Additionally, the female lip 312 is deformed over the male lip 310 help secure the four layers of the sidelap seam 314 together at the location of the coupling.

As illustrated generally in FIG. 14B, in some embodiments tabs are formed by the jaws (or by other features attached to the jaws). In some embodiments the tabs are rectangular shaped. In some embodiments, instead of rectangular tabs 350 the portion of the sidelap seam 314 that is cut may form square, triangular, circular, oval, pentagonal, hexagonal, or any other like shape, or general shaped cutout in the sidelap seam 314 along with a corresponding tab. Regardless of the shape of the tab, the tab may create interferences between the male lip 310 layers and female lip 312 layers in order to, among other things, prevent or reduce the lateral movement of lateral adjacent panels 2.

The number of cut locations at a particular coupling location in the sidelap seam 314 may vary depending on the desired shear strength, thicknesses of the layers, shape of the jaws (or shape of an attachment feature to the jaws). In some embodiments, only one tab 350 (e.g., one rectangular tab) may be sheared into a coupling location in the sidelap seam 314. However, in other embodiments multiple tabs may be sheared into the sidelap seam 314 at a particular coupling location. Namely, the coupling may contain two or more tabs 350 (e.g., two or more sheared rectangular tabs). More tabs 350 may theoretically mean better shear strength and resistance to lateral forces. As illustrated in FIG. 14B, the tabs (or other like couplings 50) may have an alternating configuration, such that one tab extends or bows outwardly while an adjacent tab extends or bows inwardly on the same side of the sidelap seam 314. Alternating the tabs in this fashion may help to increase shear strength and resistance to lateral forces. It should be understood that any number of tabs (e.g. one or more) in any type of position (e.g., alternating or on the same side of the sidelap seam 314), and in any shape, might be utilized to create the coupling.

In still other embodiments of the invention, fasteners 70 may be utilized instead of welds or the cut or sheared couplings 50 described with respect to FIG. 14B.

As illustrated in Table 1, as the thicknesses of the decking panels increase (e.g., as the gage decreases from 22 to 20 to 18 to 16, or the like) the shear strength along the sidelap seam between two decking panels generally increases. However, when compared to a three-layer sidelap seam having a single male lip layer, a four-layer sidelap seam having two male lip layers shows improvements in shear strength. For example, for panels 2 that were 0.0299 inches thick (e.g., 22 gage) the two examples tested using the four-layer sidelap seams illustrated a 46% improvement in the shear strength (for both the open and closed configurations) over using the same type of coupling in a three-layer sidelap seam. With respect to the decking panels that were 0.0359 inches thick (e.g., 20 gage) the two examples tested using the four-layer sidelap seam illustrated an improvement in the shear strength of 53% (for the open male lip configuration) and 41% (for the closed male lip configuration), respectively, over the shear strength of the three-layer sidelap seam using the same type of coupling. With respect to the decking panels that were 0.478 inches thick (e.g., 18 gage) the two examples tested using the four-layer sidelap seam illustrated an improvement in the shear strength of 66% (for the open male lip configuration) and 62% (for the closed male lip configuration), respectively, over the shear strength of the three-layer sidelap seam using the same type of coupling. With respect to the decking panels that were 0.0598 inches thick (e.g., 16 gage) only the three layer sidelap seam was tested. It should be understood that four or more layers may be created in the seam of the 16 gage material, however, tests were not performed on the 16 gage material with a four-layer sidelap seam. As illustrated, the shear strength of the 16 gage material using a three-layer sidelap seam was 6628 lbs., while the shear strength of the four-layer sidelap seam using the 18 gage material (e.g., thinner than the 16 gage material) was 7717 lbs. As such, the four-layer sidelap seam using the thinner material provided improved shear strength of 16% over the three-layer sidelap seam using the thicker material.

TABLE 1

Test data comparing the shear strength of the three layer side-lap seam to the four layer side-lap seam

| | Design Base Metal | Seam with Single Layer Male | Seam with Open Double Layer Male | | Seam with Closed Double Layer Male | |
|---|---|---|---|---|---|---|
| Gage | Thickness t (in) | Shear Strength (lbs.) | Shear Strength (lbs.) | % Increase | Shear Strength (lbs.) | % Increase |
| 22 | 0.0299 | 2356 | 3431 | 46% | 3438 | 46% |
| 20 | 0.0359 | 3369 | 5164 | 53% | 4750 | 41% |
| 18 | 0.0478 | 4656 | 7717 | 66% | 7564 | 62% |
| 16 | 0.0598 | 6628 | — | — | — | — |

The values displayed in Table 1 relate to single results of testing of the four-layer sidelap seams of the present invention versus three-layer sidelap seams in one example. The actual repeatable product testing may provide different results, but generally it should be understood that with other variables being equal the four-layer sidelap seam provides improved shear strength when compared to three-layer sidelap seams. As such, based in part on Table 1, the use of a four-layer sidelap seam over a three-layer sidelap seam generally increases the shear strength of the sidelap seam. The increased shear strength, with all other factors being equal, shows at least a 40% improvement in the shear strength. However, in other embodiments of the invention, with reduced material thickness the shear strength of the four-layer sidelap seam may also illustrate an improvement over three-layer sidelap seams with greater material thicknesses. As such, in the present invention, the shear strength of the four-layer sidelap seam, may have a 5, 10, 15, 20, 25, 30, 35, 40, 45, 50, 55, 60, 65, 70, 75, 80, 85, 90, 95, 100, 110, 120, 130, 150, or more percent improvement over the shear strength of a three-layer sidelap seam (e.g., with the other factors of panel thickness and number of couplings being equal). The improvement in shear strength may include a range that falls within, is outside of, or overlaps any of the percent values recited above. It should be noted that the shear strengths illustrated in Table 1 are for the isolated couplings within a sample of a panel system. Moreover, the shear strengths of the sidelap seam 314 may be less than, the same as, or greater than what is illustrated in Table 1 based on the type of couplings formed in the sidelap seam. For example, a different type of coupling formed by cutting may result in a shear strength that is less than, equal to, or greater than what is illustrated in Table 1. In another example, using a weld or a fastener (e.g., different types of fasteners) as couplings 50 may result in a shear strength that is less than, equal to, or greater than what is illustrated in Table 1. However, it should be understood that utilizing the four-layer sidelap seam (or more than four-layers) with various types of couplings 50 may result in improved shear strength over the use of the same or similar couplings 50 in a three-layer sidelap seam.

As previously discussed with respect to the improved shear strength resulting from the use of the reinforcing member 250, the improved shear strength of the four layer sidelap seam 314 allows for the use of aspects of the present invention that improve the ductility of the panel system. The improved sidelap seam 314 allows for the use of panels 2 with reduced thicknesses, a reduce number of connections along the length of the sidelap seam, the use of the connection configuration patterns previously discussed herein, and/or use of other aspects of the invention described herein that create bucking spans in the panels, which allow for buckling of the panels 2 before failure of the connections (e.g., failure of the couplings to the support members 31, failure of the couplings in the sidelap seam 314, and/or failure of the sidelap seam 314 or panels around the couplings). For example, by increasing the strength of the sidelap seam 314, and utilizing the connection configurations previously described herein, the buckling spans are created in the panels 2 without degrading the strength of the overall ductile fluted panel system (e.g., without reducing the ultimate loading strength of the ductile fluted panel system). Without increasing the strength of the sidelap seams 314 between the panels 2, the ability to create the buckling spans in the panels 2 without degrading the strength of the system may not be possible.

Moreover, as previously discussed, the increased shear strength utilizing the four-layer out-of-plane sidelap seam 314 may be an improvement over a three-layer sidelap seam because not as many couplings would be needed in the four-layer sidelap seam in order to achieve the same or similar shear strength in the three-layer sidelap seam. In one example, with respect to Table 1, when using 18 gage panels with a ten (10) foot long sidelap seam of mating decking panels 10 and couplings that are located one foot apart (e.g., at 0.5 ft, 1.5 ft, 2.5 ft . . . 9.5 ft) a decking system that utilizes the three-layer sidelap seam may have a shear strength of 46,560 (e.g., 10 couplings multiplied by the 4656 lbs. shear strength of a single coupling in the 18 gage panel). In the present invention, the same system (e.g., 18 gage panels with a ten (10) foot long sidelap seam, and the same type of couplings) can achieve the same or similar shear strength in the four-layer sidelap seam by utilizing only 6 couplings (e.g., 46,560/7717 equals 6.033 couplings). This illustrates a 40% reduction in the amount of couplings. As such in some embodiments of the invention, depending on the gage thickness, the length of the sidelap seam, the type of four-layer sidelap seam, the type of couplings, or other like parameters, the number of couplings used in the four layer sidelap seam of the present invention may be reduced by 5, 10, 15, 20, 25, 30, 35, 40, 45, 50, 55, 60, 65, 70, 75, 80, 85, 90, 95, or more percent when compared to the number of couplings used in a three layer sidelap seam (e.g., with all the other factors of the systems being equal) while maintaining the same or similar shear strength. As such, the number of couplings 50 may be reduced by any percentage illustrated or by any range that falls within, is outside of, or overlaps any of the percentages listed above. The reduction in the number of couplings 50 used reduces the assembly time of the system, which results in lower costs and improved safety (e.g., the workers spend less time on roofs installing the systems).

As previously discussed the increased shear strength utilizing the four-layer sidelap seam may be an improvement over a three-layer sidelap seam because using the four-layer sidelap seam may allow a four-layer sidelap seam system to drop gage thicknesses (e.g., move from 18 gage to 20 gage) without sacrificing shear strength. As illustrated in Table 1, a system may be able to utilize 20 gage panels using the four-layer sidelap seam to achieve a shear strength (e.g., 5164 lbs. or 4750 lbs.) that is the same or similar to the shear strength (e.g., 4656 lbs.) using a three-layer sidelap seam with an 18 gage panel (e.g., thicker than the 20 gage panel) and the same number of couplings 50. In some embodiments of the invention, a reduction in the thickness of the panels (e.g., a drop down in the gage thickness from 18 to 20, or any other drop) may not be achieved without also increasing the number couplings used in the four-layer sidelap seam. This would only occur when a reduction in the thickness of the panels using a four-layer sidelap seam with the same number of couplings as the three-layer sidelap seam using the thicker panels would not result in the same shear strength. Adding additional couplings 50 in the four-layer sidelap seam may achieve the desired shear strength, while still reducing costs because the material is less expensive (e.g., thinner decking panels), even though creating the additional couplings 50 in the sidelap seam would increase the cost of assembly. As such, in some embodiments of the invention, depending on the gage thickness, the length of the sidelap seam, the type of four-layer sidelap seam, the type of couplings, or other like parameters, the thickness (or in other embodiments of the invention the weight) of the panels may be reduced by 5, 10, 15, 20, 25, 30, 35, 40, 45, 50, 55, 60, 65, 70, 75, 80, 85, 90, 95, or more percent, while still achieving the same shear strength as a three layer sidelap seam that utilizes the same, more, or in some cases less couplings.

In other embodiments of the invention, a nested sidelap 414 may be utilized as the sidelap 13 in embodiments of the present invention in order to strengthen the sidelap 13 to be able to create the desired buckling spans in the panels 2. Embodiments of the nested sidelap 414 may be illustrated in FIGS. 15A-17B. As illustrated in FIGS. 15A-17B, panel edges 12 may be formed into lips that couple a first structural panel 2 to a lateral adjacent second structural panel 2. The lips on opposite edges 12 of a structural panel 2 may include a "lower lip" 410 and an "upper lip" 412, which may be nested with the opposing lips on lateral adjacent structural panels 2. For example, lateral adjacent structural panels 2 may be coupled together by resting the upper lip 312 of a first structural panel edge 12 on top of the lower lip 410 of a second structural panel edge 12. The lower lip 410 may be dimensioned in some embodiments in order to allow the upper lip 412 to fit within a nested portion 411 of the lower lip 410 over at least a portion of the length of, or the entire length of, the edge of the structural panel edges 12 without the use of tools in order to form a nested sidelap 414 (e.g., unjoined without couplings). As will be explained in further detail, the couplings 50 may be formed in the nested sidelap 414 of the structural panels 2 to couple adjacent structural panels 2 to each other. Multiple structural panels 2 may be modularly configured to create a variety of differently sized walls, floors, or roofing arrangements (e.g., different parts of the wall, floor, or roof may have different panels 2 with different material thicknesses). In other embodiments of the invention, a first structural panel 4 may have two lower lips 410 on each edge 12 and a second structural panel 6 may have two upper lips 412 on each edge 12, such that the structural panels are alternated when assembled to form the structural system.

One structural panel edge 12 may include a generally in plane lower lip 410 (e.g., located between 45 degrees+/− from an in-plane orientation with the plane of the structural panel 2, or the like) as illustrated in FIGS. 15A-17B. The lower lip 410 may be offset from one of the structural top flanges 84, such that the lower lip 410 does not extend around a lower flange corner 85 and/or web 88. In one embodiment the lower lip 410 may comprise a nested portion 411 at the end of the lower lip 410, which has a radius of curvature and is curved upwardly from an in-plane orientation with respect to the structural panel 2. The nested portion 411 of the lower lip 410 may have the same shape as a lower flange corner 85 of an edge 12 of an adjacent structural panel 2. As such the nested portion 411 of a lower lip 410 of a second structural panel 2 may allow the flanged corner 85 of a first structural panel 2 to lie within the nested portion 411 when the upper lip 412 is placed over the lower lip 410.

Figure 15A:
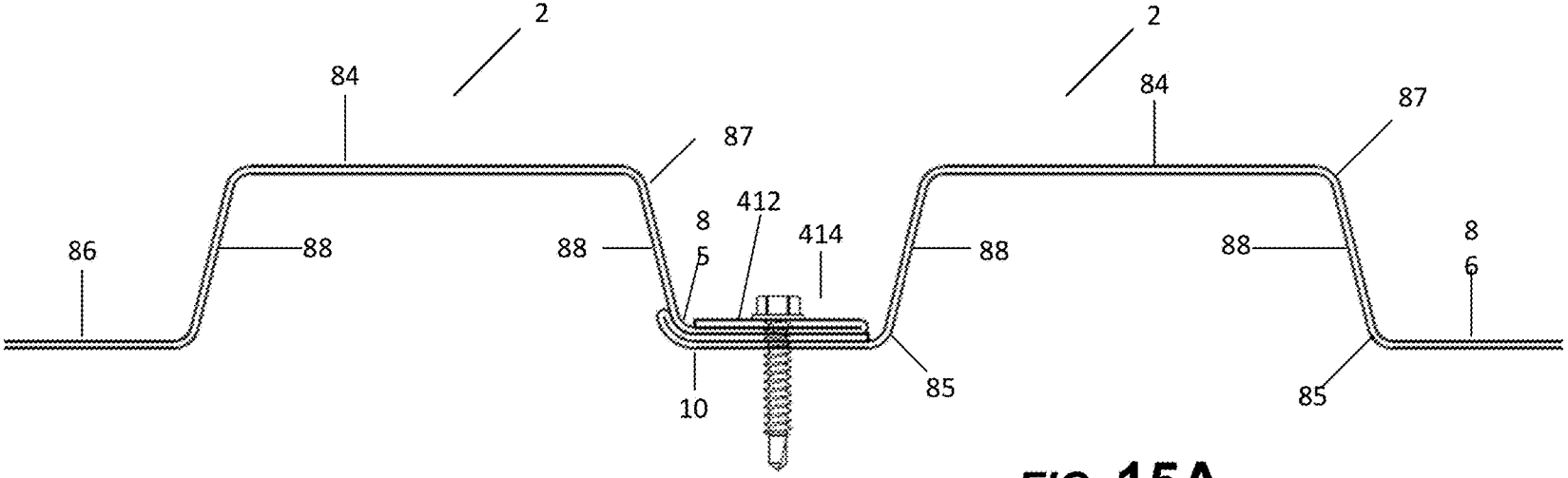
FIG. 15A illustrates a profile view of a portion of a structural panel system having a nested sidelap with a fastener coupling, in accordance with embodiments of the invention.

The lower lip 410 may be created at one of the structural panel edges 12 by roll forming (or other like operation) the structural panel edge 12 into a generally flat in plane shape (as illustrated in FIGS. 15A-17B), or another shape such as a bowed shaped (e.g., concave or convex), or the like. The lower lip 410 may have a first lower lip layer 420 that is extended in a generally in-plane orientation, as illustrated in FIGS. 15A and 15B. As further illustrated in FIGS. 15A and 15B, the lower lip 410 may have a second lower lip layer 422 that is folded inwardly back towards the upper surface (e.g., top surface or outer surface, such as the surface that faces up when decking is installed) of the structural panel edge 12, such that the first lower lip layer 420 is the bottom layer of the lower lip 410 and the second lower lip layer 422 is the top layer of the lower lip 410. In other embodiments, not illustrated in the Figures, the second lower lip layer 22 may be folded outwardly back towards the lower surface (e.g., bottom surface or inner surface, such as the surface that faces down when the deck is installed) of the structural panel edge 12, such that the first lower lip layer 420 is the top layer of the lower lip 410 and the second lower lip layer is the bottom layer of the lower lip 410.

The figures illustrate that the first lower lip layer 420 and the second lower lip layer 422 touch; however, it should be understood that in some embodiments there may be no gap between the surfaces of the first lower lip layer 420 and the second lower lip layer 422 (as illustrated in the figures), may be some gaps along at least a portion of the first lower lip layer 420 and the second lower lip layer 422, or a gap along the entire length of the lower lip 410 between the first lower lip layer 420 and the second lower lip layer 422. As such, in some embodiments of the invention the second lower lip layer 422 may converge towards the first lower lip layer 420, diverge away from the first lower lip layer 420, or both depending on the location along the length of the lower lip 410.

Figure 15B:
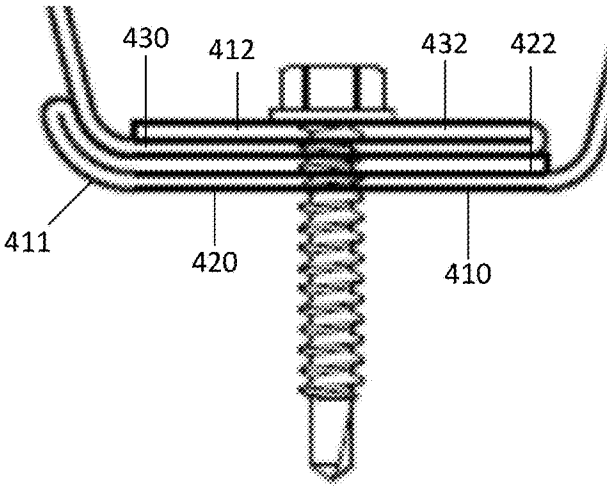
FIG. 15B illustrates an enlarged view of the profile of the nested sidelap and fastener coupling of FIG. 15A, in accordance with embodiments of the invention.

When folded, the lower lip 410 typically includes a thickness of two layers of the structural panel 2 as illustrated in FIGS. 15A and 15B. By including two structural panel layers in the lower lip 410, the strength of the lower lip 410 with two-layers is improved over the strength of a lower lip 410 with a single lower lip layer along the structural panel edge 12. As such, the lower lip 410 with two layers is less likely to be bent out of position before installation, and has improved strength even before the upper lip 412 of an adjacent structural panel 2 is placed over the lower lip 410 and the couplings 50 are created. Moreover, after the couplings 50 are formed, the shear strength of the nested sidelap 414 formed by coupling the two layer lower lip 410 to the two layer upper lip 412 increases the shear strength of the nested sidelap 414 and/or system, thus allowing for the use of a reduced number of couplings and/or reduced material thickness of the structural panels 2 (e.g., as determined before the structural panels are installed), or the use of aspects of the present invention that increase the ductility of the system. As such, utilization of the two-layer lower lip 410 and two-layer upper lip 412 may enable the use of structural panels 2 with reduced material thicknesses (e.g., higher gage panels) to achieve the same or similar shear strengths along the nested sidelap as other structural panels with greater material thicknesses (e.g., lower gage panels)

that utilize a single layer for the lips (e.g., a two layer nested sidelap) or utilize a sidelap seam configuration, as explained in further detail later.

The opposite structural panel edge 12 may include a generally in-plane upper lip 412 (e.g., located between 45 degrees+/−from a parallel orientation with the plane of the structural panel 2, or the like) as illustrated in FIGS. 15A and 15B. The upper lip 412 may be offset from one of the top flanges 84, such that the upper lip 412 does not extend around a lower flange corner 85 and/or web 88. In one embodiment, the upper lip 412 may comprise a nested portion at the end of the upper lip 412, which has a radius of curvature and is curved upwardly from an in plane orientation with respect to the structural panel 2 (not illustrated in the Figures). The nested portion of the upper lip 412 may have the same shape as a lower flange corner 85 of an edge 12 of a lateral adjacent structural panel 2. As such, the nested portion of an upper lip 412 of a first structural panel 2 may lie within the flanged corner 85 and/or over the web 88 of a second structural panel 2 when the upper lip 412 is placed over the lower lip 410. As such, in some embodiments the edges 12 of all the structural panels 2 may have the same lip (e.g., the lower lip 410 is the same as the upper lip 412), such that the structural panel 2 may be utilized in either a right-handed or left handed configuration and are interchangeable with each other, which may reduce assembly or installation costs.

The upper lip 412 may be created at one of the structural panel edges 12 by roll forming (or other like operation) the structural panel edge 12 into a generally flat in-plane shape (e.g., horizontal orientation in roof or floor systems) as illustrated in the figures, or another shape such as a bowed shaped (e.g., concave or convex), or the like. The upper lip 412 may have a first upper lip layer 430 that is extended in a generally in-plane orientation, as illustrated in FIGS. 15A and 15B. As further illustrated in FIGS. 15A and 15B, the upper lip 412 may have a second upper lip layer 432 that is folded inwardly back towards the upper surface (e.g., top surface or outer surface, such as the surface that faces up when the roof panel is installed) of the structural panel edge 12, such that the first upper lip layer 430 is the bottom layer of the upper lip 412 and the second upper lip layer 432 is the top layer of the upper lip 412. In other embodiments, not illustrated in the figures, the second upper lip layer 432 may be folded outwardly back towards the lower surface (e.g., bottom surface or inner surface, such as the surface that faces down when the roof panel is installed) of the structural panel edge 12, such that the first upper lip layer 430 is the top layer of the upper lip 412 and the second upper lip layer 432 is the bottom layer of the upper lip 412.

The figures illustrate that the first upper lip layer 430 and the second upper lip layer 432 touch. However it should be understood that in some embodiments there may be no gap between the surfaces of the first upper lip layer 430 and the second upper lip layer 432 (as illustrated in the figures), may be some gaps along at least a portion of the first upper lip layer 430 and the second upper lip layer 432, or a gap along the entire length of the upper lip 412 between the first upper lip layer 430 and the second upper lip layer 432. As such, in some embodiments of the invention the second upper lip layer 432 may converge towards the first upper lip layer 432, diverge away from the first upper lip layer 432, or both depending on the location along the length of the lower lip 410.

When folded, the upper lip 412 typically includes a thickness of two layers of the structural panel 2 as illustrated in FIGS. 15A and 15B. By including two structural panel layers in the upper lip 412, the strength of the upper lip 412 with two-layers is improved over the strength of an upper lip 412 with a single upper lip layer along the structural panel edge 12. As such, the upper lip 412 with two layers is less likely to be bent out of position before installation, and has improved strength even before the upper lip 412 is placed over a lower lip 410 of an adjacent structural panel 2 and the couplings 50 are used to create the connection. Moreover, after the connection is formed from the couplings 50 the shear strength of the nested sidelap 414 formed by coupling the two layer upper lip 412 to the two layer lower lip 410 increases the shear strength of the nested sidelap, thus allowing for the use of a reduced number of couplings and/or reduced material thickness of the structural panels 2 (e.g., as determined before the structural panels are installed). As such, utilization of the two-layer lower lip 410 and two-layer upper lip 412 may enable the use of structural panels 2 with reduced material thicknesses (e.g., higher gage panels) to achieve the same or similar shear strengths along the nested sidelap as other structural panels with greater material thicknesses (e.g., lower gage panels) that utilize a single layer for the lips (e.g., a two layer nested sidelap) or a sidelap seam, as discussed later in further detail. Moreover, as previously discussed with respect to the sidelap seam in FIGS. 12A-14B, the improved strength of nested sidelap 414 and/or system using the nested sidelap 414 may allow for the use of other features of the present invention that increase the ductility of the roof and/or wall systems.

In some embodiments the upper lip 412 and/or the lower lip 410 may extend beyond the lower flange corners 85 of the adjacent structural panels 2. In still other embodiments the nested sidelap 414 with three or more layer may be located over a width within the center, on the left side, on the right side, or anywhere else within the bottom flange 86 created between two adjacent top flanges 84 of adjacent structural panels 2.

In order to couple two adjacent panels 2 together, the lower lip 410 of a first structural panel 2 (with or without the nested portion 411) may receive an upper lip 412 of a second structural panel 2. The upper lip 412 may be placed over the lower lip 410 as depicted in FIGS. 15A and 15B to create an nested sidelap 414 (e.g., unjoined without couplings) along the length of lateral adjacent structural panel edges 12. The purpose of the nested sidelap 414 formed after coupling (e.g., utilizing a fastener, deforming and/or cutting, welding, or the like) is to couple two adjacent structural panels 2 securely to each other in order to prevent one panel from separating transversely from another panel 2 (e.g., lifting vertically off another panel in a horizontal roof installation or lifting horizontally away from another panel in a vertical wall installation), preventing in plane movement (e.g., shifting of the panels along the nested sidelap) between the adjacent structural panels 2, and providing the desired shear strength of the structural system, such that the structural system, including the nested sidelap 414, meets the structural requirements for the application. When the lower lip 410 and upper lip 412 are coupled, the nested sidelap 414 may include four-layers of structural panel material, in which two of the layers are associated with the lower lip 410 and two of the layers are associated with the upper lip 412. In other embodiments of the invention the nested sidelap 414 may have additional layers to further improve the shear strength of the structural system. For example, a five-layer nested sidelap, a six-layer nested sidelap, or the like formed by having additional folds on the lower lip 410 (e.g., three-layers) or on the upper lip 412 (e.g., three-layers) may be utilized in the present invention. However, in some embodiments of the invention the fasteners or tools used to cut (e.g., shear, punch, or the like) a five-layer nested sidelap, six-layer nested sidelap, or the like may need additional power to cut the layers in the nested sidelap 414 while still operating between adjacent top flanges 84 of adjacent panels 2 of the structural panels.

Figure 16A:
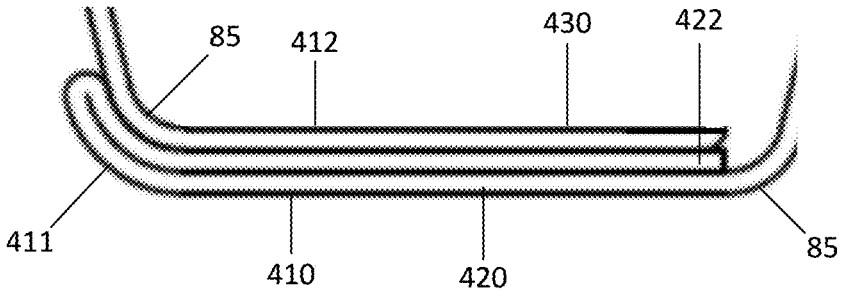
FIG. 16A illustrates an enlarged view of the profile of a nested sidelap of the structural panel system having a one-layer upper lip placed over a two-layer lower lip, in accordance with embodiments of the invention.

As illustrated in FIG. 16A, in some embodiments of the invention, the upper lip 412 may only have a single first upper lip layer 430, while the lower lip 410 may comprise the first lower lip layer 420 and the second lower lip layer 422 previously described above. As such, as illustrated in FIG. 16A the upper lip 412 and the lower lip 410 form a nested sidelap 414 with a total of three-layers. As previously discussed with respect to the four-layer nested sidelap, a lower lip 410 may comprise a nested portion 411 in which the upper lip 410 and/or the lower flange corner 85 rests. Moreover, as previously discussed, the upper lip 412 may also have an upper nested portion (not illustrated) that may also rest within a lower flange corner 85, as previously discussed.

Figure 16B:
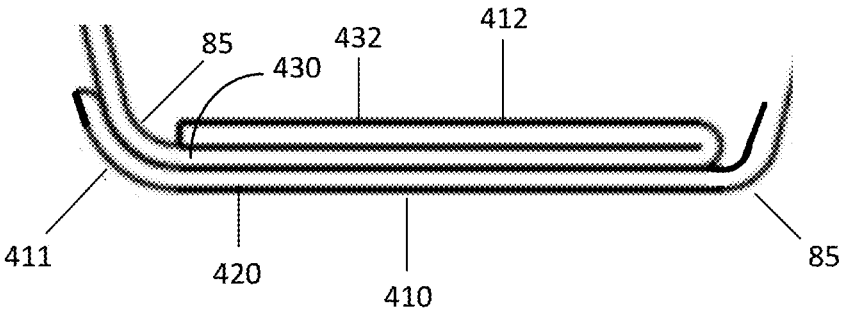
FIG. 16B illustrates an enlarged view of the profile of a nested sidelap of the structural panel system having a two-layer upper lip placed over a one-layer lower lip, in accordance with embodiments of the invention.

As illustrated in FIG. 16B, in some embodiments of the invention, the lower lip 410 may only have a single first lower lip layer 420, while the upper lip 410 may comprise the first upper lip layer 430 and the second upper lip layer 432 previously described above. As such, as illustrated in FIG. 16B the upper lip 412 and the lower lip 410 form a nested sidelap 414 with a total of three-layers. As previously discussed with respect to the four-layer nested sidelap, the lower lip 410 may comprise a nested portion 411 in which the upper lip 410 and/or the lower flange corner 85 rests. Moreover, as previously discussed, the upper lip 412 may also have an upper nested portion (not illustrated) that may also rest within a lower flange corner 85.

It should be understood that the layers in the upper lip 410 and/or lower lip 420 may be straight, or may have portions that are straight with other portions that are shaped (e.g., bent, curved, or the like), in order to add additional support to the upper lip 410, the lower lip 420, and/or the nested sidelap 414. The couplings 50 formed at the connection locations may occur in the straight portions and/or the shaped portions of the lower lip 410, the upper lip 412, and/or the sidelap 13.

Figure 17A:
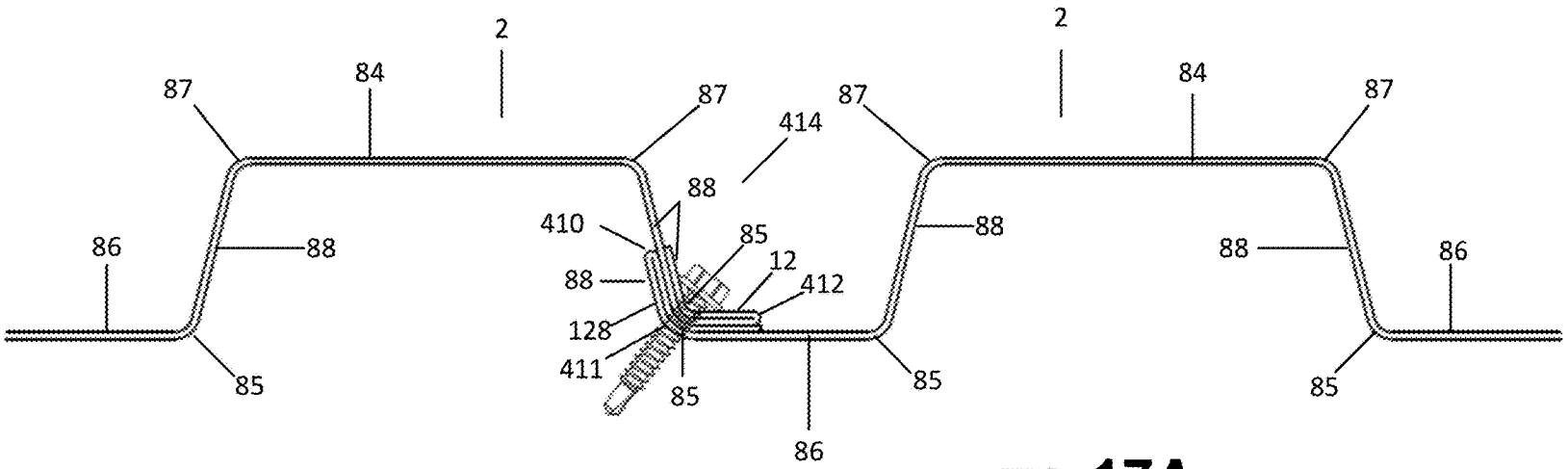
FIG. 17A illustrates a profile view of a portion of a structural panel system having a nested sidelap with a two-layer upper corner lip placed over a two-layer lower corner lip, in accordance with embodiments of the invention.
Figure 17B:
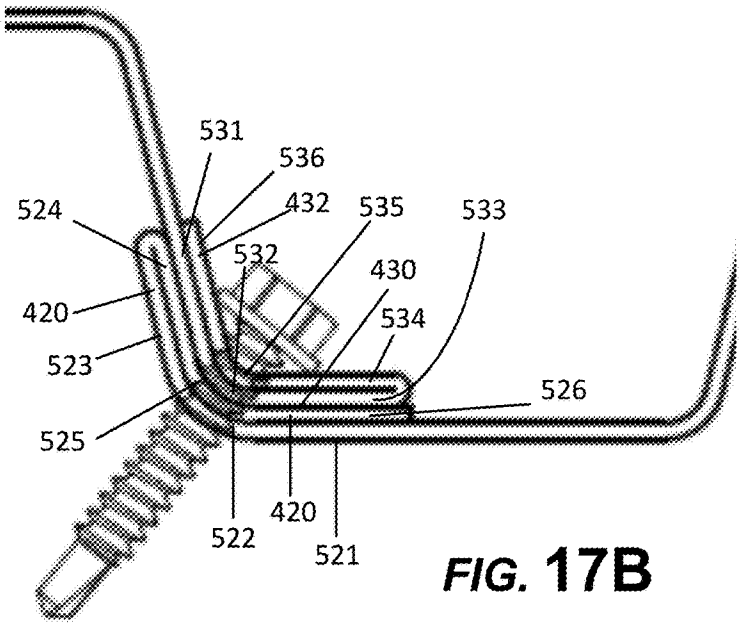
FIG. 17B illustrates an enlarged view of the profile of the nested sidelap of the structural panel system illustrated in FIG. 17A, in accordance with embodiments of the invention.

FIGS. 17A and 17B illustrate another embodiment of the invention, in which the nested sidelap 414 is formed around the lower flange corner 85 of one of the structural panels 2. As illustrated in FIG. 17A, in one embodiment a first structural panel 2 may comprise an edge 12 with an upper lip 412 formed around the lower flange corner 85. The upper lip 412 may comprise a first upper lip layer 430 formed from a first upper portion 531 (e.g., a portion of a web 88), a second upper portion 532 (e.g., lower flange corner 85), and a third upper portion 533 (e.g., a portion of a lower flange 86 located at the edge 12 of the panel 2). The upper lip 412 may also comprise a second upper lip layer 432 that is folded back upon the first upper lip layer 430 formed by a fourth upper portion 534 (e.g., portion folded back upon the third upper portion 533, such as the portion of the lower flange 86 at the edge 12 of the structural panel 2), a fifth upper portion 535 (e.g., folded back upon the second upper portion 532, such as the lower flange corner 85), and a sixth upper portion 536 (e.g., folded back upon the first upper portion 531, such as the portion of the web 88). As illustrated in FIG. 17B, in one embodiment a second structural panel 2 may comprise an edge 12 with a lower lip 410 forming a nested portion 411 in which the upper lip 412 rests. The lower lip 410 may comprise a first lower lip layer 420 formed from a first lower portion 521 (e.g., a portion of a bottom flange 86), a second lower portion 522 (e.g., lower flange corner 85), and a third lower portion 523 (e.g., a portion of a web 88). The lower lip 410 may also comprise a second lower lip layer 422 that is folded back upon the first lower lip layer 420 formed by a fourth lower portion 524 (e.g., portion folded back upon the third upper portion 523, such as a portion of the web 88), a fifth lower portion 525 (e.g., folded back upon the second lower portion 522, such as a portion of the lower flange corner 85), and a sixth lower portion 526 (e.g., folded back upon the first lower portion 521, such as the portion of the bottom flange 86).

As such, the nested sidelap 414 in some embodiments may be formed in multiple planes around a lower flange corner 85, such as in-plane with the lower flange 86 formed between adjacent structural panel edges 12, at an angle from the lower flange 86 and in-plane with a web 88, and around a lower flange corner 85. The connections formed by the couplings 50 in the nested sidelap 414 illustrated in FIGS. 17A and 17B may be formed in multiple portions of the nested sidelap 414, such as in-plane with the bottom flange 86 formed between adjacent structural panels 2, in-plane with the web 88, and/or in the lower flange corner 85 (as illustrated in FIGS. 17A and 17B). The corner nested sidelap 414 illustrated in FIGS. 17A and 17B may provide for improved strength because not only does it have four-layers but it has two portions of the four-layer nested sidelap 414 that are located in different planes and a third portion that operatively couples the two portions that are located in different planes. As such, the nested sidelap 414 has stiffening elements in two different orientations (e.g., the two planes). In other embodiments as previously discussed with respect to the nested sidelaps in FIGS. 16A and 16B, the corner nested sidelap 414 may only have three layers (e.g., a single first upper layer 430 in the upper lip 412 and/or a single first lower layer 420 in the lower lip 410).

Table 2 illustrates percent improvements for the diaphragm shear strength values for a four-layer nested sidelap 414 over a two-layer nested sidelap 414 for structural decking systems with different panel thicknesses, and using self-drilling screws as the couplings 50 at the connection locations. The minimum shear strength improvements illustrated in Table 2 were found at the lower span lengths (e.g., shorter lengths of the decking panels), while the maximum shear strength improvements were found at the higher span lengths.

TABLE 2

Four-Layer In-Plane Nested Sidelap Diaphragm Shear Strength Improvements over Two-Layer In-Plane Nested Sidelap Diaphragm Shear Strength

| Panel | Shear Strength Improvement | | |
|---|---|---|---|
| Gage | Min | Max | Average |
| 22 | 5% | 26% | 18% |
| 20 | 6% | 26% | 17% |
| 18 | 6% | 26% | 17% |
| 16 | 6% | 26% | 17% |

It should be understood that utilizing a nested sidelap of the present invention described herein (e.g., four-layer, three-layer, corner nested sidelap, or other layer nested sidelap greater than two-layers) may improve the shear strength of the nested sidelap and/or structural panel system over a two-layer nested sidelap and/or structural panel system by 1, 2, 3, 4, 5, 6, 7, 8, 9, 10, 11, 12, 13, 14, 15, 16, 17, 18, 19, 20, 21, 22, 23, 24, 25, 30, 35, 40, 45, 50, 55, 60, 65, 70, 75, 80, 85, 90, 95, 100, 110, 120, 130, 150, 200, 250, 300 or more percent. In other embodiments the improvement may be outside of, within, or overlapping any numbers within this range.

As previously discussed, with respect to the improved strength resulting from the use of the reinforcing member 250 or the out-of-plane four-layer sidelap seam 314, the improved shear strength of the nested sidelaps 414 described herein allows for the use of aspects of the present invention that improve the ductility of the panel system. The improved nested sidelaps 414 allows for the use of panels 2 with reduce thicknesses, the use of a reduced number of couplings 50 at the connection locations, the use of the connection configuration patterns previously discussed herein, and/or use of other aspects of the invention described herein that create bucking spans in the panels 2, which allow for buckling of the panels 2 before failure of the connections (e.g., failure of the couplings 50 to the support members 31, failure of the couplings 50 in the nested sidelap 414, and/or failure of the nested sidelap 414 or panels 2 around the couplings 50). For example, by increasing the strength of the sidelap through the use of a nested sidelap 414, and utilizing the connection configurations previously described herein, the buckling spans are created in the panels 2 without degrading the strength of the overall ductile fluted panel system (e.g., without reducing the ultimate loading strength of the ductile fluted panel system). Without increasing the strength of the sidelap between the panels 2, the ability to create the buckling spans in the panels 2 without degrading the strength of the system may not be possible.

Alternatively, as discussed herein, using the four-layer nested sidelap 414 (or three-layer nested sidelap) of the present invention can increase the stiffness without affecting the costs because the number of couplings and/or the thickness of the decking panels remain unchanged. The improvement of the present invention is due in part to creating a connection through four-layers (or three-layers) using a coupling 50, which is stiffer than creating a connection through two-layers. The values for Table 2, and discussion thereof, are described as being related to roof systems 100, but it should be understood that the same principals would also apply to wall systems 1.

Moreover, as previously discussed, the increased shear strength utilizing the four-layer nested sidelap 414 may be an improvement over a two-layer in-plane nested sidelap because not as many couplings 50 would be needed in the four-layer nested sidelap 414 in order to achieve the same or similar shear strength in the two-layer sidelap. As such in some embodiments of the invention, depending on the gage thickness, the length of the nested sidelap, the type of four-layer nested sidelap 414, the type of couplings 50, or other like parameters, the number of couplings used in the four layer nested sidelap of the present invention may be reduced by 5, 10, 15, 20, 25, 30, 35, 40, 45, 50, 55, 60, 65, 70, 75, 80, 85, 90, 95, or more percent when compared to the number of couplings used in a two-layer in-plane sidelap (e.g., with all the other factors of the systems being equal) while maintaining the same or similar shear strength. As such, the number of couplings 50 may be reduced by any percentage illustrated or by any range that falls within, is outside of, or overlaps any of the percentages listed above. The reduction in the number of couplings 50 used reduces the assembly time of the system, which results in lower costs and improved safety (e.g., the workers spend less time on roofs installing the systems).

As previously discussed the increased shear strength utilizing the four-layer nested sidelap, or other sidelap discussed herein, may be an improvement over a two-layer in-plane sidelap (or in other embodiments a three-layer sidelap seam) because using the four-layer nested sidelap may allow a four-layer nested sidelap system, or other sidelap discussed herein, to drop gage thicknesses (e.g., move from 18 gage to 20 gage, or the like) without sacrificing shear strength. In some embodiments of the invention, a reduction in the thickness of the panels (e.g., a drop down in the gage thickness from 18 to 20, or any other drop) may not be achieved without also increasing the number couplings used in the four-layer nested sidelap, or other sidelaps discussed herein. This would only occur when a reduction in the thickness of the panels using a four-layer nested sidelap, or other sidelaps discussed herein, with the same number of couplings as a two-layer sidelap (or a three-layer sidelap seam) using the thicker panels would not result in the same shear strength or the desired shear strength. Adding additional couplings in the four-layer nested sidelap, or other sidelaps discussed herein, may achieve the desired shear strength, while still reducing costs because the material is less expensive (e.g., thinner structural panels), even though creating the additional couplings in the seam may increase the cost of assembly (e.g., if the cost of inserting the fasteners of the present invention were less than the cost savings of the thinner structural panels). As such, in some embodiments of the invention, depending on the material thickness of the panels, the length of the nested sidelap, the type of four-layer nested sidelap, or other sidelaps herein, the type of couplings, or other like parameters, the thickness (or in other embodiments of the invention the weight) of the panels may be reduced by 5, 10, 15, 20, 25, 30, 35, 40, 45, 50, 55, 60, 65, 70, 75, 80, 85, 90, 95, 100, 110, 120, 130, 150, or more percent, while still achieving the same shear strength as a two-layer sidelap (or a three layer sidelap seam) that utilizes the same, more, or in some cases less couplings.

Generally, because of the additional strength at the sidelaps 13 discussed herein (e.g., the sidelap with the reinforcing member 250, the four-layer sidelap seam 314, and/or the three or more layer nested sidelaps 414) the overall structural panel system may be less flexible when compared the same structural panel system with a two-layer in-plane sidelap or three layer sidelap seam, with all other features being the same. As such, in some applications of the structural panel system in some types of building structures, it may be desirable to improve the diaphragm system flexibility or ductility (e.g., reduce stiffness) at the expense of the shear strength. The sidelaps of the present invention may facilitate the ability to improve flexibility without degrading the shear strength. As discussed herein, improvements in the flexibility may be achieved through a number of different ways, such as reducing the thickness of the structural panels 2, reducing the number of couplings in the sidelaps 13, using the connection patterns described herein (e.g., no connections with the intermediate support members 31, or no connections at alternating intermediate support members 31), changing the orientation of the panels (e.g., as discussed in further detail below), or the like, all of which can be achieved while maintaining the desired shear strength of the sidelaps 13 or structural panel systems. As such, not only may the sidelaps 13 discussed herein be utilized to increase the shear strength of the sidelap, but may also be used to increase the diaphragm system flexibility of the ductile fluted panel systems 1, 100 while keeping the shear strength the same or similar to two layer sidelap configurations.

The sidelaps discussed herein have been discussed with respect to being either in wall panel systems 1 and/or roof panel systems 100; however, it should be understood that the sidelaps discussed herein may be utilized in either wall panel systems 1 or roof panel systems 100, or within different zones of wall panel systems 1 or roof panels systems 100. For example, different areas within a roof and/or wall panel system may require different strengths and/or flexibility. As such, the present invention may be utilized to provide systems that have the desired flexibility, strength, and/or cost.

Figure 18:
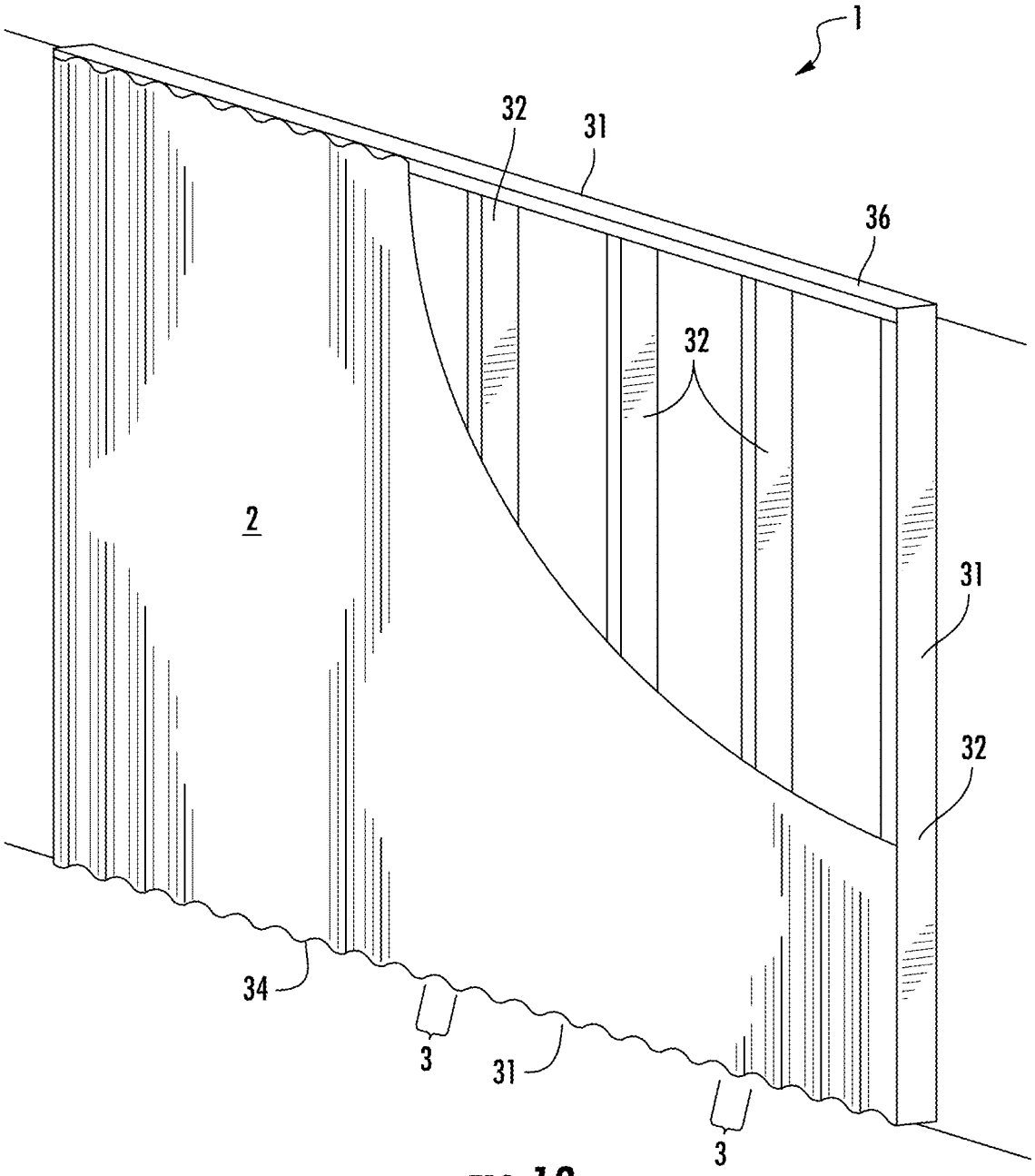
FIG. 18 illustrates a perspective view of a portion of a wall panel system having wall panels with a plurality of longitudinal flutes oriented in parallel with vertical support members, in accordance with embodiments of the invention.
Figure 19:
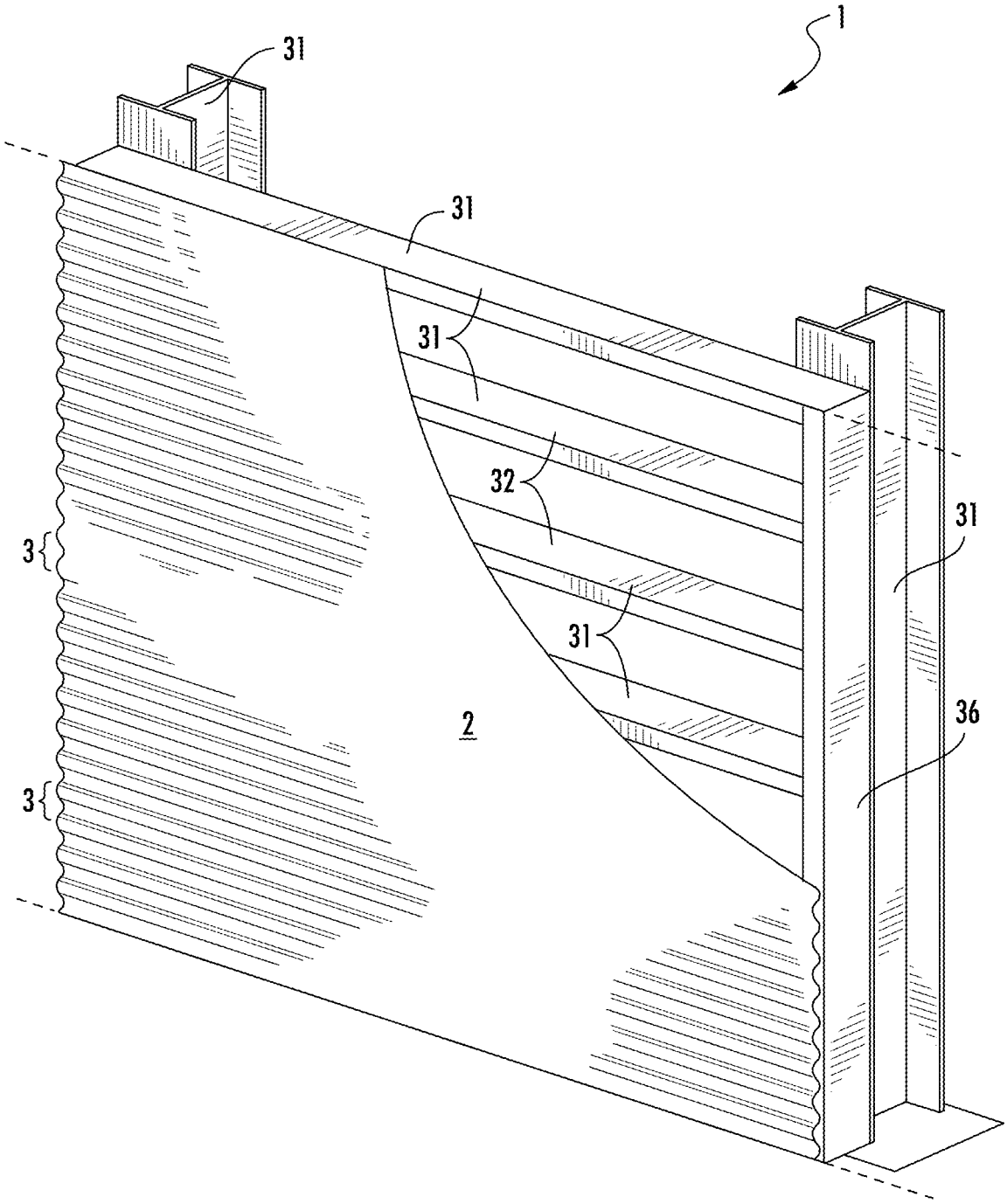
FIG. 19 illustrates a perspective view of a portion of a wall panel system having wall panels with a plurality of longitudinal flutes oriented in parallel with horizontal support members, in accordance with embodiments of the invention.

Instead of using the combination of the increased strength along the sidelaps 13 between adjacent panels 2, and the connection configurations described herein, in order to achieve the buckling spans of the ductile fluted panel systems 1, 100 described herein, the orientation of the decking panels 2 may be changed. Changing the orientation of the panels 2 may also provide for improved flexibility of the roof and/or wall panel systems. FIG. 18 illustrates a perspective view of a portion of a ductile fluted wall panel system 1000 having a panel 2 with longitudinal flutes 3 oriented in parallel with longitudinal support members 31 (e.g., in a first direction), such as vertical studs 32, and perpendicular with other supports members 31, such as a top cap 34 and a bottom cap 34, in accordance with embodiments of the present invention. Alternatively, FIG. 19 illustrates a perspective view of a portion of a ductile fluted wall panel system 1000 having a panel 2 with longitudinal flutes 3 oriented in parallel with support members 31 (e.g., a first direction), such as horizontal studs 32, and perpendicular with other support members 31, such as vertical columns, in accordance with embodiments of the present invention. As such, the support members 31 may be load-bearing supports, such as the studs 32 illustrated in FIG. 18, or non-load bearing support members 31, such as the studs 32 illustrated in FIGS. 19 and 20.

Figure 20:
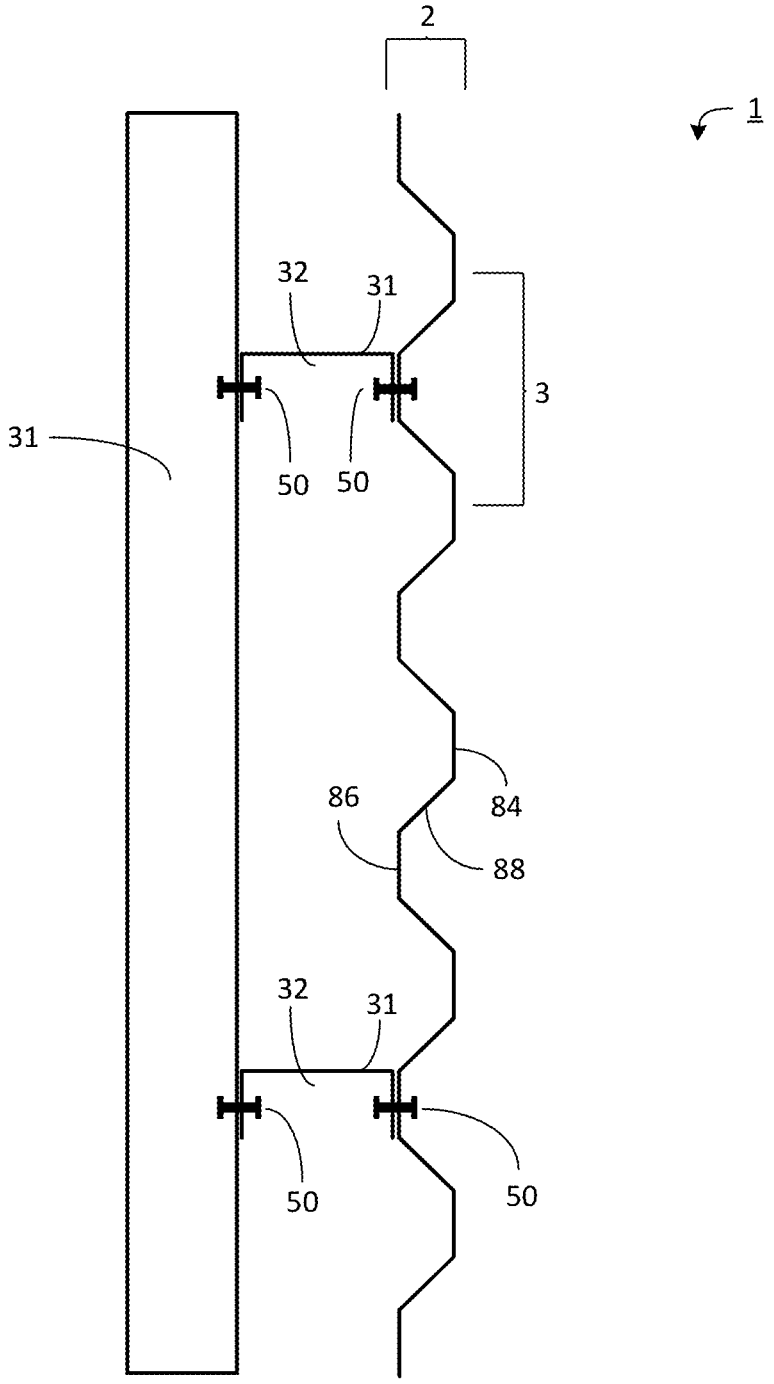
FIG. 20 illustrates a cross-sectional side view of a portion of the wall panel system of FIG. 19, in accordance with embodiments of the invention.

FIG. 20 illustrates a cross sectional view of the wall system 1000 illustrated in FIG. 19 having a panel 2 with flutes 3 oriented in parallel with the support members 31 (e.g., horizontal studs 32), and perpendicular with other support members 31 (e.g., vertical support columns), in accordance with embodiments of the present invention. However, it should be understood that the panels 2 illustrated in FIGS. 18 and 19 are the same panels 2 just oriented in different directions. As previously discussed with respect to the other embodiments of the invention, the panels 2 are operatively coupled together, and/or to the support members 31, through couplings 50. The couplings 50, as described throughout, are typically used to operatively couple the panels 2 together along the panel edges 12, ends 18, and/or to the support members 31 through the second flanges 86 (e.g., inner flanges, bottom flanges, or the like). However, depending on the locations of the support members 31, the panels 2 may be operatively coupled to the support members 31 at the first flanges 84 (e.g., outer flanges, upper flanges, or the like).

Figure 21A:
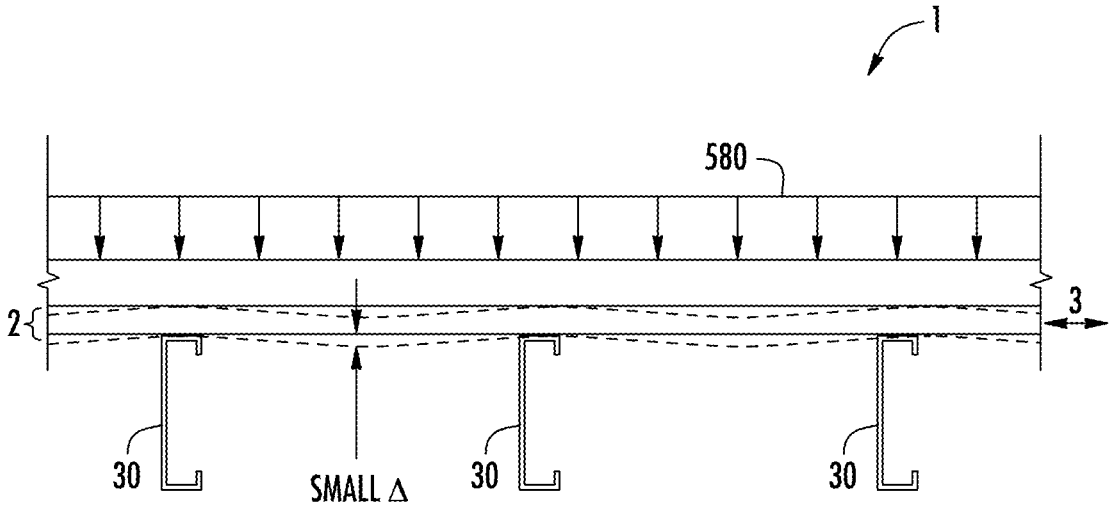
FIG. 21A illustrates a cross-sectional view of a portion of a wall panel system having wall panels with longitudinal flutes oriented transverse to support members, and the effects of out-of-plane loading on this configuration, in accordance with embodiments of the invention.

FIG. 21A illustrates a cross-sectional view of a portion of a wall panel system 500 having wall panels 2 with longitudinal flutes 3 oriented perpendicular to support members 31, and the effects of out-of-plane loading 580 on this configuration. The primary reason for orienting the longitudinal flutes of the panels 2 perpendicular to the support members 31 is to resist out-of-plane loads 580, such as wind loading. FIG. 21A illustrates how this type of configuration resists out-of-plane loading 580, such as the wind loading, to limit deflection to desired levels.

Figure 21B:
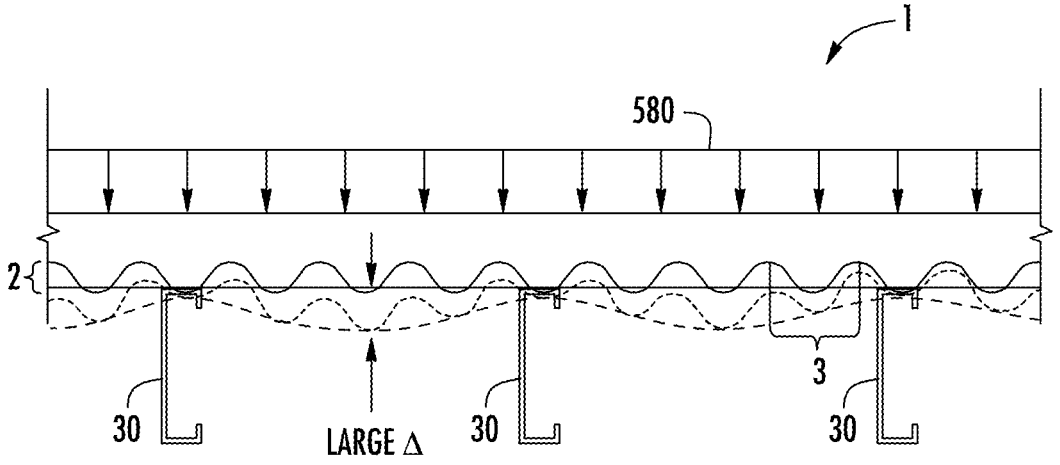
FIG. 21B illustrates a cross-sectional view of a portion of a wall panel system having wall panels with longitudinal flutes oriented parallel to support members, and the effects of out-of-plane loading on this configuration, in accordance with embodiments of the invention.

FIG. 21B illustrates a cross-sectional view of a portion of a ductile fluted wall panel system 1000 having wall panels 2 with longitudinal flutes 3 oriented parallel to support members 31, and the effects of out-of-plane loading, in accordance with embodiments of the present invention. In this configuration the out-of-plane loading 580, such as wind loads, will cause the panels 2 to stretch like an "accordion" producing large deflections of the panel 2 under out-of-plane loading 580. As such, this type of configuration would not typically be acceptable for resisting out-of-plane loading 580, such as wind loads.

Figure 22A:
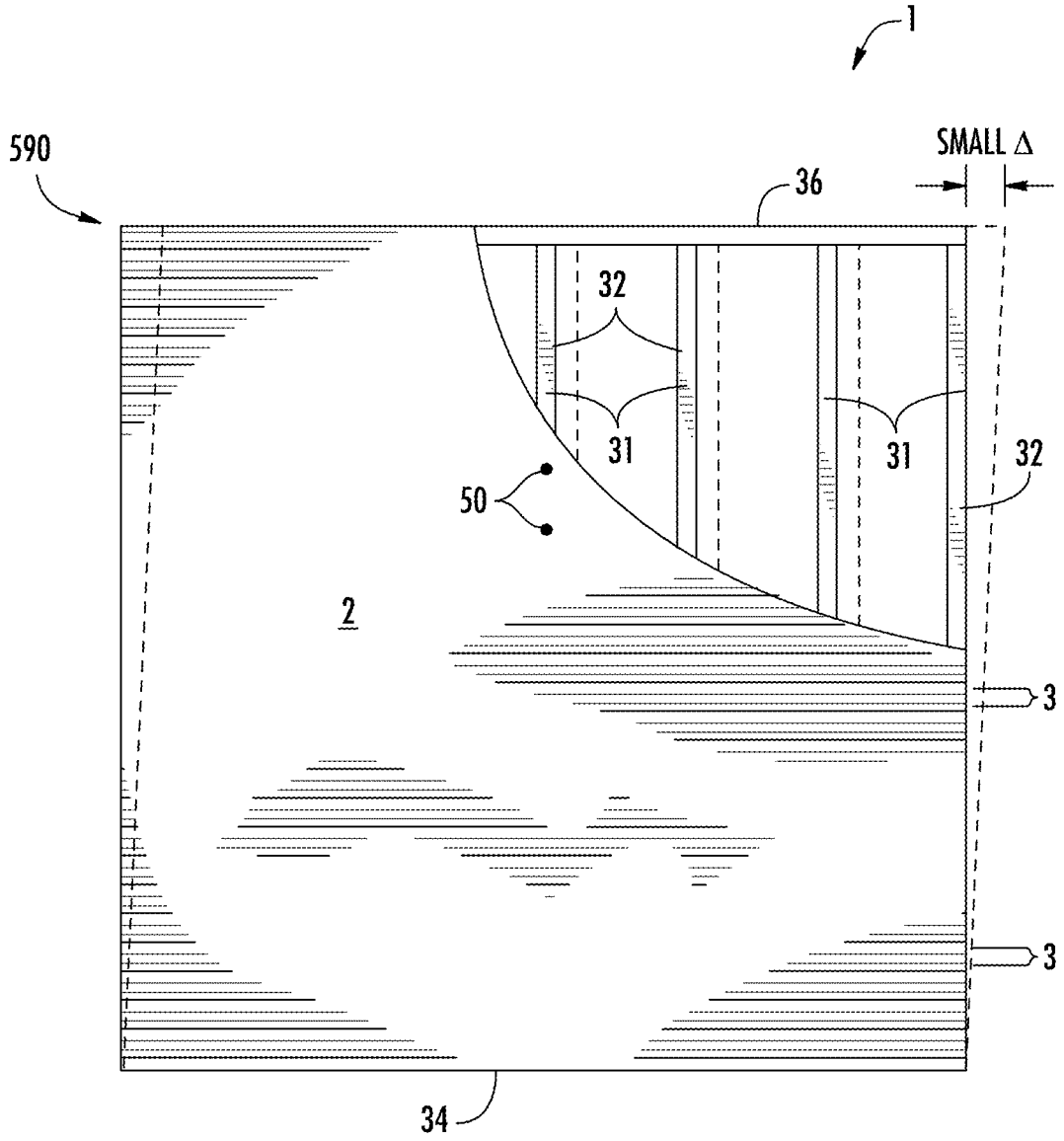
FIG. 22A illustrates a front view of a portion of a wall panel system having wall panels with longitudinal flutes oriented transverse to support members, and the effects of in-plane loading on this configuration, in accordance with embodiments of the invention.

It should be understood that the ability of fluted panels 2 to resist out-of-plane loading 580, such as wind loads, is typically not critical when in-plane loading 590, such as seismic loading, is more of a concern. The key characteristic for ductile fluted wall panel systems 1000 to resist in-plane loading 590, such as seismic loads, is the ductility of the wall panel systems 1000. The ductility of the ductile fluted wall panel system 1000 is directly related to how much in-plane displacement a wall can absorb both leading up to and after the peak shear load is applied. FIG. 22A illustrates a front view of a portion of a wall panel system 500 having wall panels 2 with longitudinal flutes 3 oriented transverse to support members 31 (e.g., studs 32), and the effects of in-plane loading 590 on this configuration. FIG. 22A depicts that the wall panels 2 having longitudinal flutes 3 running transverse to the support members 31 (e.g., studs 32) leads to a very stiff wall panel system in which a relatively small displacement occurs at both the peak loads and post-peak loads. In the configuration illustrated in FIG. 22A, the in-plane loading 590 would typically force the couplings 50 between the panels 2 and the studs 32 to yield. As previously discussed, these couplings 50 may be screws; however, the couplings 50 may be welds, rivets, bolts, clinch couplings, sheared couplings, or other suitable couplings 50. The couplings 50 are relatively rigid, and as the wall panel system 1 is loaded in-plane 590, the couplings 50 yield leading to a small displacement of the wall panel system 1 before the couplings 50 fail by the panel 2 tearing around the couplings 50, the couplings 50 shearing (e.g., fastener shearing), or the couplings 50 pulling out of or away from the support members 31 (e.g., fastener pulling out of the studs 32).

Figure 22B:
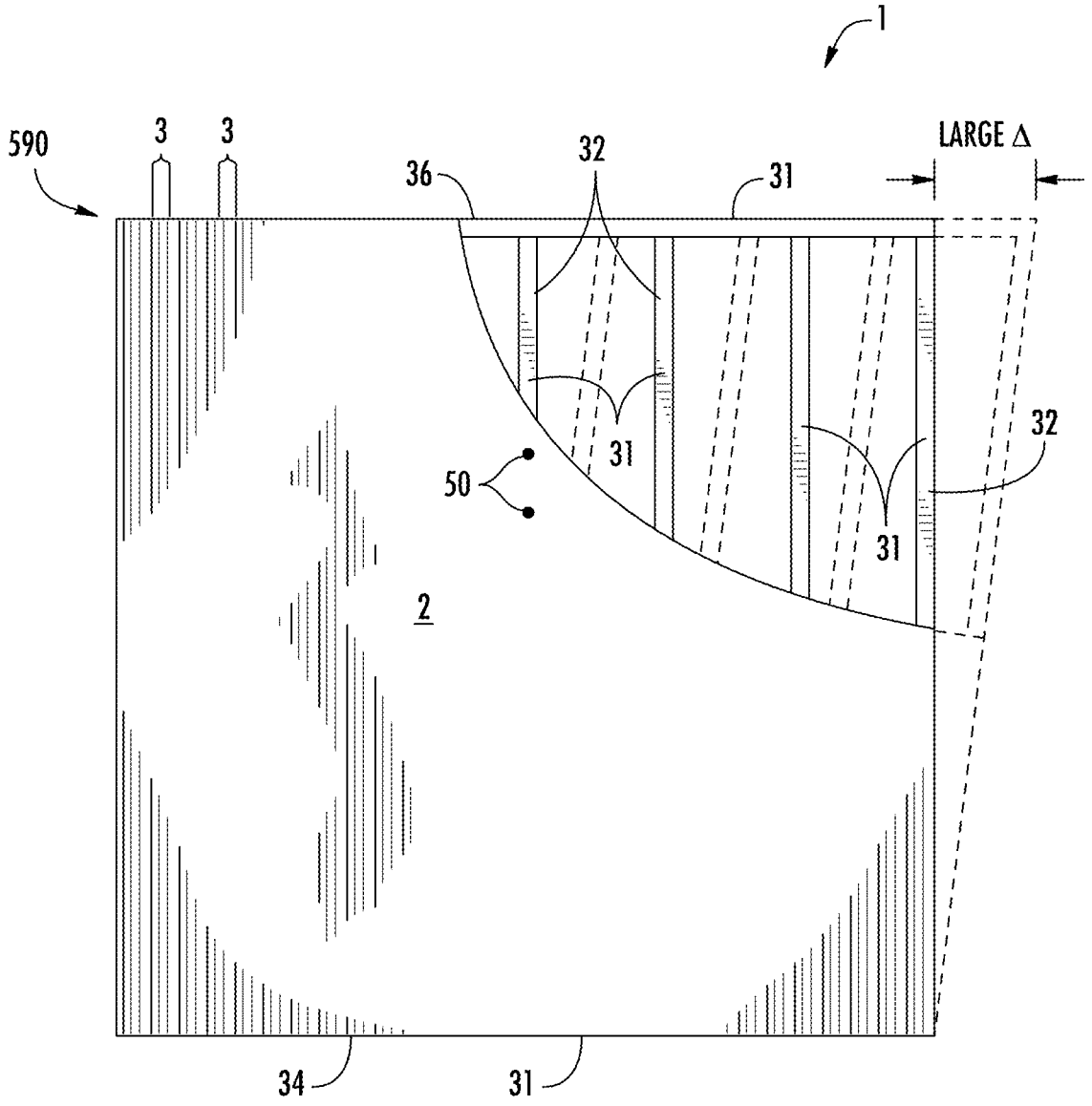
FIG. 22B illustrates a front view of a portion of a wall panel system having wall panels with longitudinal flutes oriented parallel to support members, and the effects of in-plane loading on this configuration, in accordance with embodiments of the invention.

FIG. 22B illustrates a front view of a portion of a ductile fluted wall panel system 1000 having wall panels 2 with longitudinal flutes 3 oriented parallel to support members 31 (e.g., studs 32), and the effects of in-plane loading 590 in this configuration. The configuration with the wall panels 2 having longitudinal flutes 3 running parallel to the support members (e.g., studs 32) is capable of relatively large displacements under in-plane loading 590, such as seismic loading. In this configuration the wall panels 2 are installed in the weak direction, and thus, exhibit a very different type of failure profile. Due to the weak orientation, the panels 2 buckle (e.g., the flutes 3 collapse and expand) well before the couplings 50 are stressed to a level at which they will yield. The buckling of the flutes 3 of the panels 2 allows for relatively large displacements prior to and after the peak load of the wall panel system 1 is reached.

Figure 23:
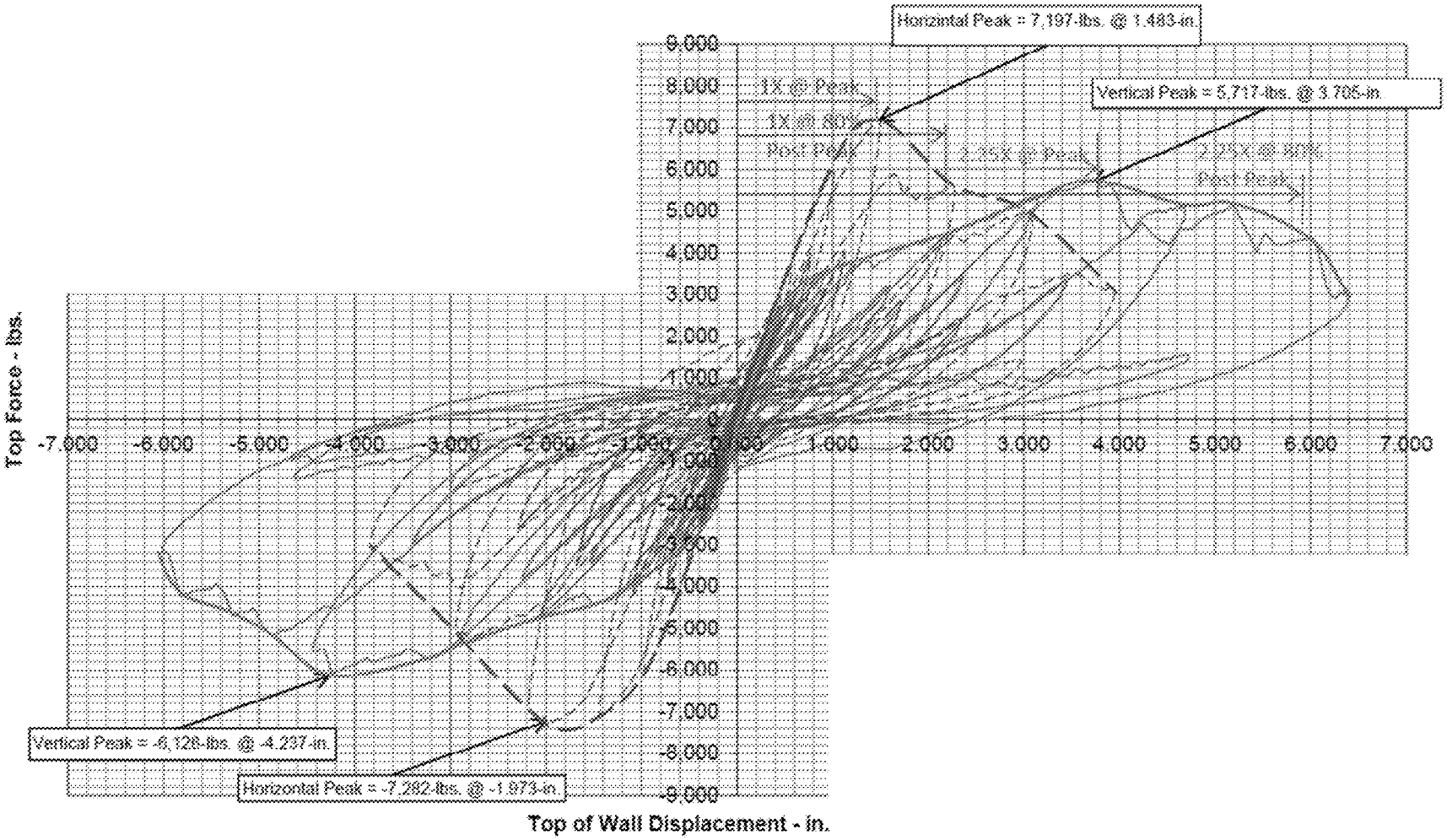
FIG. 23 illustrates a graph of the load displacement of a panel system in which the panels are oriented transverse to the support members verses panels that are oriented parallel to the support members, in accordance with embodiments of the invention.

FIG. 23 illustrates the cyclic load displacement curve and back bone curve for the orientations when the longitudinal flutes 3 are parallel and perpendicular with the support members 31 (e.g., studs 32) overlaid on top of each other. The two primary indicators of the ductility of the wall panel system 1 are the displacement at peak load and the displacement at 80% post peak load. Both the displacement at peak load and at 80% post-peak load are approximately 2.25 times greater for the panels 2 with longitudinal flutes 3 installed parallel to the support members 31 (e.g., studs 32) compared to panels 2 with longitudinal flutes 3 installed transverse to the support members (e.g., studs 32), as illustrated in FIG. 23. As such, in various embodiments of the invention, based on the thickness of the panels, the panel profile, the grade of the steel, or the like, the displacement at peak load and/or at 80% post-peak load may be 1.1, 1.2, 1.3, 1.4, 1.5, 1.6, 1.7, 1.8, 1.9, 2.0, 2.05, 2.1, 2.15, 2.2, 2.25, 2.3, 2.35, 2.4, 2.45, 2.5, or more, times greater for panels 2 with longitudinal flutes installed parallel to the support members 31 (e.g., studs 32) compared to panels 2 with longitudinal flutes installed perpendicular to the support members 31 (e.g., studs 32). In some embodiments the displacement improvement may range between any of these values, or have ranges that fall within, outside of, or overlap any of these values.

FIG. 24 illustrates a general process flow 600 for assembling a ductile fluted panel system 1000. The process 600 includes block 602 of assembling two or more support members 31 to other support members 31, wherein the two or more support members 31 are oriented in a first direction (e.g., vertically, horizontally, or the like). In some embodiments, the support members 31 are studs 32, and the other supports are top or bottom caps, end caps, and/or support columns. In some embodiments of the process 600, the first direction is substantially vertical such that the support members 31 (e.g., studs 32) are in a substantially upright configuration. In other embodiments of the process 600, the first direction is substantially horizontal such that the support members 31 (e.g., studs 32) are in a substantially lateral configuration. In embodiments where the first direction is horizontal, the supports columns may be substantially vertical such that the supports serve as support columns for the ductile panel system 1000.

The process 600 may also include block 604 of assembling a panel 2 (e.g., a first panel) to the two or more studs, wherein the panel 2 comprises a plurality of flutes 3 running longitudinally along the panel 2 in the first direction along with the two or more support members 31.

The process 600 further includes block 606, in which additional panels 2 are operatively coupled to the support members 31, the panel 2 from block 604, and/or each other. The flutes 3 of the additional panels 2 are assembled in the first direction along with the two or more support members 31 and the panel 2 from block 604 in order to form the ductile fluted panel system 1000.

In some embodiments, multiple panels 2 may be assembled together such that they form at least a portion of a roof or wall panel system. In such embodiments, the panels 2 may overlap each other at the ends 18 of longitudinally adjacent panels (e.g., adjacent panels in which the flutes 3 align longitudinally in series) such that longitudinally adjacent panels 2 may be assembled together by using couplings 50 that operatively couple the overlapping portions of the ends 18 together and/or to support members 31. In other embodiments, the panels 2 do not overlap, and the couplings 50 operatively couple the ends 18 of the panels 2 to the support members 31 (e.g., studs 32 or other supports). Laterally adjacent panels 2 (e.g., adjacent panels in which the flutes 3 are not aligned but are positioned parallel to each other) are further configured for coupling along the edges 12 of the panels 2. In such embodiments, the panel edges 12 create a sidelap 13 that may be assembled together by using couplings 50 that operatively couple the edges 12 of adjacent panels 2. These sidelaps may or may not utilize the seams described herein, such as but not limited to sidelaps with the reinforcing member 250, sidelap seams 314, and/or nested sidelaps 414.

In some embodiments of the process 600, the panels 2 and the two or more support members 31 (e.g., studs 32) are assembled such that when the ductile fluted wall panel system 1000 is under its peak load, the displacement of the ductile wall panel system 1 is at least 1.5 (e.g., approximately 2.25) times greater than wall panel systems 500 having flutes 3 oriented transverse to the support members 31 (e.g., studs 32) without the increased shear strength at the sidelaps and without the connection configurations described herein.

In some embodiments of the process 600, the panel 2 and the two or more support members 31 (e.g., studs 32) are assembled such that when the ductile fluted wall panel system 1000 is under eighty percent (80%) of its peak load, the displacement of the ductile wall panel system 1000 is at least 1.5 (e.g., approximately 2.25) times greater than wall panel systems 500 having flutes oriented transverse to the support members 31 (e.g., studs 32) without the increased shear strength at the sidelaps and without the connection configurations described herein.

The displacement of the ductile fluted wall panel system 1000 is due to the parallel configuration of the panels 2 with the support members 31, as this configuration provides less rigidity in a wall panel system. The reduced rigidity gives the ductile fluted wall panel system 1000 greater resiliency with respect to in-plane cyclic loading, such as seismic activity, whereby the panels 2 are allowed to bend and buckle due to the loading instead of transferring substantial forces to couplings 50 between the panels 2 and the support members 31 (e.g., studs 32). The reduced transferred forces on the couplings 50 between the panels 2 and the support members 31 (e.g., studs 32) reduces the likelihood that the connections (e.g., the couplings 50 or panels around the couplings 50) will fail, allowing the panels 2 of a ductile fluted wall panel system 1000 to buckle and continue to remain attached to the support structures 31 (e.g., studs 32) after enduring external forces that would have removed a fluted panel in a transverse configuration (without the increased shear strength at the sidelap and connection configurations discussed herein). However, it should be understood that these ductile fluted panel systems 1000 having flutes 3 running parallel to the support members 31 are not very resilient to other types of loading. As such, the ductile fluted panel systems 1, 100 that combines both the increased shear strength along the sidelaps 13, 314, 414, and the connection configurations described herein, provide and improved system that allows for increased displacement during cyclic in-plane loading, while still providing the desired strength in other types of loading (e.g., wind loading or other building loading). Alternatively, while ductile fluted panel systems 1000 having flutes 3 running parallel to the support members provides improvements for cyclic loading, these configurations have reduced strength during other types of loading.

It should be understood the orientating the panels 2 in parallel with the support members 31 (e.g., studs 32) has been described with respect to a ductile fluted wall panel system 1000. However, it should be understood that this same principal may be utilized in a roof panel system, and the same results may be achieved.

It should be understood that the combinations of different embodiments described herein allows for improved ductile fluted panel systems, which lead to a safer and more cost effective panel system when protection from in-plane loading 590 is more important than out-of-plane loading 580, such as when protection from seismic loading is more important than resisting wind loading.

It should be further understood that combinations of different embodiments described herein may be used within the ductile fluted wall panel systems 1, the ductile fluted roof panel systems 100, and/or building systems utilizing both the ductile fluted wall panels systems 1 and the ductile fluted roof panel systems 100. For example, in some embodiments different types of sidelaps (e.g., sidelap with reinforcing member 250, four-layer sidelap seam 314, three or four layer nested sidelap 414, or the like) may be utilized within different sections of the same ductile fluted wall panel system 1 and/or the same ductile fluted roof panel system 100. Moreover, in other examples, a ductile fluted wall panel systems 1 with one or more types of sidelaps will be used in the same building system with a ductile fluted roof panel systems 100 with one or more types of sidelaps. In one example, a ductile fluted wall panel system 1 with the reinforcing member 250 at the sidelap may be utilized as a wall within a building system, while a ductile fluted roof panel system with the sidelap seam 314 and/or the nested sidelap 414 may be utilized as a floor and/or roof within the building system. It these particular embodiments it may be easier to assemble the wall system with the reinforcing member 250, while it may be easier to assemble the floor and/or roof structure with the sidelap seam 314 and/or the nested sidelap 414.

It should be further understood when describing that a component is perpendicular with another component, perpendicular may be perpendicular (e.g., 90 degrees, or the like), substantially perpendicular (e.g., 80 to 100 degrees, or the like), or generally perpendicular (e.g., 45 degrees to 135 degrees, or the like) (e.g., the flutes 3 of a panel are perpendicular, substantially perpendicular, or generally perpendicular to the support members 31, or the like). Moreover, it should be further understood when describing that a component is parallel with another component, parallel may be parallel (e.g., 0 degrees, or the like), substantially parallel (e.g., −10 to 10 degrees, or the like), or generally parallel (e.g., −45 degrees to 45 degrees, or the like) (e.g., the flutes 3 of a panel are parallel, substantially parallel, or generally parallel to the support members 31, or the like).

It should be understood that "operatively coupled," when used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more."

What is claimed is:

1. A method of forming a structural panel system, comprising:

assembling a first panel and a second panel to a support structure, wherein:

the first panel comprising first flutes, opposing ends, and opposing edges comprising at least a first edge;

the second panel comprising second flutes, opposing ends, and opposing edges comprising at least a second edge;

the support structure comprises:

a first support member;

a second support member;

one or more intermediate support members, wherein the first support member, the second support member, and the one or more intermediate support members are generally parallel with each other;

a third support member; and a fourth support member;

wherein the third support member and the fourth support member are oriented generally perpendicular to and operatively coupled to opposing ends of the first support member, the second support member, and the one or more intermediate support members; and wherein the first flutes of the first panel and the second flutes of the second panel are oriented generally perpendicular with the first support member, the second support member, and the one or more intermediate support members and generally parallel with the third support member and the fourth support member;

assembling a sidelap formed between the first edge of the first panel and the second edge of the second panel;

assembling panel edge couplings to operatively couple the first edge of the first panel to the second edge of the second panel at the sidelap; and assembling end support couplings to operatively couple the opposing ends of the first panel and the second panel to the first support member and the second support member; and wherein the first panel and the second panel are void of couplings between the opposing edges and the opposing ends of the first panel and the second panel located between the first support member and the second support member, and the third support member and fourth support member where the first panel and the second panel cross at least one of the one or more intermediate support members.

2. The method of claim 1, further comprising:

assembling edge support couplings to operatively couple the first edge of the first panel to the second edge of the second panel and to the one or more intermediate support members where the sidelap crosses at least one of the one or more intermediate support members.

3. The method of claim 1, wherein assembling the sidelap comprises assembling a reinforcing member to the first edge of the first panel and the second edge of the second panel, wherein the reinforcing member comprises:

a first channel and a second channel;

wherein the first channel and the second channel are generally parallel to each other, and out of plane with respect to each other;

wherein when assembled the first edge of the first panel is located within the first channel, and the second edge of the second panel is located within the second channel to form the sidelap; and wherein the panel edge couplings operatively couple the first edge of the first panel, the second edge of the second panel, and the reinforcing member together.

4. The method of claim 1, wherein assembling the sidelap comprises forming a sidelap seam that is out-of-plane and formed from the first edge of the first panel being a male lip and the second edge of the second panel being a female lip, wherein the male lip and the female lip form the sidelap seam comprising four or more layers.

5. The method of claim 1, wherein assembling the sidelap comprises forming a nested sidelap that is in-plane and formed from the first edge of the first panel being an in-plane edge and the second edge of the second panel being an in-plane edge, wherein the first edge and the second edge form the nested sidelap comprising three or more layers.

6. The method of claim 1, wherein the one or more intermediate support members comprise at least three or more intermediate supports, and wherein the method further comprises:

assembling panel support couplings in a middle intermediate support of the three or more intermediate supports to reduce a buckling span of the first panel and the second panel.

7. The method of claim 1, wherein the structural panel system comprises a ductile fluted roof panel system.

8. The method of claim 3, wherein the reinforcing member comprises:

a first leg;

a second leg; and a third leg;

wherein the first leg is operatively coupled to the second leg and forms the first channel; and wherein the second leg is operatively coupled to the third leg and forms the second channel.

9. The method of claim 1, wherein the third support member comprises a top cap and the fourth support member comprises a bottom cap for the first support member, the second support member, and the one or more intermediate support members.

10. A method of forming a structural panel system, comprising:

assembling two or more panels to a support structure, wherein:

each of the two or more panels comprise:

flutes;

opposing ends; and opposing edges;

the support structure comprises:

a first support member;

a second support member;

one or more intermediate support members, wherein the first support member, the second support member, and the one or more intermediate support members are generally parallel with each other;

a third support member;

a fourth support member, wherein the third support member and the fourth support member are oriented generally perpendicular to and operatively coupled to opposing ends of the first support member, the second support member, and the one or more intermediate support members; and wherein the flutes of the two or more panels are oriented generally perpendicular with the first support member, the second support member, and the one or more intermediate support members and generally parallel with the third support member and the fourth support member;

assembling a sidelap between adjacent edges of adjacent panels of the two or more panels;

assembling panel edge couplings to operatively couple the sidelap between the adjacent edges of the two or more panels; and assembling end support couplings to operatively couple the opposing ends of the two or more panels to the first support member and the second support member; and wherein the two or more panels are void of couplings between the opposing edges and the opposing ends of the two more panels between the first support member and the second support member, and the third support member and fourth support member where the two or more panels cross at least one of the one or more intermediate support members.

11. The method of claim 10, further comprising:

assembling edge support couplings to operatively couple the sidelap between the adjacent panels of the two or more panels to the one or more intermediate support members where the sidelap crosses at least one of the one or more intermediate support members.

12. The method of claim 10, wherein assembling the sidelap comprises assembling one or more reinforcing members between the adjacent edges of the adjacent panels, wherein each of the one or more reinforcing members comprise:

a first channel and a second channel;

wherein the first channel and the second channel are generally parallel to each other, and out of plane with respect to each other;

wherein when assembled in the sidelap between the adjacent edges of the adjacent panels of the two or more panels, an edge of a panel is located within the first channel, and an edge of an adjacent panel is located within the second channel; and wherein the panel edge couplings operatively couple the edge of the panel and the edge of the adjacent panel to the one or more reinforcing members.

13. The method of claim 10, wherein assembling the sidelap comprises forming a sidelap seam that is out-of-plane and formed between the adjacent edges of the adjacent panels of the two or more panels, wherein an edge of a panel comprises a male lip and an edge of an adjacent panel comprises a female lip, wherein the male lip and the female lip form the sidelap seam comprising four or more layers.

14. The method of claim 10, wherein assembling the sidelap comprises forming a nested sidelap that is in-plane and formed between the adjacent edges of the adjacent panels of the two or more panels, wherein an edge of a panel comprises a first in-plane edge and an edge of an adjacent panel comprises a second in-plane edge, wherein the first in-plane edge and the second in-plane edge form the nested sidelap comprising three or more layers.

15. The method of claim 10, wherein the one or more intermediate support members comprise at least three or more intermediate supports, and wherein the method further comprises:

assembling panel support couplings in a middle intermediate support of the three or more intermediate supports to reduce a buckling span of the two or more panels.

16. The method of claim 10, wherein the structural panel system comprises a ductile fluted roof panel system.

17. The method of claim 12, wherein the one or more reinforcing members each comprise:

a first leg;

a second leg; and a third leg;

wherein the first leg is operatively coupled to the second leg and forms the first channel; and wherein the second leg is operatively coupled to the third leg and forms the second channel.

18. A method of forming a structural panel system, comprising:

assembling a first panel and a second panel to a support structure, wherein:

the first panel comprising first flutes, opposing ends, and opposing edges comprising at least a first edge;

the second panel comprising second flutes, opposing ends, and opposing edges comprising at least a second edge;

the support structure comprises:

a first support member;

a second support member;

one or more intermediate support members, wherein the first support member, the second support member, and the one or more intermediate support members are generally parallel with each other;

a third support member;

a fourth support member, wherein the third support member and the fourth support member are oriented generally perpendicular to and operatively coupled to opposing ends of the first support member, the second support member, and the one or more intermediate support members;

wherein the first panel and the second panel are oriented generally perpendicular with the first support member, the second support member, and the one or more intermediate support members; and assembling a reinforcing member to the first edge of the first panel and the second edge of the second panel, wherein the reinforcing member comprises a first channel and a second channel, wherein the first channel and the second channel are generally parallel to each other, and out of plane with respect to each other, and wherein when assembled, the first edge of the first panel is located within the first channel and the second edge of the second panel is located within the second channel to form a sidelap;

assembling couplings to operatively couple the first panel and second panel to the first support member, the second support member, the third support member and the fourth support member; and wherein the first panel and second panel are void of the couplings between the opposing edges and the opposing ends of the first panel and the second panel located between the first support member and the second support member, and the third support member and the fourth support member where the first panel and second panel cross at least one of the one or more intermediate support members.

19. The method of claim 18, wherein the reinforcing member comprises:

a first leg and a second leg forming the first channel; and a third leg and the second leg forming the second channel;

wherein the first channel and the second channel are open in opposite directions; and wherein the reinforcing member comprises three layers and when assembled with the first edge of the first panel and the second edge of the second panel forms the sidelap with at least five layers.

20. The method of claim 18, wherein assembling the couplings comprise:

assembling edge support couplings operatively coupling the first edge of the first panel, the second edge of the second panel, and the one or more intermediate support members when the sidelap crosses the one or more intermediate support members; and assembling end support couplings operatively coupling the opposing ends of the first panel and the second panel to the first support member and the second support member;

wherein the first flutes of the first panel and the second flutes of the second panel are oriented generally perpendicular with the first support member, the second support member, and the one or more intermediate support members and generally parallel with the third support member and the fourth support member.

* * * * *